US006376995B1

(12) United States Patent
Kato et al.

(10) Patent No.: US 6,376,995 B1
(45) Date of Patent: Apr. 23, 2002

(54) PLASMA DISPLAY PANEL, DISPLAY APPARATUS USING THE SAME AND DRIVING METHOD THEREOF

(75) Inventors: Tetsuya Kato, Sagamihara; Kazuo Tomida, Fuchu; Yoshio Watanabe, Yokohama; Hiroki Kono, Toyonaka, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/469,350

(22) Filed: Dec. 22, 1999

(30) Foreign Application Priority Data

| | | |
|---|---|---|
| Dec. 25, 1998 | (JP) | 10-369151 |
| Feb. 23, 1999 | (JP) | 11-044393 |
| Jun. 24, 1999 | (JP) | 11-177931 |
| Jun. 24, 1999 | (JP) | 11-177936 |
| Jul. 21, 1999 | (JP) | 11-205933 |
| Aug. 3, 1999 | (JP) | 11-219735 |

(51) Int. Cl.[7] ..... G09G 3/10

(52) U.S. Cl. ..... 315/169.3; 315/169.2; 315/169.4; 345/67; 345/204

(58) Field of Search ..... 315/169.1, 169.2, 315/169.3, 169.4; 345/55, 60, 67, 204

(56) References Cited

U.S. PATENT DOCUMENTS

| | | | | |
|---|---|---|---|---|
| 5,107,182 A | * | 4/1992 | Sano et al. | 315/169.4 |
| 5,661,500 A | * | 8/1997 | Shinoda et al. | 345/60 |
| 5,674,553 A | * | 10/1997 | Shinoda et al. | 427/68 |
| 5,943,030 A | * | 8/1999 | Minamibayashi | 315/169.3 |
| 5,995,069 A | * | 11/1999 | Tokunaga et al. | 315/169.4 |
| 6,037,916 A | * | 3/2000 | Anemiya | 345/60 |
| 6,084,559 A | * | 7/2000 | Nagao et al. | 345/67 |
| 6,144,349 A | * | 11/2000 | Awata et al. | 345/60 |
| 6,160,530 A | * | 12/2000 | Makino | 345/67 |

FOREIGN PATENT DOCUMENTS

| | | |
|---|---|---|
| JP | S57-22289 | 2/1982 |
| JP | 5-41164 | 2/1993 |
| JP | 5-41165 | 2/1993 |
| JP | 6-275202 A | 9/1994 |
| JP | 7-021929 A | 1/1995 |
| JP | 52-91373 | 1/1997 |
| JP | 9-068944 A | 3/1997 |

* cited by examiner

*Primary Examiner*—Don Wong
*Assistant Examiner*—Thuy Vinh Tran
(74) *Attorney, Agent, or Firm*—Parkhurst & Wendell, LLP

(57) ABSTRACT

The PDP of the present invention has first, second and third electrodes. Intervals between the first and second electrode is 0.2 mm or more. A plurality of third electrodes are formed. Protrusions which are shorter than ribs are formed between the plurality of third electrodes. The plurality of third electrodes are connected, in part, to one another or at least connected in part, such that they form a network. In the driving method of the PDP of the present invention, a self-erasing discharge is generated, and subsequently when a potential difference between the electrodes is increased, using the self-erasing discharge as a trigger, discharge is generated and light is emitted.

50 Claims, 59 Drawing Sheets

VOLTAGE

VOLTAGE

VOLTAGE
TIME

VOLTAGE

VOLTAGE
DISCHARGE
INITIATION

VOLTAGE
TIME

VOLTAGE

VOLTAGE

VOLTAGE
DISCHARGE
INITIATION
TIME

VOLTAGE

ELECTRODE 21
VOLTAGE

ELECTRODE 22
VOLTAGE

ELECTRODE 23
TIME

VOLTAGE

ELECTRODE 21
VOLTAGE

ELECTRODE 22
VOLTAGE

ELECTRODE 23
DISCHARGE
INITIATION
TIME

VOLTAGE
Vs
gnd

VOLTAGE
Vs
gnd

VOLTAGE
2Vs
RESTING PERIOD
POTENTIAL CHANGING PERIOD
TIME

VOLTAGE
Vs
gnd

VOLTAGE
Vs
gnd

VOLTAGE
2Vs
A HALF CYCLE
ONE CYCLE
TIME

VOLTAGE
Vs
gnd
Psus

VOLTAGE
Vs
gnd

VOLTAGE
205
Vs
206
gnd

VOLTAGE
2Vs
TIME

VOLTAGE
Vs
gnd

VOLTAGE
Vs
gnd

VOLTAGE
POTENTIAL CHANGING
SPEED 0.9V/ns
2Vs

Ic
Id
Ic
Id
TIME

VOLTAGE
50μsac
Vs
gnd

VOLTAGE

Vs
gnd
POTENTIAL CHANGING
SPEED 1.6V/ns
VOLTAGE

2Vs
VOLTAGE

Ic
Id
Ic
Id
Ic
TIME

PLASMA DISPLAY PANEL, DISPLAY APPARATUS USING THE SAME AND DRIVING METHOD THEREOF

FIELD OF THE INVENTION

The present invention relates to plasma display panels, display apparatuses using the same and their driving methods, especially to the display panels which have unconventionally high luminance and emission efficiency.

BACKGROUND OF THE INVENTION

Plasma display panel (PDP)s have faster displaying speed, wider visual field, are easier in enlarging the size, and, since they emit light by themselves, better picture quality than liquid crystal displays (LCD) is obtained. Due to these characteristics, among flat panel display technologies, they are attracting special attention. In general, in PDP technology, ultraviolet rays are generated by gas discharge. The UV rays excite the phosphor to emit light to display color image. Display pixels (pixels) which are divided by ribs, are disposed on substrates. The phosphor layer is formed in the display pixels. The current main PDPs are three-electrode surface discharge type PDPs.

FIG. 58 shows a perspective exploded view illustrating the construction of a conventional three-electrode surface discharge type PDP. As FIG. 58 shows, the conventional PDP has pairs of display electrodes comprising a scan electrode 1 and a sustain electrode 2 placed closely and in parallel with each other on one of the substrates. Address electrodes 3 extending transversely to the display electrodes and ribs 16 and a phosphor layer 17 are disposed on the other substrate. This construction allows the phosphor layers to be comparably thicker, thus suitable for color displays.

As a discharge between the electrode 1 and 2 emits light which displays the image, it is called a sustain discharge, or, since it occurs in parallel with a substrate 10, it is called a surface discharge. A dielectric layer 4 is formed on the electrodes, and for protection, it is coated with a protective layer 5 made of MgO. Space charge of electrons and cations ionized by discharge is accumulated on the dielectric layer 4. This space charge is called "wall charge". In PDPs, the voltage of the wall charge and the voltage applied from outside control the discharge.

The electrodes 1 and 2 are transparent electrodes, and they output light emitted at their bottom outside of the substrate 10. A plurality of electrodes 3 are disposed transversely perpendicular to the electrodes 1 and 2. An address discharge that selects the pixels to emit light for displaying, occurs between the electrodes 3 and the electrode 2. The address discharge is also called transverse discharge since it occurs perpendicularly between the substrate 10 and substrate 20. R, G and B phosphor 8 are disposed on the electrodes 3. To prevent the colors of the phosphor 8 from mixing, ribs 16 are placed parallel to the electrodes 3.

In a conventional driving method of a PDP, one field period is divided into a plurality of sub-fields, and by combining these sub-fields graduation is displayed. Each sub-field comprises a setup period, an address period, a sustain (display discharge) period and an erase (discharge termination) period.

To display image data, different signal waveforms determined by the setup, address and sustain periods, are applied on each of the electrodes. During the setup period, setup pulses are applied on all of the electrodes 1.

During the address period, writing pulses are applied between the electrodes 3 and the electrodes 1 to make address discharge and to select discharge pixels.

In the following sustain period, cyclical sustain pulses which are inverted alternatively are applied between the electrode 1 and the electrode 2 for a predetermined period to make the sustain discharge between the two electrodes and to display images.

Finally, during the erase period, a weak discharge is generated to remove unevenness of the wall charge between pixels caused by the discharge during the sustain period. Then, the same process is repeated in the following sub-field.

However, the plasma display devices using the conventional PDPs have problems of low emission efficiency and low luminance. For example, the emission efficiency is 11 m/W, which is only a fifth of that of CRT display devices.

The reason for this low efficiency is that in the case of PDPs, the strength of emission obtained at each discharge is virtually the same, and the luminance is low. In one field period, there are the startup and address periods that do not contribute to the emission but occupy more than half of one field period. To intensify the luminance of the display within a limited time, sustain pulses should be increased. As a result, frequency and cycle of the sustain pulses of the conventional PDPs are set to be about 200 KHz and 5 $\mu$s respectively.

The sustain pulses have startup time and terminating time, and PDPs are capacitive loads. Circuit which collect ineffective power associated with charging and discharging of the sustain pulse require about 500 ns each. Furthermore, in the first 200 ns after the starting up of the sustain pulses, discharge does not occur due to a statistical delay. And, there is discharge sustaining time lasting about 1 $\mu$s. Therefore, it is difficult to improve the luminance of the screen with the conventional PDPs by increasing frequency of the sustain pulses further.

In the case of high definition panels, which is expected to enjoy increasing demand, the ribs that partition pixels increases in terms of their proportion on the display. The ribs do not contribute to the light emission, therefore, emissive area decreases, lowering the luminance of the display.

A lot of effort has been made to solve the problems mentioned above. In one effective method, positive column is used to enhance the emission efficiency of the UV rays. However, no PDPs adopting this method have been commercialized yet.

The possible reasons for this are:

a) distance between electrodes necessary to generate positive column can not be obtained since the sizes of the pixels of PDPs are limited, and b) discharge can not be stabilized only by expanding the distance between electrodes, because it is difficult to control the discharge. Related patents to the foregoing method are Japanese Patent Laid Open Unexamined Publication No. H05-41165, Japanese Patent Laid Open Unexamined Publication No. H05-41164, and Japanese Patent Laid Open Unexamined Publication No. H06-275202. However, all of them have failed to achieve satisfactory results.

The present invention aims to provide PDPs, their display devices and driving methods of the same which achieve a stable use of the positive column, high luminance and high emission efficiency.

SUMMARY OF THE INVENTION

The PDP of the present invention comprises:

a first substrate on which first and second electrodes are disposed;

a second substrate on which third electrodes are disposed transversely to the first and second electrodes, and which, together with the first substrate, sandwiches the discharge space;

ribs dividing the discharge space into emission units (EU); and phosphor layer.

Further, protrusions shorter than the ribs are disposed between the first and second electrodes.

Another PDP of the present invention has a first substrate having first and second electrodes thereon. On the first substrate, third electrodes are also disposed transversely to the first and second electrodes at right angles, via a dielectric material.

The intervals between the first and second electrodes are 0.2 mm or more. A plurality of third electrodes is disposed in a EU. Protrusions shorter than the ribs are disposed between the plurality of the third electrodes. The protrusions are disposed in parallel with the third electrodes in such a manner that they form stripes. The plurality of third electrodes is connected to each other or connected such that they form a network at least in part.

A plurality of fourth electrodes (float electrode) is formed between the neighboring first and second electrodes. At least a part of the float electrodes is connected to one another.

The intervals between the first and second electrodes are 0.2 mm or more, longer than that of neighboring ribs. In between the neighboring first and second electrodes is part of the ribs.

The driving method of the PDP of the present invention includes;

generating self-erasing discharge (self-erasing discharge here means a discharge which is generated by its own wall charge when a potential between electrodes is reduced) in the PDP having at least three different kinds of electrodes (first, second and third electrodes); and then generating discharge and emitting light using the self-erasing discharge as a trigger when a potential difference between the electrodes is increased.

Another driving method of the PDP of the present invention includes:

producing a potential difference between the first and second electrodes, the first and third electrodes and/or the third and second electrodes;

putting discharge current (I main) to flow to emit light between the first and second electrodes;

applying counter electromotive force (Vemf-main) which suppresses fluctuation of the discharge current to the first electrode and/or the second electrode; and putting discharge current (I sub) to flow between the third and second electrodes and/or the first and third electrodes.

With yet another driving method of the present invention, sustain pulses are applied to the third electrodes on the second substrate when the sustain discharge occurs between the first and second electrodes on the first substrate, and a sustain discharge is generated between one of the first and second electrodes or both of them and the third electrodes.

By driving the PDP of the present invention by the driving method of the present invention, positive column discharge is generated firmly, suppressing flickering of the discharge of the plasma display device. Since the self-erasing discharge can be used as a trigger discharge, the positive column discharge of the following cycle can be triggered at low voltages. Further, stable sustaining of the discharge becomes possible.

The positive column discharge produced in the foregoing manner, is remarkably efficient, realizing strong emission. Furthermore, the positive column discharge of the following cycle can be generated at low voltages. In addition, in the case of PDP in which a phosphor layer is formed on the third electrodes, degradation of the phosphor layer can be decreased.

Part of the discharge occurring near the first substrate occurs near the second substrate as well. Therefore, ultraviolet rays move toward the second substrate, increasing light emitted from the phosphor near the second substrate and increasing the luminance of the screen of the PDP. Further, power consumption is reduced.

When all of the three electrodes are formed on the same substrate, materials with a high secondary emission coefficient can be used as a protective layer. This allows starting voltages of the PDP to be lowered.

By forming float electrodes in between the neighboring pixels (minimum display unit), cross-talk can be reduced.

With the present invention, potentials of the first, second and third electrodes are set the same during the erase period. This allows metastable atoms generated by crashing of atoms and residual space charge in the discharge space to be accumulated as wall charge, suppressing mis-discharge. Further, when fourth electrodes are added, residual space charge during the discharge period can be accumulated in the fourth electrodes to prevent its diffusion to other discharge spaces, enabling discharge control. These constructions allow the PDP to have high emission efficiency and to select any pixels when widening the distance between the first and second electrodes.

DETAILED DESCRIPTION OF THE PREFERRED EMBODIMENTS

The preferred embodiments of the present invention are described hereinafter with reference to the accompanied drawings.

First Preferred Embodiment

The driving method for the PDP of this embodiment has the characteristics of; initiating self-erasing discharge when driving the PDP having at least 3 (first, second, and third) electrodes, and then when the potential difference between electrodes is increased, initiating discharge and emitting light using the self-erasing discharge as a trigger.

The self-erasing discharge is initiated between the third and second electrodes and/or the first and third electrodes when the potential difference between the first and second electrodes, the first and third electrodes, and/or the third and second electrodes was decreased.

Using the self-erasing discharge as a trigger, discharge current I main flows between the first and second electrodes to make the PDP to emit light while discharge current I sub is forced to flow between the third and second electrodes and/or the first and third electrodes. According to the present invention, the discharge is sustained by using the self-erasing discharge or trigger discharge as a trigger in the following cycle.

When an emission is produced by the discharge current I main between the first and second electrodes, counter electromotive force Vemf-main which suppresses fluctuation in discharge current is applied to the first and/or second electrode sides. Furthermore, when the potential difference between the first and second electrodes, the first and third electrodes and/or the third and second electrodes is increased, counter electromotive force Vemf-C that suppresses fluctuation in charge and discharge current is applied. The peak value of the discharge I main is reduced by 10% or more by applying the counter electromotive force Vemf-main.

The counter electromotive force is adjusted so that the amount of discharge current I sub flowing between the third and second electrodes and/or the first and third electrodes becomes 10% or more of the added amount of the discharge current I main and the discharge current I sub.

A discharge starting voltages between the third and second electrodes and/or the third and second electrodes are smaller than that of the first and second electrodes.

Distances between the third and second electrodes and/or the third and second electrodes are smaller than that of the first and second electrodes.

This embodiment is described hereinafter referring to specific examples, however, preferred embodiments of the present invention is not limited to this.

Figure 1:
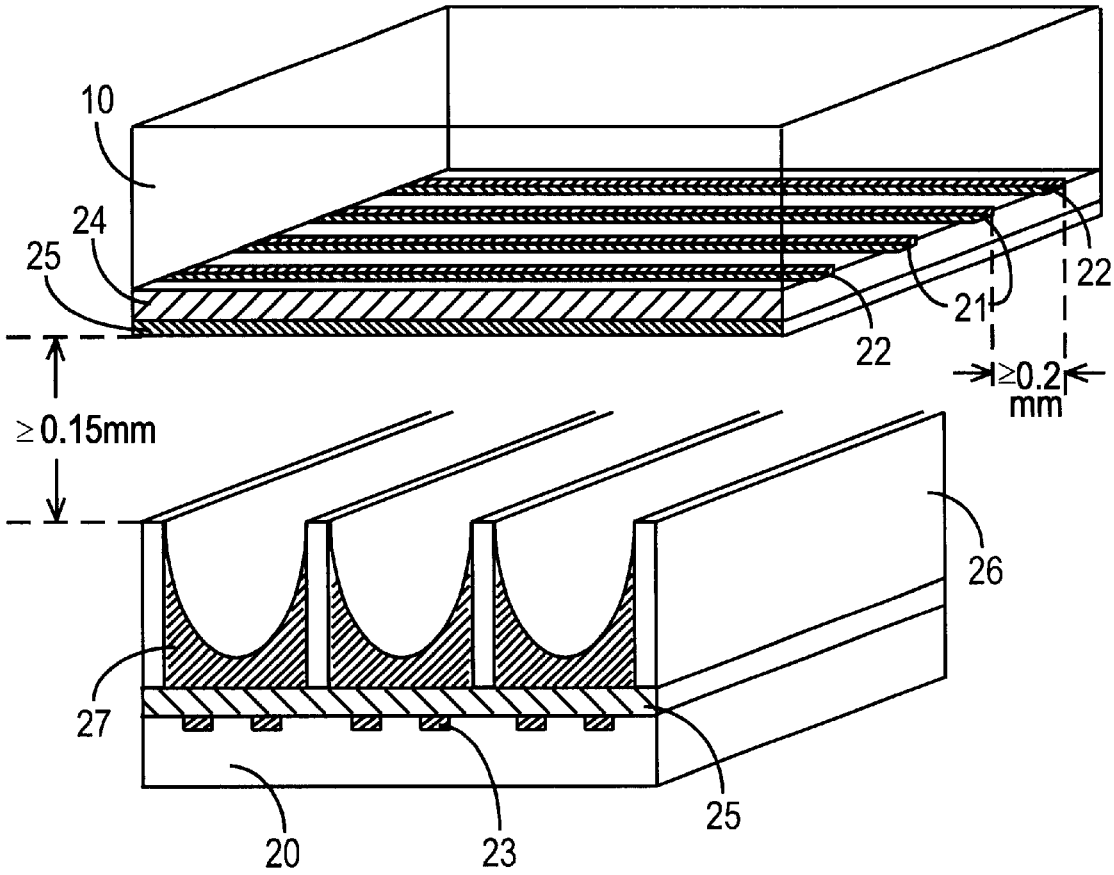
FIG. 1 shows an exploded perspective view of a PDP according to a first preferred embodiment of the present invention.

The PDP of FIG. 1 has ribs 26 disposed in such a manner that they form stripes. Two third electrodes (address electrodes) 23 are disposed in each emission unit (EU) parallel to the ribs 26. On the address electrodes 23 is a phosphor layer 27 formed on an over-coating dielectric layer 24. A pair of first and second electrodes 21 and 22 respectively form a scan electrode and a sustain electrode, and are disposed transversely and perpendicularly to the address electrodes 23. The electrodes 21 and 22 are covered with the transparent dielectric layer 24 and a protective layer 25, and a discharge gap between the two electrodes is 0.2 mm or more. The two electrodes 23 disposed in the EU are electrically connected to each other.

More than two electrodes 23 can be disposed in the EU. The two electrodes 23 may be connected at one point, however, if they are connected at a plurality of points like a network, electrical connection would not be cut even when some of the connections are cut.

The following is a description of this embodiment presented with specific examples, however the preferred embodiments are not limited to this.

[Panel Construction]

FIG. 1 shows an exploded perspective view of a PDP according to the first preferred embodiment. In the PDP of FIG. 1, the first electrodes 21 and the second electrodes 22 which are in parallel with each other, and the dielectric layer 24 are disposed on the inner face of a first substrate 10 which forms a pair with a second substrate 20. On the inner surface of the second substrate 20 are the third electrodes 23 disposed transversely to the electrodes 21 and 22, a dielectric layer 24, the ribs 26 dividing the discharge space at EUs, and the phosphor layer 27. The intervals between the first and second electrodes 21 and 22 are 0.2 mm and over.

The common material for the substrates is soda lime glass, however, it is not limited to this. The ribs are commonly made of low-melting glass, however, it is not limited to this. The material for the phosphor is not specifically limited providing it is excited by the UV rays generated by the discharge and emits light. The dielectrics is commonly made of low-melting glass, but is not limited to this. As a material for the protective layer, a material with a high secondary-emission coefficient is desirable. For this reason, MgO is commonly used, however, it is not limited to this. Commonly used discharge gas is a mixed gases of Xe including at least one of He, Ne, and Ar, however it is not limited to this.

The following is a description of the manufacturing method of the PDP of this embodiment. The PDP comprises a back panel and a front panel.

Firstly, the manufacturing method of the back panel is described below. For the substrate 20, a 2.8 mm thick soda lime glass is used. Silver paste XFP5392 (NAMIX CO., LTD) was screen printed on the substrate. The substrate was then dried at 150° C. and fired at 550° C. to produce the electrode 23. A prototype dielectric paste G3-2083 (OKUNO CHEMICAL INDUSTRIES CO., LTD.) was screen printed and then dried at 150° C. and fired at 550° C. to form the dielectric layer 24.

Rib paste G3-1961 (OKUNO CHEMICAL INDUSTRIES CO., LTD.) was screen printed, then dried at 150° C. to provide a predetermined height, and then fired at 550° C. to form the ribs 26. In between the ribs 26, red phosphor paste, green phosphor paste, and blue phosphor paste were screen printed in order, and then dried at 150° C. and fired at 550° C. to produce the phosphor layer 27.

Next, the manufacturing method of the front panel is described below. A 2.8 mm thick soda lime glass was used for the substrate 10. On the substrate, chrome, copper and then chrome were vacuum deposited to form the electrodes 21 and 22. Dielectric paste G3-0496 (OKUNO CHEMICAL INDUSTRIES CO., LTD.) was screen printed and then dried at 150° C. and fired at 580° C. to form the dielectric layer 24. On the surface of the dielectric layer 24, MgO was vacuum deposited, forming the protective layer 25.

The back and front panels were placed facing to each other, and peripherals of which were sealed with frit glass. After adequately evacuating the air, a gas (a mixture of Xe containing 5% Ne, 500 torr) was charged. Then the panels were sealed to produce the PDP.

[Driving Method]

Figures 2A, 2B, 2C:
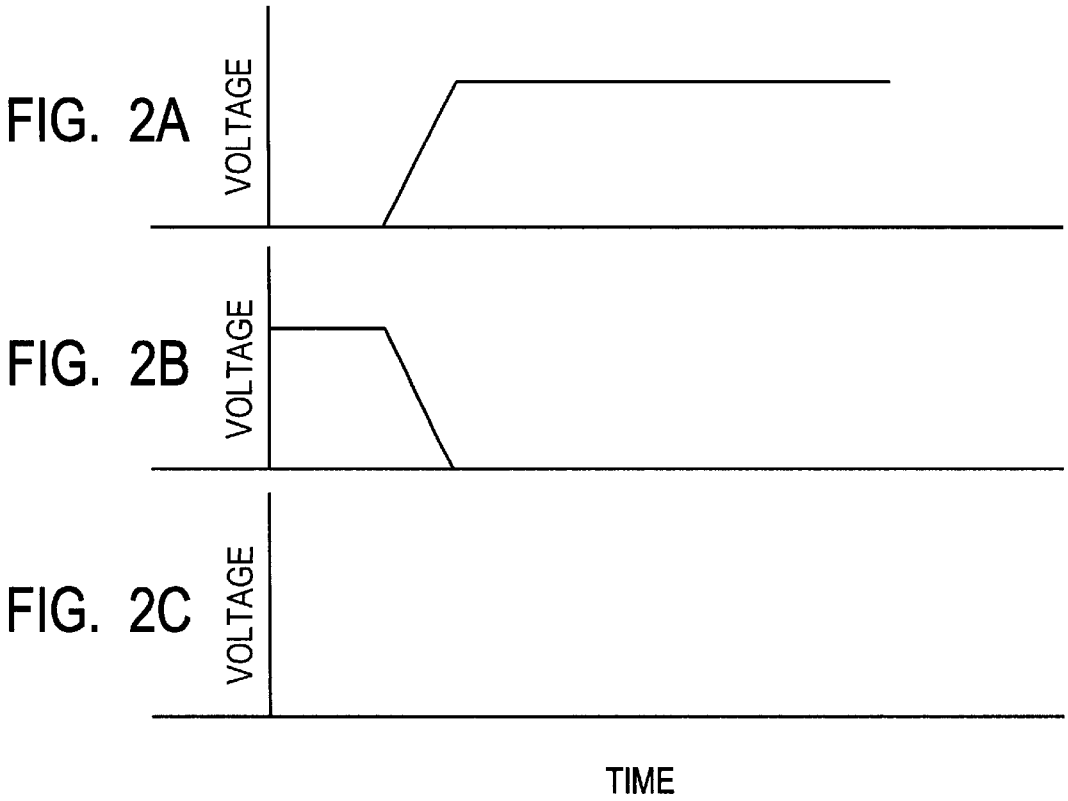
FIGS. 2A–2C show a chart illustrating voltage waveforms output from circuits to each electrode according to the first preferred embodiment.

FIGS. 2A–2C show voltage waveforms output from the circuit to the electrodes 1(A), 2(B), and 3(C) during sustain period. In FIGS. 2A–2C, the vertical axis represents voltages and horizontal axis, time. FIGS. 2A–2C only shows the period in which voltage of the electrodes 2 changes from "high" to "low", and voltage of the electrodes 1, from "low" to "high". During the sustain period, light is emitted successively by repeating the period in which voltages of the electrodes 2 and 1 changes from "high" to "low" and "low"

to "high" respectively, and voltages of the electrodes 1 and 2 changes from "high" to "low" and "low" to "high" respectively. During the period where the voltage of the electrodes 2 changes from "high" to "low", the potential difference between the electrodes 1 and 2 as well as the electrodes 3 and 2 is reduced to make the capacitor of the PDP to discharge. At this point, if the starting voltage between the electrodes 3 and 2 is adequately lower than that of between the electrodes 1 and 2, and an adequate wall charge was generated in the previous cycle, the potential difference between the electrodes 3 and 2 is reduced. Therefore, the self-erasing discharge can be generated between the electrodes 3 and 2.

Figure 3A:
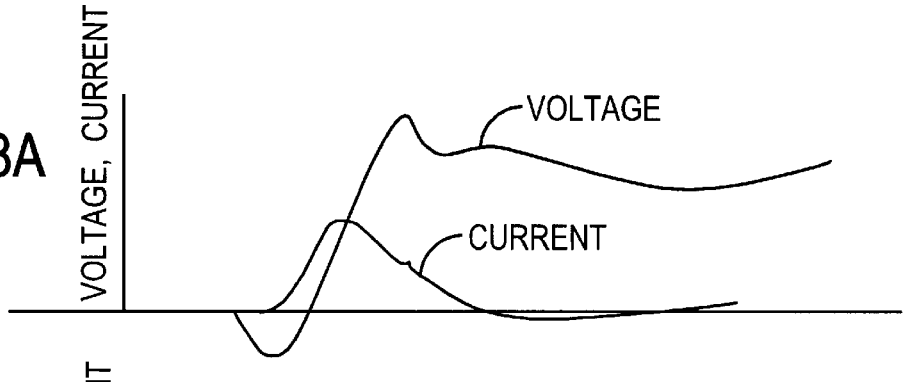
FIGS. 3A–3C show a chart illustrating voltage and current waveforms observed at each electrode according to the first preferred embodiment.
Figure 3B:
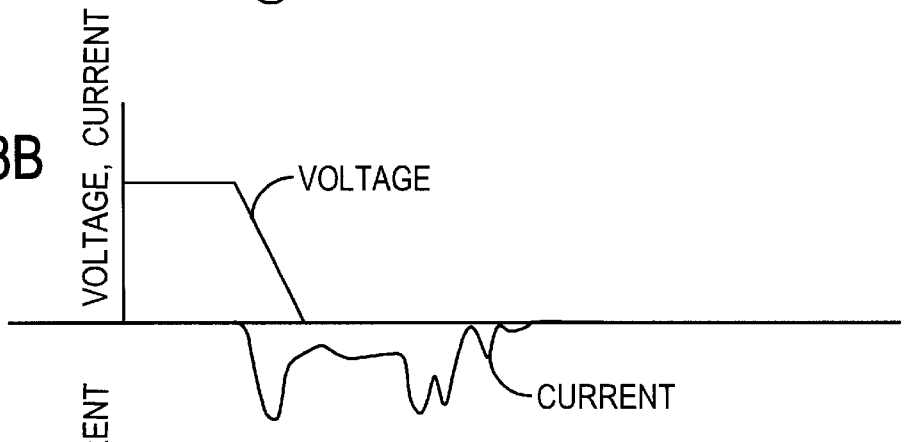
Figure 3C:
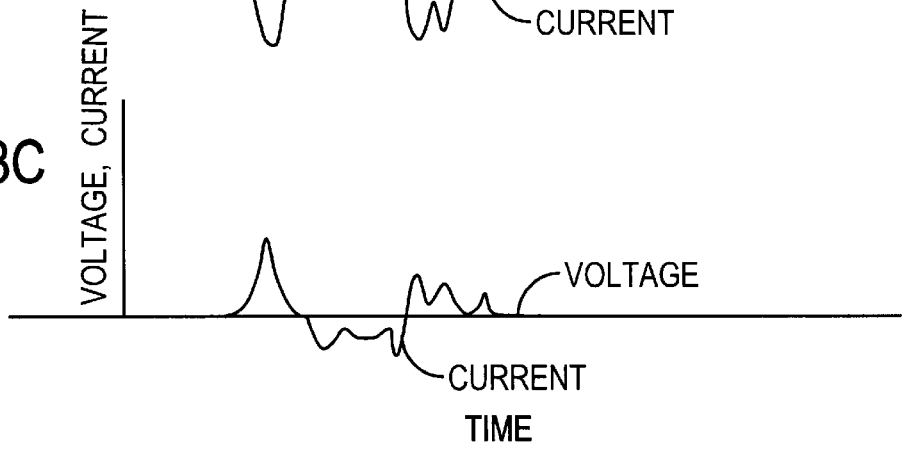

FIGS. 3A–3C show current waveforms flowing between the electrodes 1, 2, and 3. The current associated with the self-erasing discharge occurring between the electrodes 3 and 2 is observed.

In the following period in which the voltage of the electrodes 1 changes from "low" to "high", a potential difference is generated between the electrodes 1 and 2 as well as the electrodes 1 and 3, and the PDP is charged by making the electrodes 1 positive and the electrodes 2 and 3 negative. During this process, voltage is applied so that the changing speed of the potential is 1.0 V/ns or more. Furthermore, inductance of 100 $\mu$H is inserted to the electrode 1 side of the circuit in order to generate counter electromotive force Vemf-C which suppresses the fluctuation of the charging current of the panel. As a result, the voltage and current waveforms of the electrodes 1, 2 and 3 shown in FIGS. 3A–3C were observed. Thus the strength of the electric field placed between the electrodes 1 and 2 immediately before the initiation of discharge can be intensified.

When the self-erasing discharge between the electrodes 3 and 2 acts as a trigger and discharge is produced, the discharge current I main flows between the electrodes 1 and 2 and light is emitted.

At this moment, the inductance of 100 $\mu$H inserted to the electrodes 1 side of the circuit board is used in order to generate the counter electromotive force Vemf-main that suppresses fluctuation of the discharge current. This decreases the discharge current I main and the current waveforms of which become moderate. When the positive column is observed at this point, it is found to be stronger and thicker, and very stable. As the discharge starts, simultaneously, the discharge current I sub starts to flow between the electrodes 3 and 2. This flow of the discharge current I sub allows formation of the wall charge for the trigger discharge of the following cycle, thereby maintaining the discharge.

The following is a description of the next cycle. In the previous stages the polarity between the electrodes 2 and 3 is positive in the electrodes 3 side and negative on the electrodes 2 side. MgO having high a secondary-emission coefficient is used only on top of the electrodes 3. Therefore, the self-erasing discharge does not occur during the period when the voltage of the electrodes 1 changes from "high" to "low".

In the following period when the voltage of the electrodes 2 changes from "low" to "high", the potential differences between the electrodes 2 and 1 as well as the electrodes 2 and 3 are generated, and the electrodes 2 are set to be positive while the electrodes 1 and 3 are set to be negative in order to charge the PDP. In this process, voltage is applied so that the changing speed of the potential is 1.0 V/ns or more.

This applied voltage and the wall charge in between the electrodes 2 and 3, cause trigger discharge between the electrodes 2 and 3. Simultaneously, by using the trigger discharge as a trigger, the discharge current I main flows between the electrodes 2 and 1, and light is emitted. At this moment, in order to generate counter electromotive force Vemf-main which suppresses fluctuation of the discharge current, the inductance of 100 $\mu$H inserted to the electrodes 1 side of the circuit board is used. This decreases the discharge current I main, and current waveforms of which become moderate. Furthermore, when the discharge initiates, simultaneously, the discharge current I sub flows between the electrodes 2 and 3. This flow of the discharge current I sub allows formation of the wall charge for the self-erasing discharge of the following cycle, thereby maintaining the discharge.

During the sustain period, the foregoing is repeated and light is emitted continuously.

If the counter electromotive force Vemf-C is not generated, the inductance is inserted immediately before the discharge starts, In addition, in order to forcibly initiate the trigger discharge, pulses can be applied to the electrodes 3.

By driving the PDP in this manner, positive column discharge is securely formed and sustained, thereby a PDP achieving a sustain voltage of 245V, the emission efficiency of 2.54 lm/W on a panel in which the distance between the substrates 10 and 20 facing each other is 0.12 mm, and the distance between the electrodes 1 and 2 of 0.5 mm is obtained.

In comparison, if the distance of each of electrodes 1, 2 and 3 is changed and the starting discharge or driving discharge between the electrodes is adjusted so that the self-erasing discharge between the electrodes 3 and 2 does not occur during the period the voltage of the electrodes 2 changes from "high" to "low", discharge becomes unstable or even stops.

On the other hand, after producing the self-erasing discharge between the electrodes 3 and 2 during the period in which the voltage of the electrodes 2 changes from "high" to "low", if it takes a sufficiently extended time to change the voltage of the electrodes 1 from "low" to "high", the self-erasing discharge did not necessarily act as a trigger. If the discharge is generated in this manner, the discharge will stop.

Figure 4A:
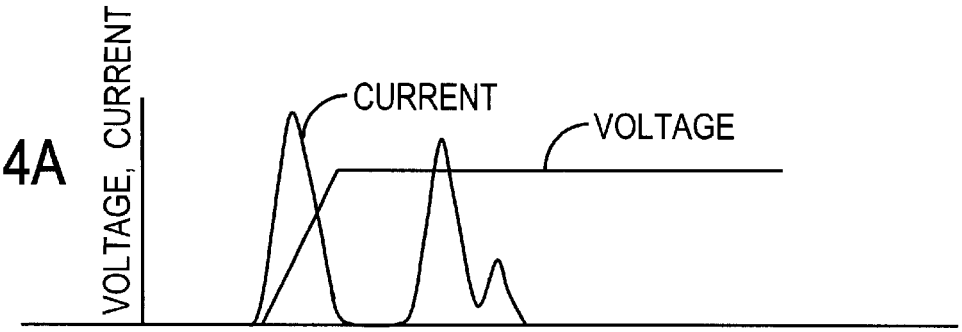
FIGS. 4A–4C show a chart illustrating voltage and current waveforms which occur when counter electromotive force Vemf-main is not applied to each electrode according to the first preferred embodiment.
Figure 4B:
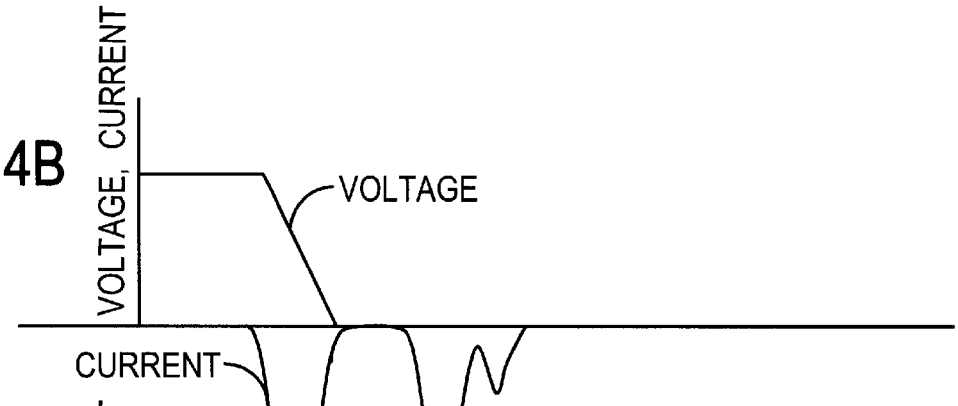
Figure 4C:
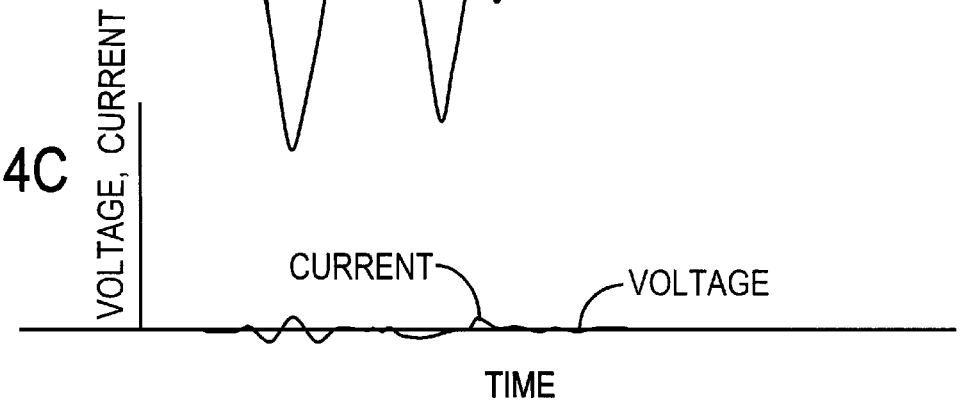

In comparison, in FIGS. 4A–4C, voltage and current waveforms of the electrodes 1, 2 and 3, when the counter electromotive force Vemf-main is not applied, are shown. In FIG. 4, A, B and C respectively represent the voltage and current waveforms of the electrodes 1, 2, and 3.

In this case, the positive column discharge is unstable, and the discharge flickers wildly. The sustaining voltage is 300V and the emission efficiency is 1.28 lm/W on a panel in which the electrodes 1 and 2 are disposed at intervals of 0.5 mm, and the distance between the substrates is 0.12 mm.

The following is the description of the results obtained when the size of the inductance or the driving voltage is changed.

It is possible to set I sub at 0 or 10% or less of the addition of I main and I sub by changing the counter electromotive Vemf-main. It is also possible to maintain the amount of reduction of the discharge current I main at less than 10% by adjusting the counter electromotive force Vemf-main. If the PDP is driven in this manner, the positive column is not stable, and substantial improvement of the emission efficiency can not be expected. Further, when I sub is reduced extremely, the wall charge for the self-erasing discharge and trigger discharge in the following cycle can not be formed, subsequently, the discharge becomes unstable or stops.

The following is a description of the consequence observed when the changing speed of the potential is changed during the process of creating the potential difference between the electrodes 1 and 2.

When the changing speed of the potential was changed from 0.5 V/ns to 2.5 V/ns, the emission efficiency changed remarkably. The emission efficiency was especially large when the changing speed was 1.0 V/ns or faster. For example, when the foregoing panel was used, the emission efficiency was approximately 1.21 lm/W at the changing speed of 1.0 V/ns. Whereas, when the changing speed of the potential is 1.8 V/ns, the emission efficiency became 2.54 lm/W.

In this embodiment, a 100 $\mu$H coil was used for the inductance, however, the most effective inductance is decided by the capacity of the panel. The inductance is desirably determined so that the discharge current I main is reduced by 10% or more, or I sub becomes 10% or more of the addition of I main and I sub, considering the capacity of the panel. When the inductance is optimized, the emission efficiency can be further enhanced by using it to both electrodes 1 and 2 sides of the circuit.

As a method to generate the counter electromotive force Vemf-main and Vemf-C, the inductance was used in the foregoing example, however, it is not limited to this for providing a counter electromotive force. For example, as a generating method of the Vemf-main, a counter electromotive force which offset the potential difference between the electrodes 1 and 2 or inverse pulses can be applied.

Figures 5A, 5B, 5C:
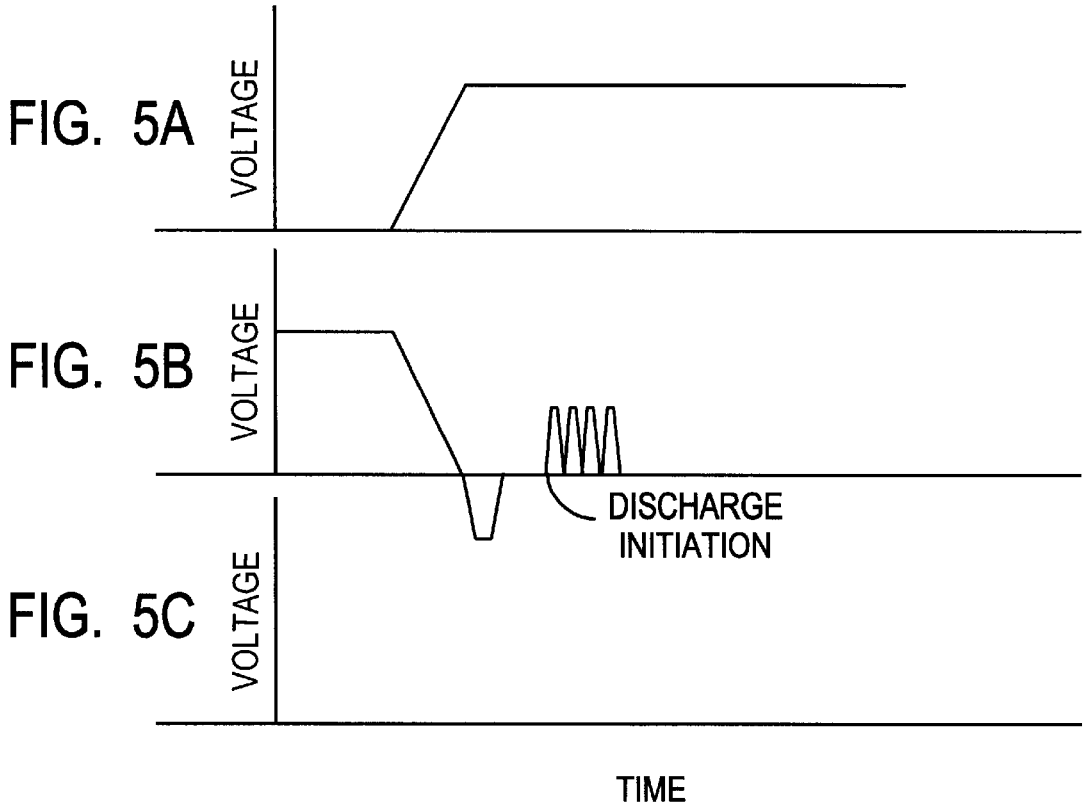
FIGS. 5A–5C show a chart illustrating waveforms of applied voltage when counter electromotive force is applied by pulses according to the first preferred embodiment.

Further, by superimposing pulses continuously, waveforms of the discharge current I main can be made moderate. Similarly, as a method to generate the counter electromotive force Vemf-C, pulses can be superimposed. In FIGS. 5A–5C, observed waveforms of the applied voltage when the counter electromotive force is generated by applying pulses is shown.

Figures 6A, 6B, 6C:
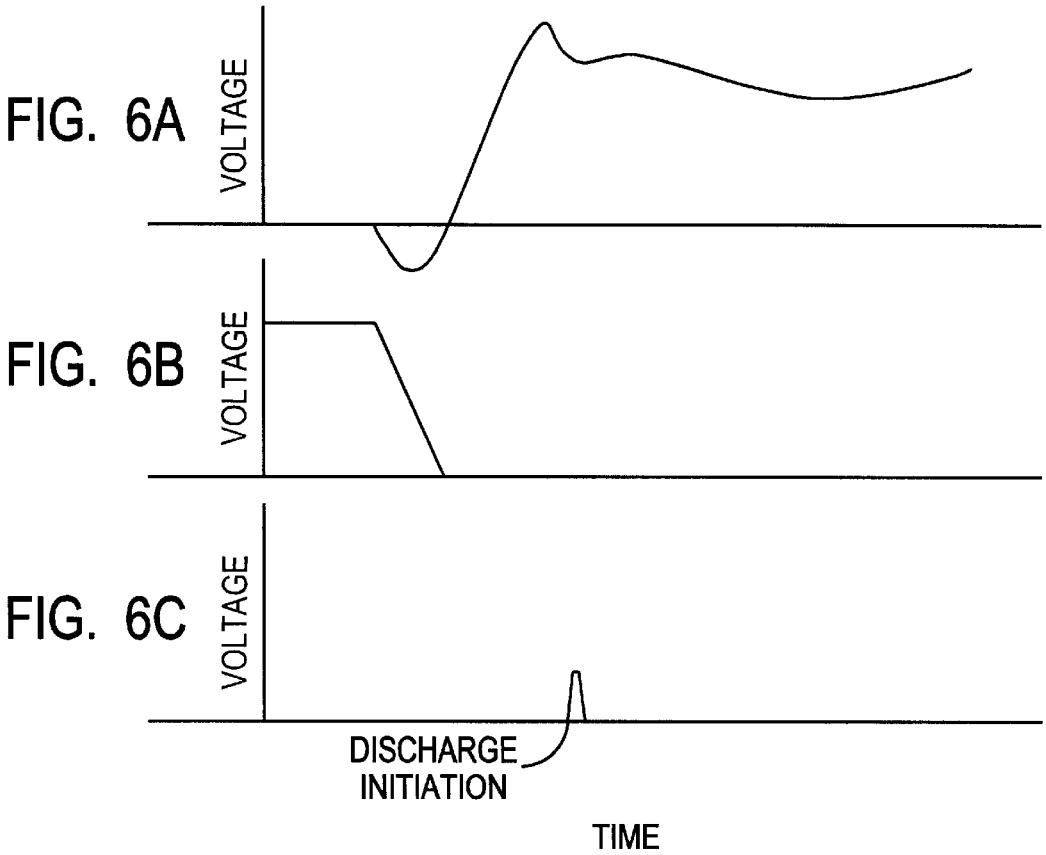
FIGS. 6A–6C show a chart illustrating waveforms of applied voltage observed when discharge current I sub is forced to flow according to the first preferred embodiment.

In order to force the discharge current I sub to flow, pulse voltage can be applied on the electrodes 3 simultaneously with the starting of the discharge. Further, in order to realize a smooth flow of the discharge current I sub, a potential difference can be provided between the electrodes 3 and electrodes 1 and/or 2 when the PDP is being charged. In FIGS. 6A–6C, waveforms of the applied voltage observed when the discharge current I sub is forced to flow is shown.

It is not limited to charging of the PDP to create a potential difference between each electrode. Discharge of the PDP (not gas discharge) can be used as well.

Technically, the effect of the invention described in this embodiment slightly differs depending on the changes of the capacity resulting from the lighting rate of the PDP (a display amount). By controlling the counter electromotive Vemf-main against the amount of display, the emission efficiency can be optimized depending on the display amount.

[Display Apparatus]

In the below, a scan electrode, a sustain electrode and an address electrode correspond respectively to the electrodes 1, 2, and 3.

Figure 7:
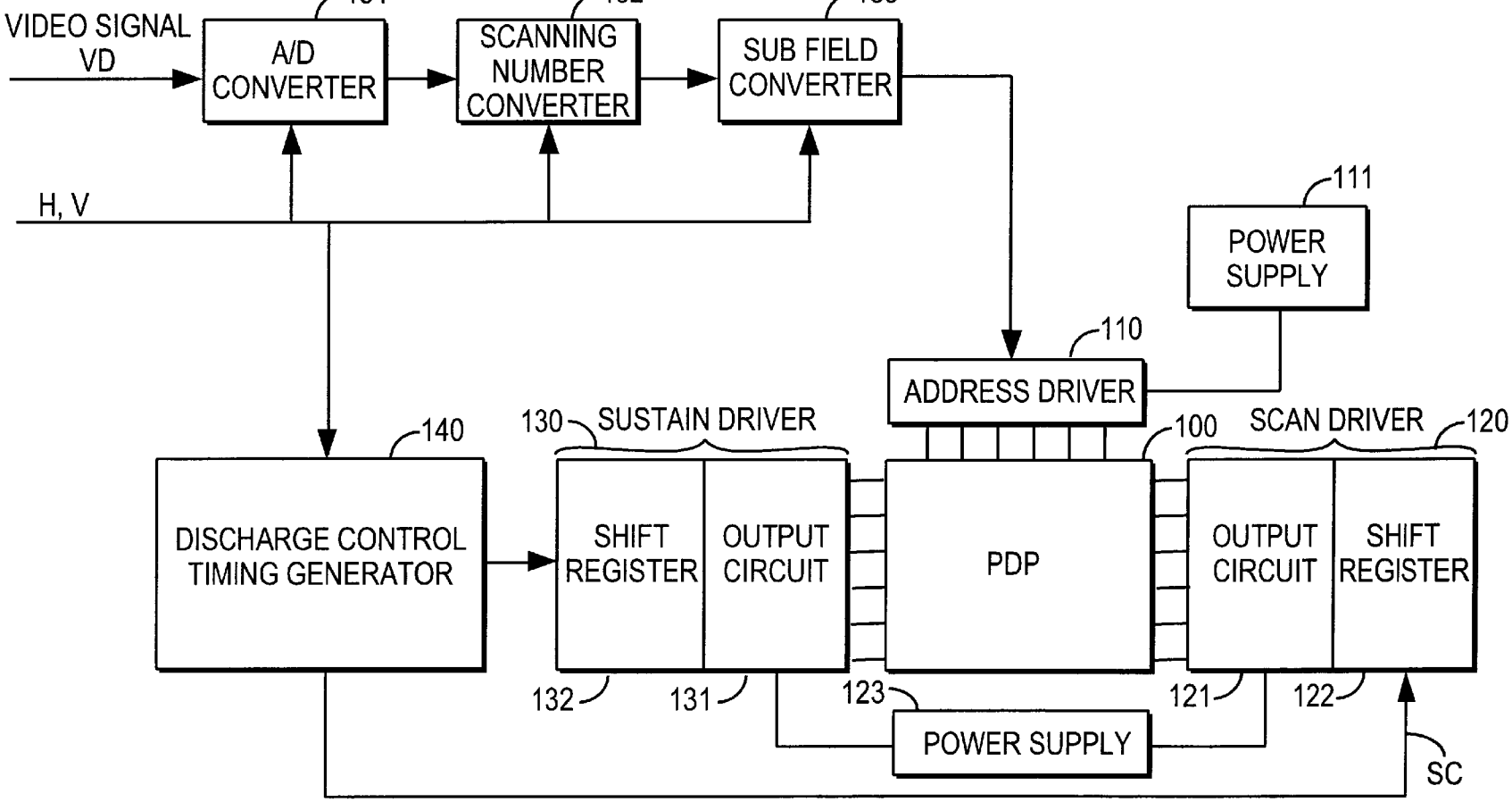
FIG. 7 shows a block diagram of a plasma display apparatus according to the first preferred embodiment.

FIG. 7 shows a block diagram illustrating the construction of the display apparatus of this embodiment.

The display apparatus in FIG. 7 comprises a PDP 100, an address driver 110, a scan driver 120, a sustain driver 130, a discharge control timing generator 140, an A/D converter 151, a scanning number converter 152 and a sub-field converter 153.

The PDP 100 includes a plurality of address electrodes, a plurality of scan electrodes and a plurality of sustain electrodes. The plurality of address electrodes are disposed vertically against the screen, and the plurality of scan and sustain electrodes, horizontally against the screen. The plurality of sustain electrodes are connected commonly. At each juncture of the address electrodes and the scan and sustain electrodes is a discharge cell. Each discharge cell forms a pixel on the screen. By applying write pulses between the address electrodes and scan electrodes on the PDP 100, address discharge occurs between the address and scan electrodes, and the discharge pixels are selected. Consecutively, by applying cyclical sustain pulses which invert alternatively in between the scan and sustain electrodes, sustain discharge is produced between the scan and sustain electrodes and image is displayed.

Figure 8:
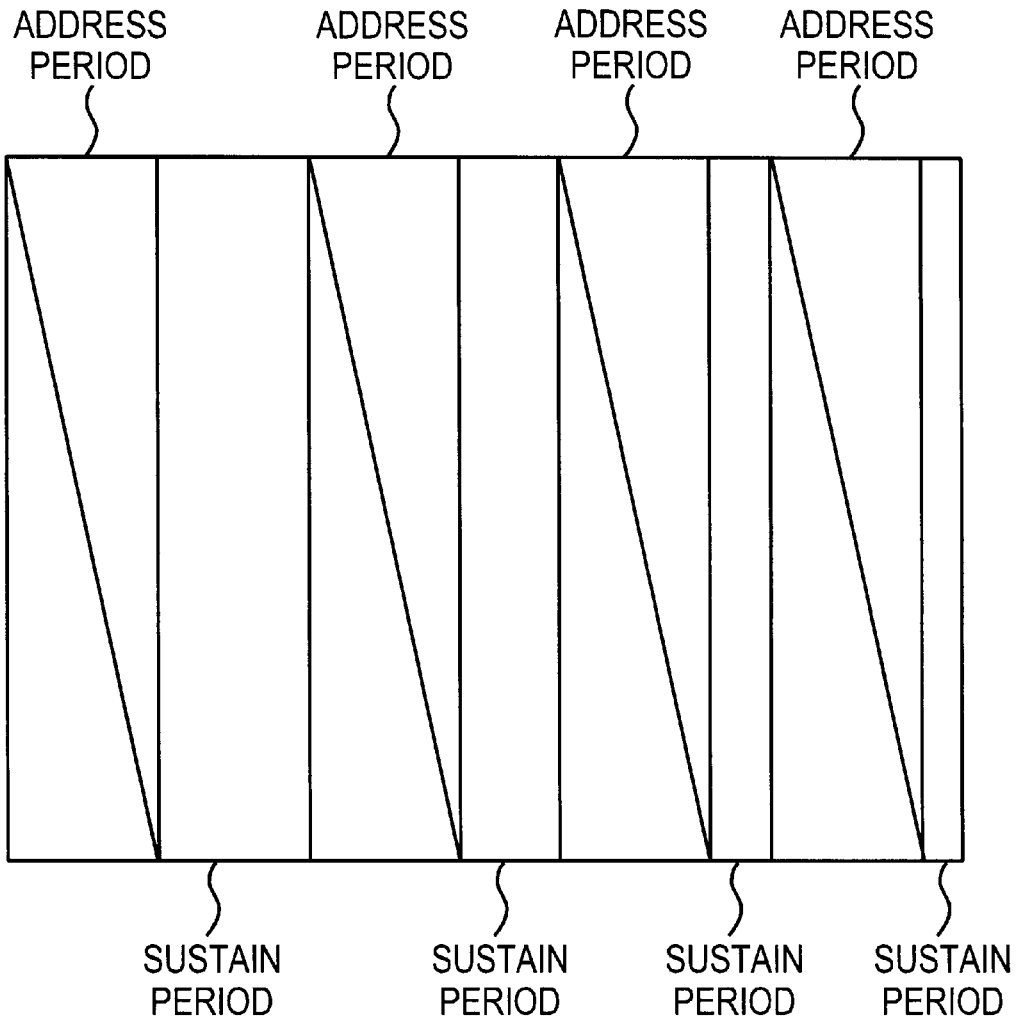
FIG. 8 shows a schematic diagram describing the ADS system according to the first preferred embodiment.

As a gradation display driving system for an AC type PDP, the Address and Display Period Separated system (ADS system) can be used. FIG. 8 describes the ADS system. The vertical axis of the FIG. 8 shows scanning direction of the scan electrodes from the first line to the "m" line. The horizontal axis shows time. In the ADS system, one field (1/60 second) is divided into a plurality of sub-fields in terms of time. For example, when 256 gradations are displayed at 8 bits, one field is divided into 8 sub-field. Each sub-field is divided into an address period in which address discharge is generated for selecting lightening pixels and a sustain period. In the ADS system, in each sub-field from the first line to the "m" line to cover the whole PDP, scanning by the address discharge is conducted. When the address discharge is completed on the whole area, the sustain discharge starts.

Video signals VD are put into the A/D converter. Horizontal sync. signal H and vertical sync. signal V are put into the discharge control timing generator, the A/D converter, the scanning number converter and the sub-field converter. The A/D converter converts the VD to digital signals and sends these video data to the scanning number converter. The scanning number converter converts the video data to video data with the number of lines corresponding to the number of pixels of the PDP, and provides the video data on each line to the sub-field converter. The sub-field converter divides data of each pixel of these video data on each line into a plurality of bits corresponding to a plurality of sub-fields, and outputs serially each bit of each pixel data of each sub-field to the address driver. The address driver is connected to a power supply, and the address driver converts the serial data output from the sub-field converter to parallel data and drives the plurality of address electrodes.

The discharge control timing generator generates discharge control timing signals SC and SU based on the horizontal sync. signals H and vertical sync. signals V and sends SC and SU respectively to the scan driver and the sustain driver. The scan driver includes an output circuit 121 and a shift register 122. The sustain driver includes an output circuit 131 and a shift register 132. The scan driver and the sustain driver are both connected to a common power supply 123.

The shift register of the scan driver sends the discharge control timing signals SC fed from the discharge control timing generator to the output circuit, shifting them vertically. The output circuit responds to the discharge control timing signals SC fed from the shift register and drives the plurality of scan electrodes in order.

The shift register of the sustain driver sends the discharge control timing signals SU fed from the discharge control timing generator to the output circuit, shifting them vertically. The output circuit responds to the discharge control timing signals SU fed from the shift register and drives the plurality of sustain electrodes in order.

Figure 9:
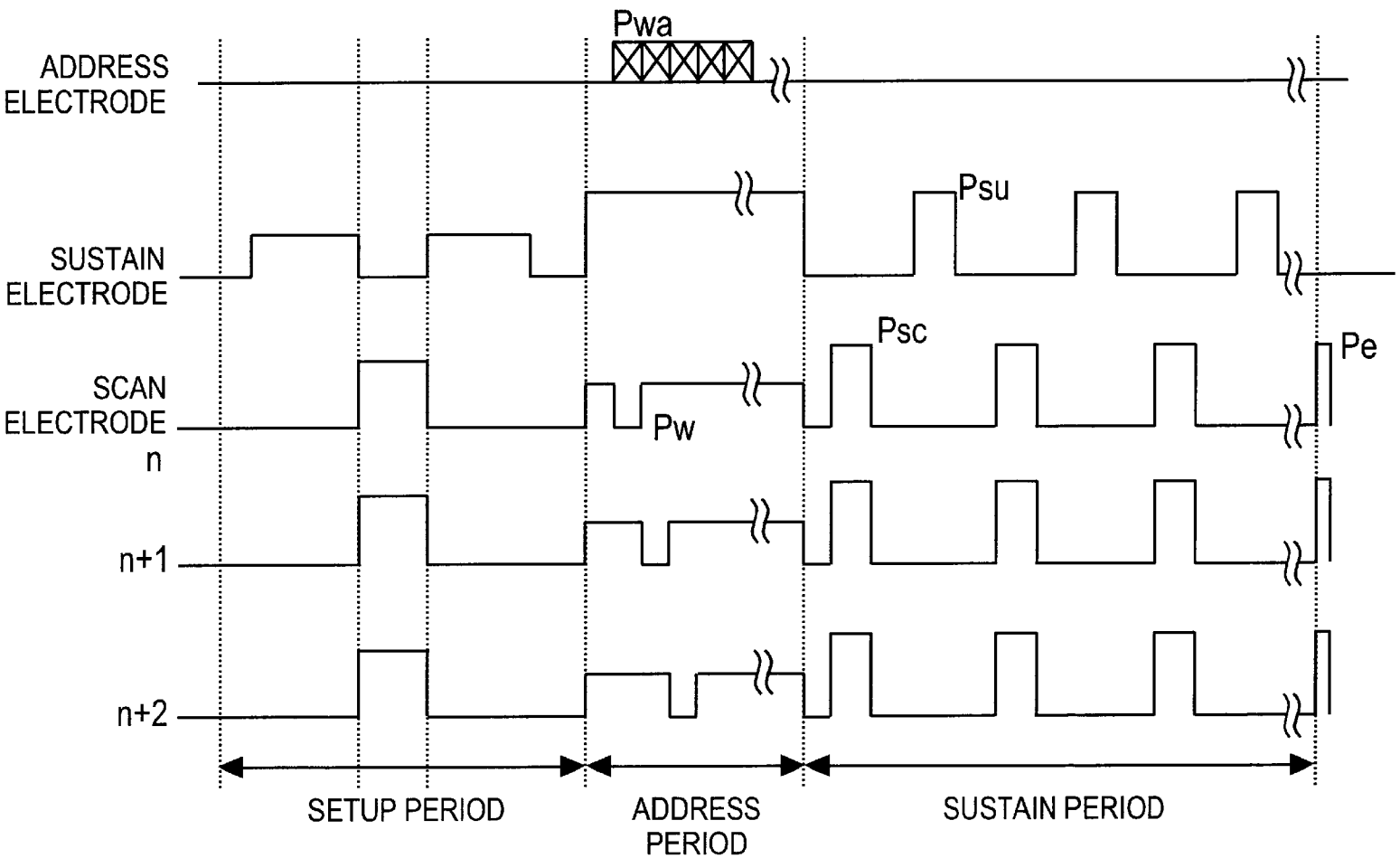
FIG. 9 shows a timing chart illustrating driving voltages applied on each electrode of the PDP according to the first preferred embodiment.

FIG. 9 shows a timing chart illustrating driving voltages applied on each electrode of the PDP 100. In FIG. 9, the horizontal axis represents time and vertical axis, voltage. In FIG. 9, driving voltages of the address, sustain and scan electrodes from the "n" line to the "(n+2)" line are shown. A "n" is any integer number.

As FIG. 9 shows, during the emitting period, sustain pulses (Psu) are applied in a certain cycle on the sustain electrodes. During the address period, write pulses (Pw) are applied on the scan electrodes. Synchronizing with these write pulses, write pulses (Pwa) are applied on the address electrodes. On and Off of the write pulses (Pwa) are controlled corresponding to each pixel of image to be displayed. When the write pulses (Pw) and (Pwa) are applied simultaneously, address discharge occurs in the discharge pixels at the juncture of the scan electrodes and the address electrodes, and the discharge pixels emit light.

During the sustain period after the address period, the sustain pulses (Psc) are applied on the scan electrodes at a predetermined cycle. The phase of the sustain pulses (Psc) applied on the scan electrodes is deviated by 180 degrees from the phase of the sustain pulses (Psc). In this case, the sustain discharge occurs only at the discharge pixels which are selected due to the address discharge.

At the end of each sub-field, erasing pulses (Pe) are applied on the scan electrodes. Due to this, the wall charge of each discharge pixel disappears or is reduced to the level where the sustain discharge is not generated, so that the sustain discharge terminates. During the rest period after the application of the erasing pulses (Pe), rest pulses (Pr) are applied on the scan electrodes at a regular cycle. These rest pulses have the same phase as the phase of the sustain pulses.

The driving method of the sustain period is the same as the method described in the foregoing [Driving Method] section.

Second Preferred Embodiment

The second preferred embodiment is described hereinafter with reference to the drawings.

The driving method of the plasma display panel and the display device of this embodiment are the same as the ones described in the first preferred embodiment. However, in addition to that, when the discharge current I sub is sent between the electrodes 23 and 22 and/or the electrodes 21 and 23, the counter electromotive force Vemf-sub which suppresses fluctuation of the discharge current I sub is applied to the electrodes 23.

In this embodiment, in order to generate the counter electromotive force Vemf-sub which suppresses fluctuation of the discharge current I sub, an inductance of 100 $\mu$H is inserted into the third electrodes 3 side of the circuit board. This allows suppression of the discharge current I sub flowing in the electrodes 23 to a minimum.

The driving method from the following cycle onwards is the same as that of the first embodiment.

When driving the PDP by this method, with the PDP in which the distance between the electrodes being 0.5 mm, the substrates, 0.12 mm, a sustain voltage of 245V and an emission efficiency of approximately 2.6 lm/W were obtained. Further, in this embodiment, degradation of the phosphor layer formed on the electrodes 3 was suppressed as well.

Regarding the influence of the following condition as well as the methods, they are the same as that of the first embodiment.

a) the self-erasing discharge is not generated, b) when the self-erasing discharge is generated, it is not used as a trigger, c) the counter electromotive force Vemf-main is not generated, d) the amount of the inductance is changed or driving voltage is intensified, e) the changing speed of the potential is changed during the process of creating a potential difference, f) the method of forcing the trigger discharge to occur, g) the method of generating the counter electromotive force Vemf-main and Vemf-C, h) the method of forcing the discharge current I sub to flow, and i) the method of controlling the counter electromotive force Vemf-main accordingly to the display rate of the PDP.

Third Preferred Embodiment

In this embodiment the construction of the PDP is based on that of the first embodiment, except the followings;

a) a plurality of third electrodes are formed in a single EU, and b) protrusions are formed between the third electrodes.

In some example, the electrodes 21 and 22 are formed on the substrate 10, and via a dielectric layer, the electrodes 23 are also formed on the substrate 10 such that they transverse the electrodes 21 and 22. In between the neighboring display pixels on the substrate, float electrodes are formed.

This embodiment is described hereinafter taking concrete examples.

Figure 10:
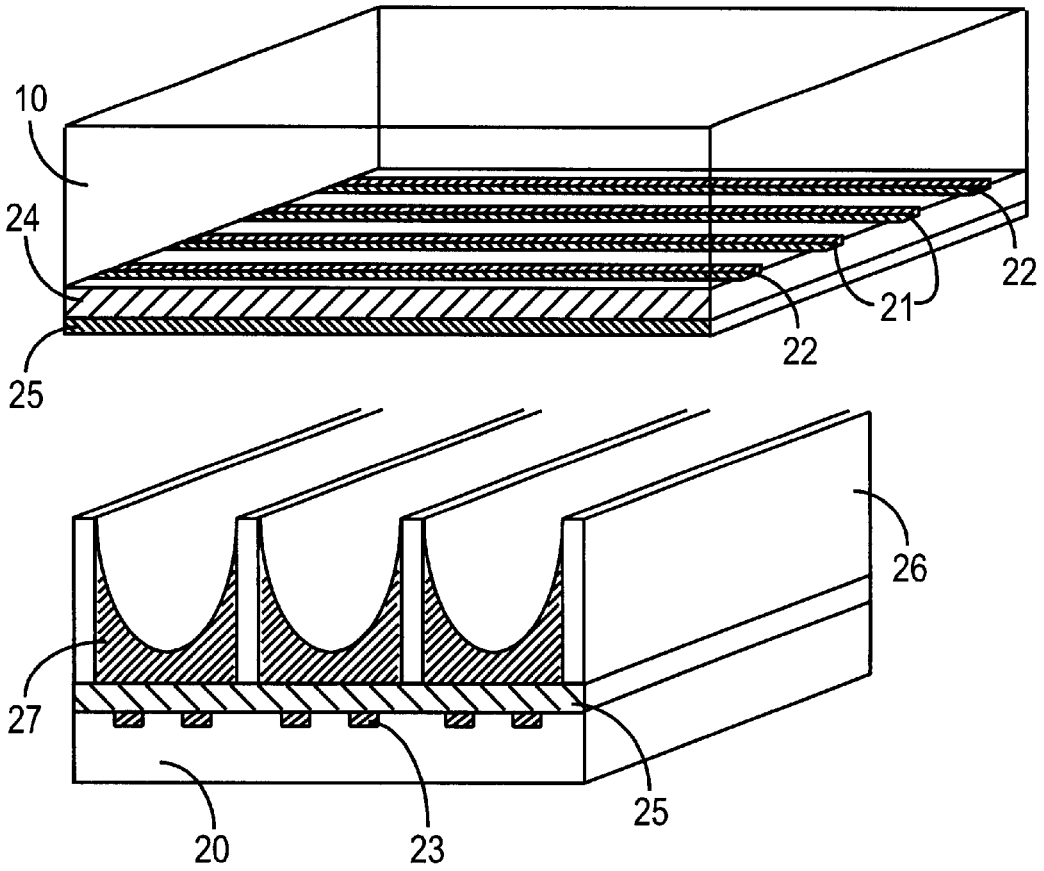
FIG. 10 shows a perspective exploded view of a PDP according to a third preferred embodiment.

FIG. 10 shows a perspective view of the PDP used in the preferred embodiment 1. The substrate 10, one of a pair of substrates has the electrodes 21 and 22 disposed parallel to each other on the inner face thereof. On the inner face of the other substrate 20 are the electrodes 23 disposed transversely to the electrodes 21 and 22, the ribs 26 and the phosphor 27. The PDP was driven, changing the distance between the substrates 10 and 20 from 0.12 mm to 0.25 mm. As a result, the emission efficiency became remarkably large at 0.15 mm or more. For example, when the distance is set at 0.18 mm, a sustain voltage of 240 v and a emission efficiency of 2.78 lm/W were obtained.

Figure 11:
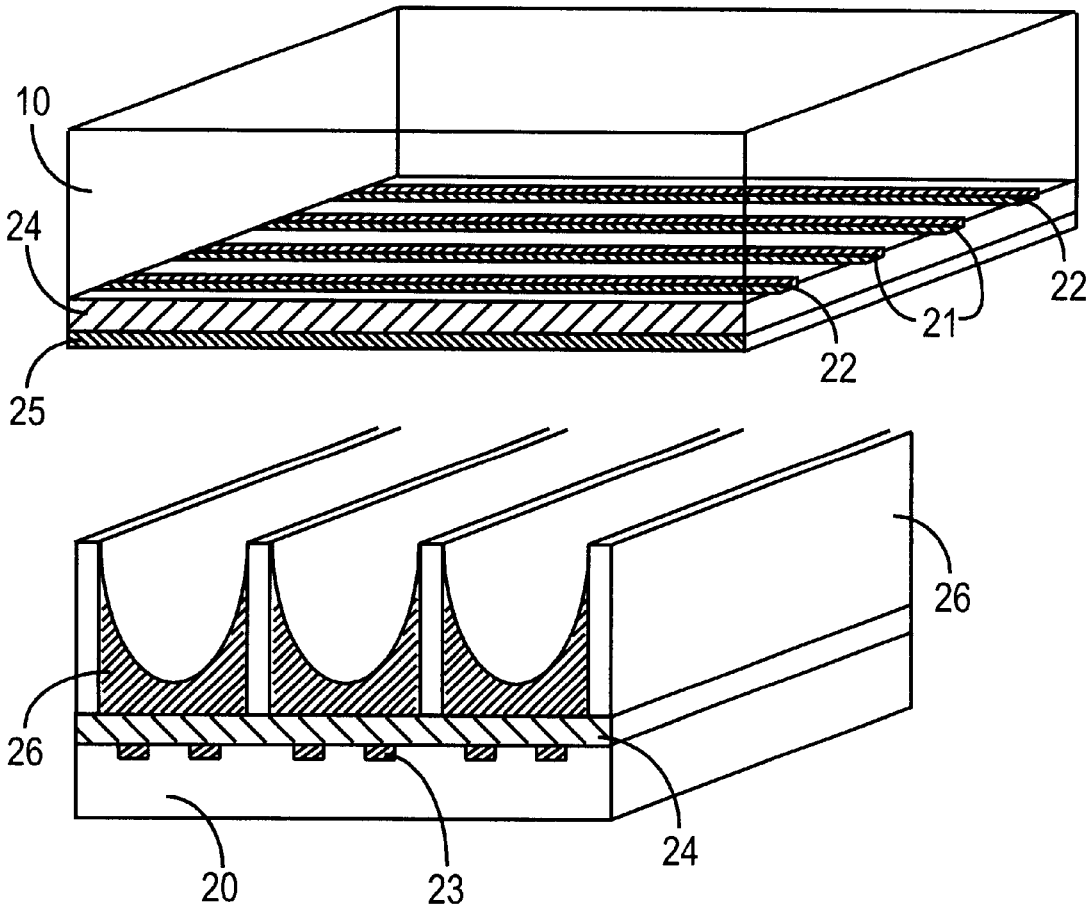
FIG. 11 shows a perspective exploded view of a PDP according to the third preferred embodiment.

In the PDP illustrated in FIG. 11, the plurality of electrodes 23 are disposed in a single display pixel.

When the PDP in the FIG. 11 is driven using the method described in the first embodiment, a sustain voltage of 245V and a emission efficiency of 2.94 lm/W were obtained with a panel in which the electrodes are placed at intervals of 0.5 mm and the distance between the substrates is 0.18 mm. By increasing further the number of the third electrodes 23, the emission efficiency can be improved even more.

Figure 12:
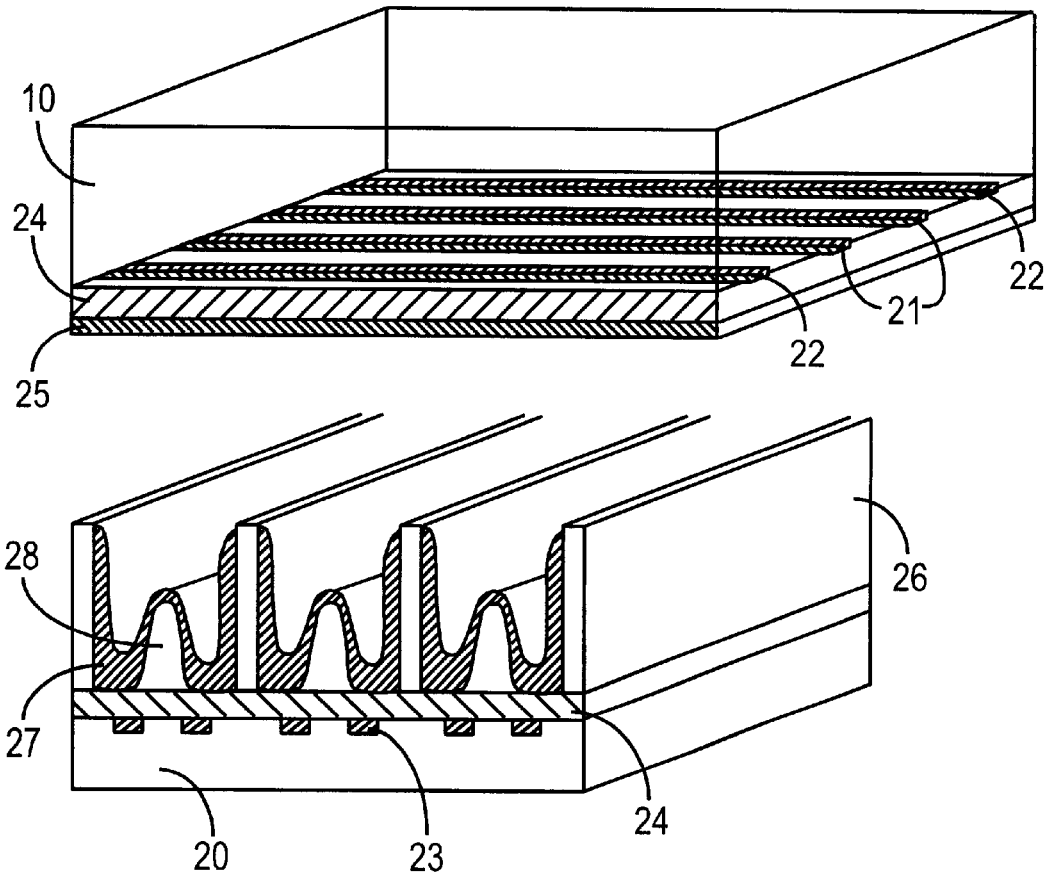
FIG. 12 shows a perspective exploded view of a PDP according to the third preferred embodiment.

The PDP illustrated in FIG. 12 has protrusions 28 in the plurality of electrodes 23 formed in one display pixel thereof. In the case of the PDP of FIG. 12, when the PDP in which the distances between the electrodes and the substrates are respectively set at 0.5 mm and 0.18 mm, and the height of the protrusions at 0.12 mm, is driven by the method described in the first embodiment, a sustain voltage of 250V and a emission efficiency of 3.40 lm/W were obtained.

Figure 13:
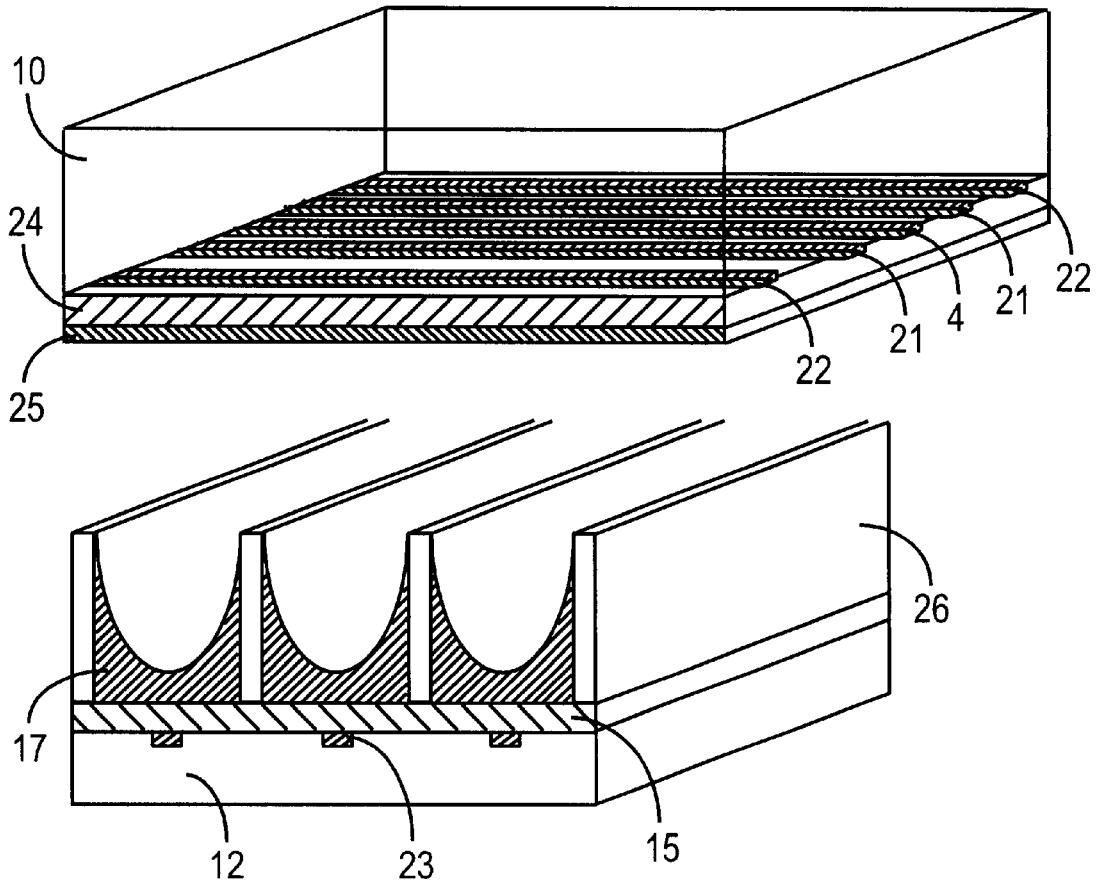
FIG. 13 shows a perspective exploded view of a PDP according to the third preferred embodiment.

The PDP illustrated in FIG. 13 has the electrodes 21 and 22 formed on the substrate 10, and a float electrode 4 is disposed in between the neighboring display pixels. When this PDP was driven, cross-talk and flickering of discharge can be suppressed. Further prevention of the flickering of discharge was achieved by introducing a plurality of float electrodes 4 in the neighboring display pixels.

Figure 14:
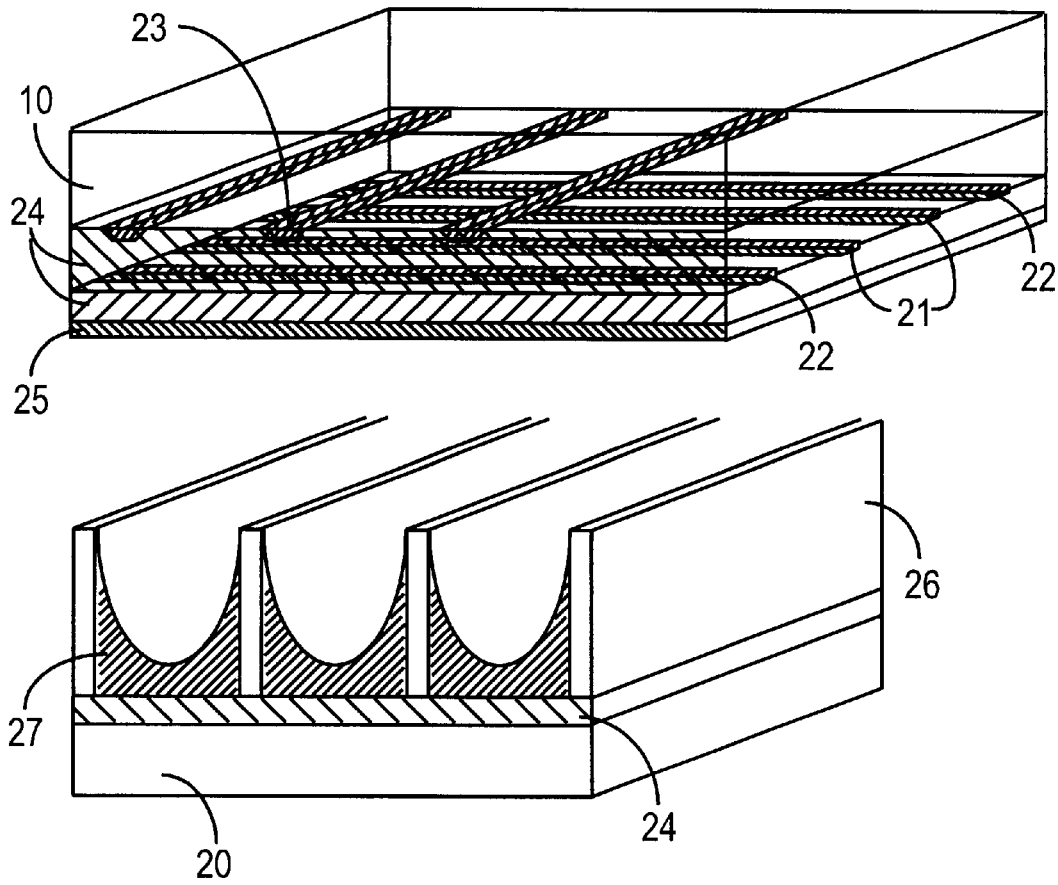
FIG. 14 shows a perspective exploded view of a PDP according to the third preferred embodiment.

The PDP in FIG. 14, has the electrodes 21 and 22 disposed on the substrate 10 thereof, and via the dielectric layer, the electrodes 23 disposed transversely to the electrodes 21 and 22 on the substrate 10. This construction allows material of high secondary-emission coefficient like MgO to be used on all of the electrodes as a protective film, thereby lowering the starting voltage.

When the panel of FIG. 14 was driven by the method described in the first embodiment, the sustain voltage could be reduced by about 10V. The third electrodes were also found able to be used as cathodes.

Figure 15:
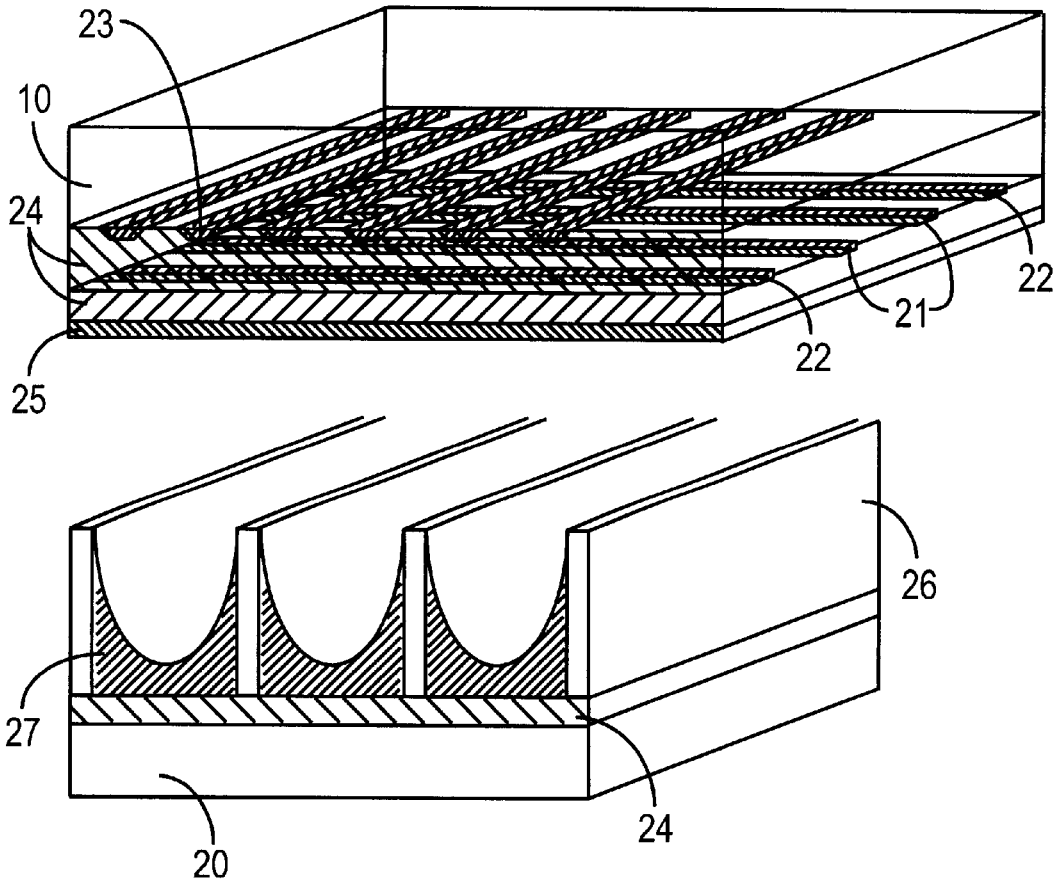
FIG. 15 shows a perspective exploded view of a PDP according to the third preferred embodiment.

The PDP illustrated in FIG. 15 is constructed such that a plurality of electrodes 23 are disposed in the display pixels of the PDP in FIG. 14. When the PDP of FIG. 15 was driven, the sustain voltage was lowered and the emission efficiency was increased.

Figure 16:
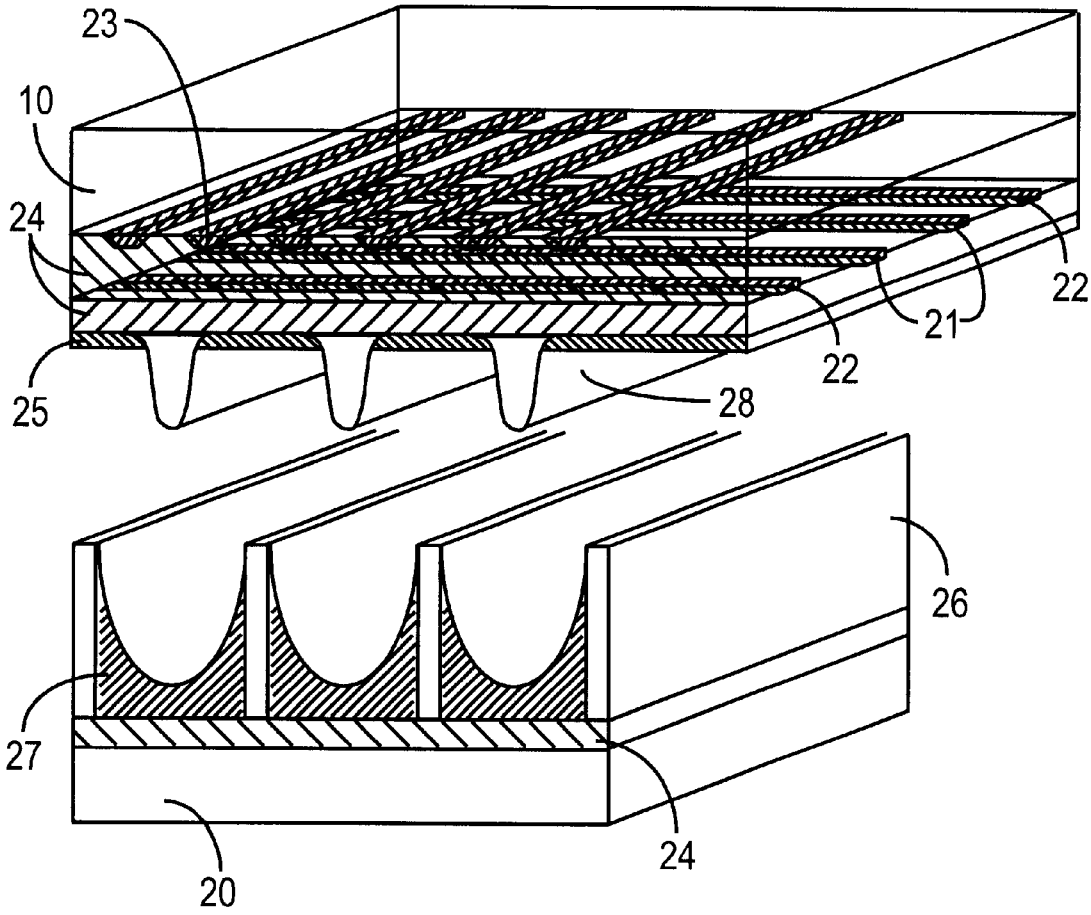
FIG. 16 shows a perspective exploded view of a PDP according to the third preferred embodiment.

The PDP illustrated in FIG. 16 is constructed such that protrusions 28 are formed in between the plurality of electrodes 23. When the PDP of FIG. 16 was driven, the sustain voltage was lowered and the emission efficiency was increased.

Fourth Preferred Embodiment

In this embodiment the driving method of the PDP is based on that of the first embodiment, and further include the followings;

a) creating a potential difference between the first and second electrodes as well as the first and the third electrodes and/or the third and second electrodes as described in the first embodiment.

b) emitting the light by applying current I main between the first and second electrodes, c) generating the counter electromotive force Vemf-main which suppress fluctuation of the discharge current I main, and d) applying the discharge current I sub between the third and second electrodes and/or the first and third electrodes.

Further, the potential of the first and second electrodes are simultaneously changed against the third electrodes.

In the process of creating a potential difference between the first and second electrodes, the changing speed of the potential is 1.0 V/ns or more.

The counter electromotive force Vemf-main is changed according to the rate of display.

The following is a description of this embodiment provided with reference to the drawings.

Figures 17A, 17B, 17C:
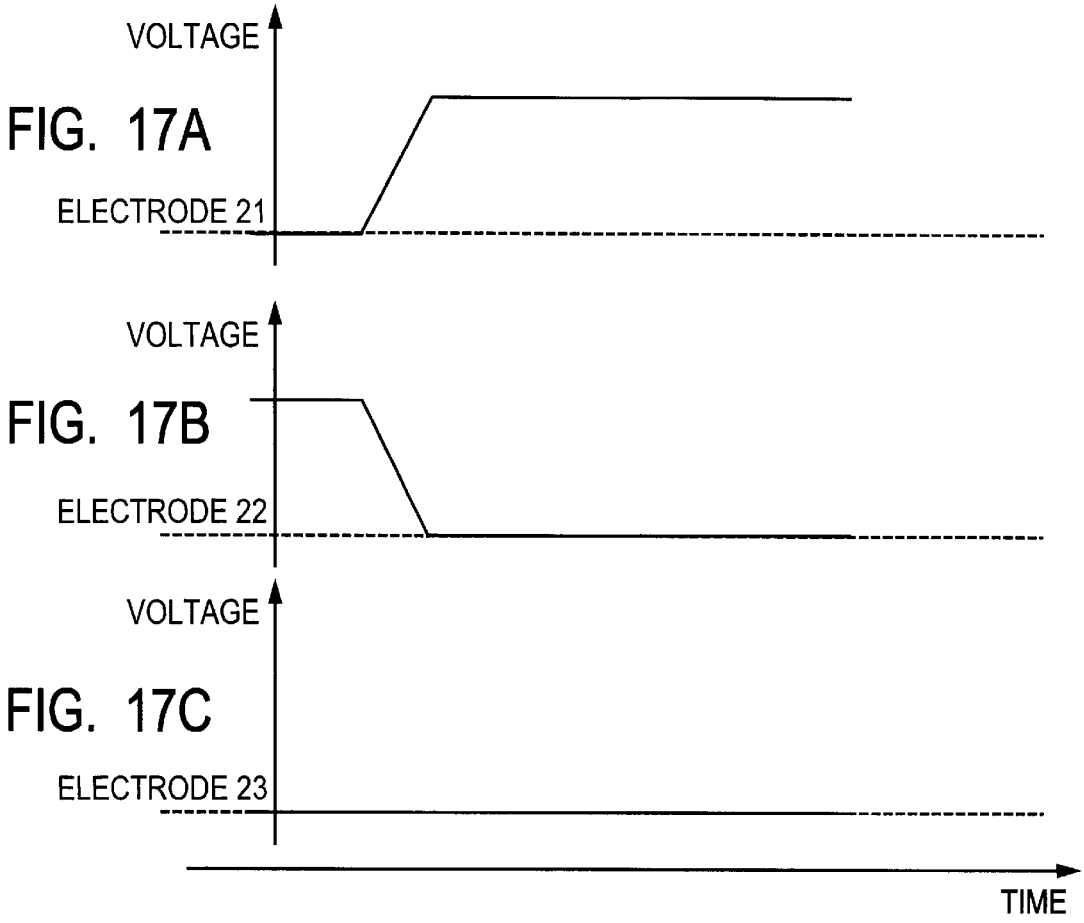
FIGS. 17A–17C show a chart illustrating voltage and current waveforms observed at each electrode according to a fourth preferred embodiment.

FIGS. 17A–17C show the voltage waveforms output from the circuit board to the electrodes 21, 22 and 23 during the sustain period. FIGS. 17A–17C only show the period in which the voltage of the electrodes 22 changes from "high" to "low", and the voltage of the electrodes 21, from "low" to "high".

During the sustain period, a period in which the voltage of the electrodes 22 changes from "high" to "low", and the voltage of the electrode 21, from "low" to "high", and a period in which the voltage of the electrode 21 changes from "high" to "low", and the voltage of the electrodes 22 from "low" to "high" are repeated, so that light is emitted continuously.

Figures 18A, 18B, 18C:
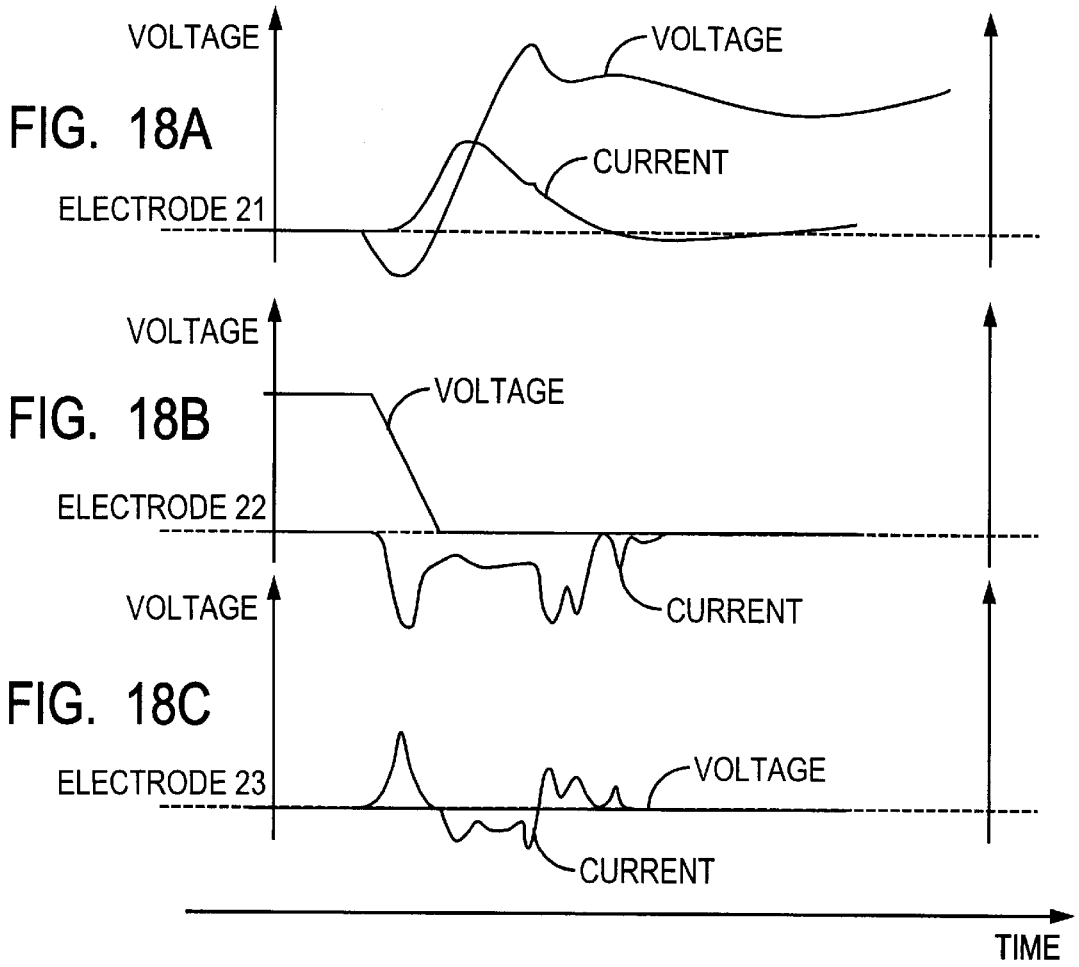
FIGS. 18A–18C show a chart illustrating voltage and current waveforms which occur when counter electromotive force Vemfmain is not applied to each electrode according to the fourth preferred embodiment.

By applying these voltages, a potential difference is created between the electrodes 21 and 22 as well as the electrodes 21 and 23, and the PDP is charged by setting the electrode 21 positive and the electrodes 22 and 23 negative, respectively. In this process, the potential of the electrodes 21 and 22 is changed against the electrodes 23 simultaneously. Further, voltage is applied so that the changing speed of potential is 1.0V/ns or more. In order to generate the counter electromotive force Vemf-C which suppresses fluctuation of the charging current of the panel, an inductance of 100 $\mu$H is inserted to the electrodes 21 side. Thus, the voltage and current waveforms of the electrodes 21,22 and 23 are observed as they are shown in FIGS. 18A–18C. Therefore, electric field between the electrodes 21 and 22 can be intensified immediately before the initiation of the discharge.

When the discharge starts, the discharge current I main starts to flow between the electrodes 21 and 22 and light is emitted. At this point, in order to generate the counter electromotive force Vemf-main which suppresses fluctuation of the discharge current, the inductance of 100 $\mu$H inserted to the electrodes 21 side on the circuit is used. This construction decreases the discharge current I main to form moderate current waveforms. The positive column observed at this point is strong and thick, and very stable.

Simultaneously with the initiation of the discharge, the discharge current I sub starts to flow between the electrodes 23 and 22 which are not applied with voltage. By having the discharge current I sub flow, it becomes possible to offset the reduction in the discharge current I main (namely the reduction in wall charge) brought about by the counter electromotive force Vemf-main. As a result, positive column discharge can be generated at a low voltage. If the counter electromotive Vemf-C is not intended to generate, the inductance can be inserted immediately before the discharge.

With this method of driving, on the PDP in which the distances between the electrodes 21 and 22 and the substrates 10 and 20 are respectively 0.5 mm and 0.21 mm, the sustain voltage of 245V and the emission efficiency of 2.54 lm/W were obtained.

As has been described, this embodiment achieves a stable creation of the positive column discharge and suppression of flickering of the discharge. Moreover, the positive column discharge created in this manner is high in efficiency, and realize high emission strength. By making the discharge current I sub flow, the reduction of the discharge current I main brought about the counter electromotive force Vemf-main can be offset, and the positive column discharge in the following cycle can be generated at a low voltage.

Figures 19A, 19B, 19C:
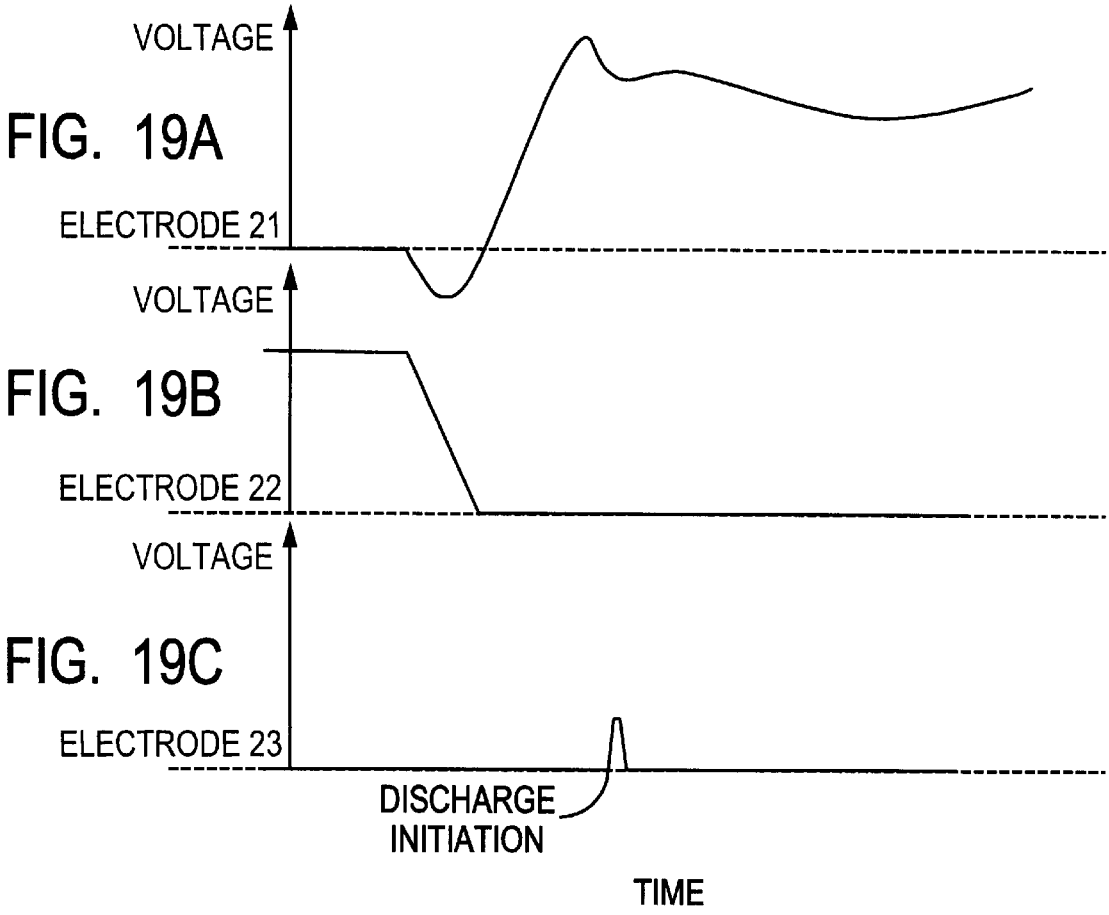
FIGS. 19A–19C show a chart illustrating waveforms of applied voltage observed when discharge current I sub is forced to flow according to the fourth preferred embodiment.

In order to flow the discharge current I sub, pulses can be applied on the electrodes 23 at the same time as the starting of the discharge. For a smooth flow of the discharge current I sub, a potential difference can be created between the electrodes 23 and 22 on charging the panel. FIGS. 19A–19C show the waveforms of the applied voltage observed when the discharge current is forced to flow by applying pulses on the electrodes 23.

[Display device]

The display device of this embodiment is the same as that of the first embodiment.

Fifth Preferred Embodiment

The fifth preferred embodiment is described hereinafter with reference to the drawings.

The driving method of the plasma display panel and the display device of this embodiment are the same as the ones described in the fourth preferred embodiment. However, in addition to that, a process of generating the counter electromotive force Vemf-sub which suppresses fluctuation of the discharge current on the electrodes 23 side of the circuit is provided.

[Driving Method]

In this embodiment, in order to generate the counter electromotive force Vemf-sub which suppresses fluctuation of the discharge current, an inductance of 100 $\mu$H is inserted to the electrodes 23 side of the circuit of the fourth embodiment. This suppresses the discharge current I sub flowing in the electrodes 23 to a minimum. If the counter electromotive force Vemf-C need not be applied, the inductance can be inserted immediately before the initiation of the discharge.

With this method of driving, on the PDP in which the distances between the electrodes 21 and 22 and substrates 10 and 20 are respectively 0.5 mm and 0.12 mm, a sustain voltage of 245V and a emission efficiency of 2.61 lm/W were obtained. Degradation of the phosphor layer formed on the electrodes 23 was prevented.

Regarding the influence of the following conditions as well as the methods, they are the same as that of the first embodiment.

a) influence brought about when the counter electromotive force Vemf-main is not generated by the inductance, b) influence brought about when the amount of the inductance is changed or driving voltage is intensified c) influence brought about when the changing speed of the potential is changed during the process of creating a potential difference between the electrodes 21 and 22, d) the method of generating the counter electromotive force Vemf-main and Vemf-C, and e) the method of controlling the counter electromotive Vemf-main accordingly to the display rate.

Sixth Preferred Embodiment

The sixth preferred embodiment is described hereinafter with reference to the drawings.

The plasma display apparatus of this embodiment is constructed based on the display apparatus of the fourth embodiment, however the distance between the substrates 10 and 20 is changed. Within a single display cell, a plurality of electrodes 23 are formed, and in between which protrusions are formed. The electrodes 21 and 22 are disposed on the substrate 10, and the electrodes 23 are disposed on the substrate 10 via the dielectric layer transversely to the electrodes 21 and 22 or they are disposed on the substrate 20. The electrodes 21 and 22 are formed on the substrate 10 and the float electrodes are formed between the neighboring display cells.

This embodiment is described hereinafter taking concrete examples.

The driving method of this embodiment is the same as that of the fourth embodiment.

The display apparatus is basically the same as that of the fourth embodiment, however, the construction of the panel is different. These differences are described hereinafter.

The panel in FIG. 1 was driven, changing the distance between the substrates 10 and 20 from 0.12 mm to 0.25 mm. As a result, the emission efficiency became remarkably large at 0.15 mm and more. For example, when the distance between the substrates is set to be 0.18 mm, a sustain voltage of 240V and a emission efficiency of 2.78 lm/W was obtained.

Figure 20:
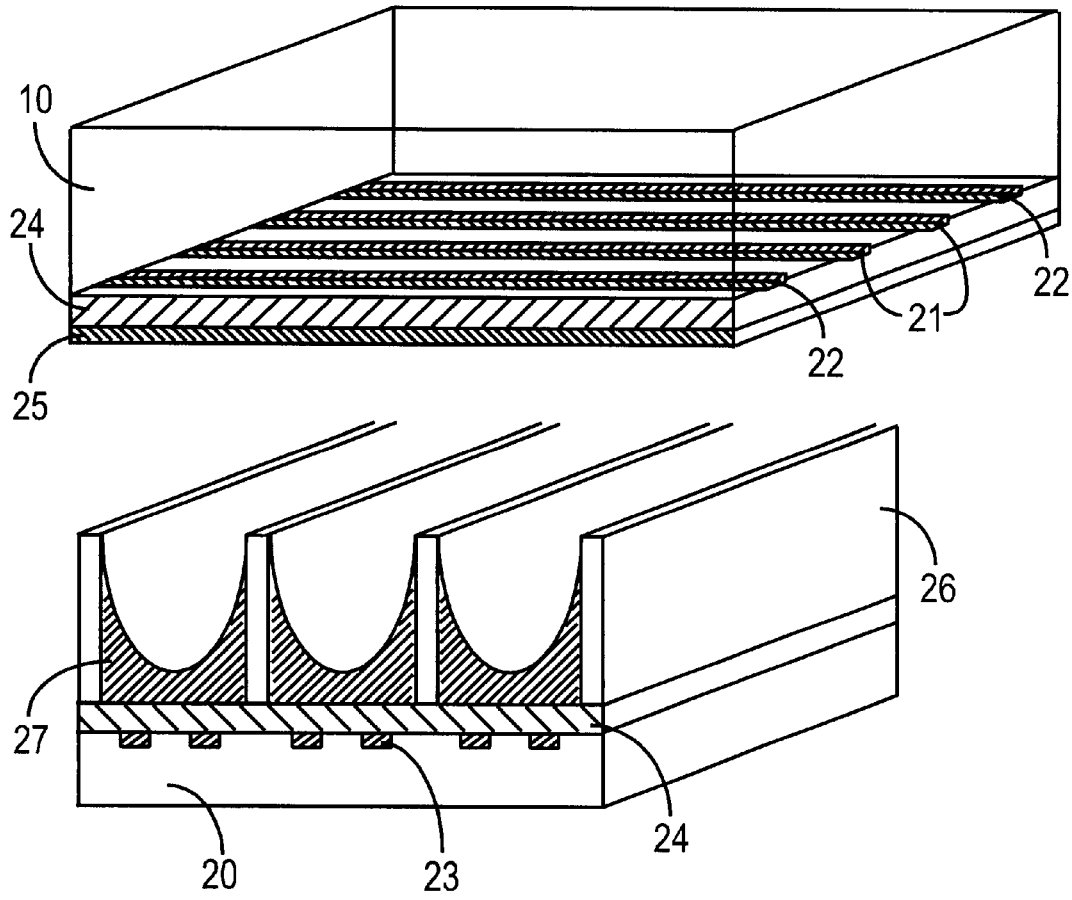
FIG. 20 shows a perspective exploded view of a PDP according to a sixth preferred embodiment.

The PDP of FIG. 20 has a plurality of electrodes 23 in a single pixel thereof.

The PDP in FIG. 20 was driven, changing the number of the electrodes 23. The result of drive is shown in the Table 1. Light was emitted from the whole display area, and the luminance and the emission efficiency were evaluated. For the evaluation of the luminance, CA-100 (product of MINOLTA CO.) was used. The emission efficiency was obtained by dividing the light beam calculated from the luminance by the input power during the discharge. The experiment was conducted on a panel in which distances between the substrates, the display electrodes, and between the neighboring ribs, are respectively 0.14 mm, 0.50 mm, and 0.44 mm.

TABLE 1

| Number of Electrodes 23 (per EU) | Luminance (cd/m$^2$) | Luminance Efficiency (lm/W) |
|---|---|---|
| 1 | 250 | 1.4 |
| 2 | 280 | 2.0 |
| 3 | 300 | 2.3 |
| 4 | 300 | 2.3 |

According to the Table 1, the luminance and the emission efficiency are increased by forming a plurality of third electrodes in an EU.

When the PDP in FIG. 20, wherein the distances between the electrodes 21 and 22 and the substrates 10 and 20 are respectively 0.5 mm and 0.12 mm, was driven by the method of this embodiment, a sustain voltage of 245V and a emission efficiency of 2.94 lm/W were obtained. When the distance between the substrates was 0.18 mm, a sustain voltage of 250V and a emission efficiency of 3.14 lm/W were obtained. By increasing the number of the electrodes 23 even further, the emission efficiency can be further improved.

Figure 21:
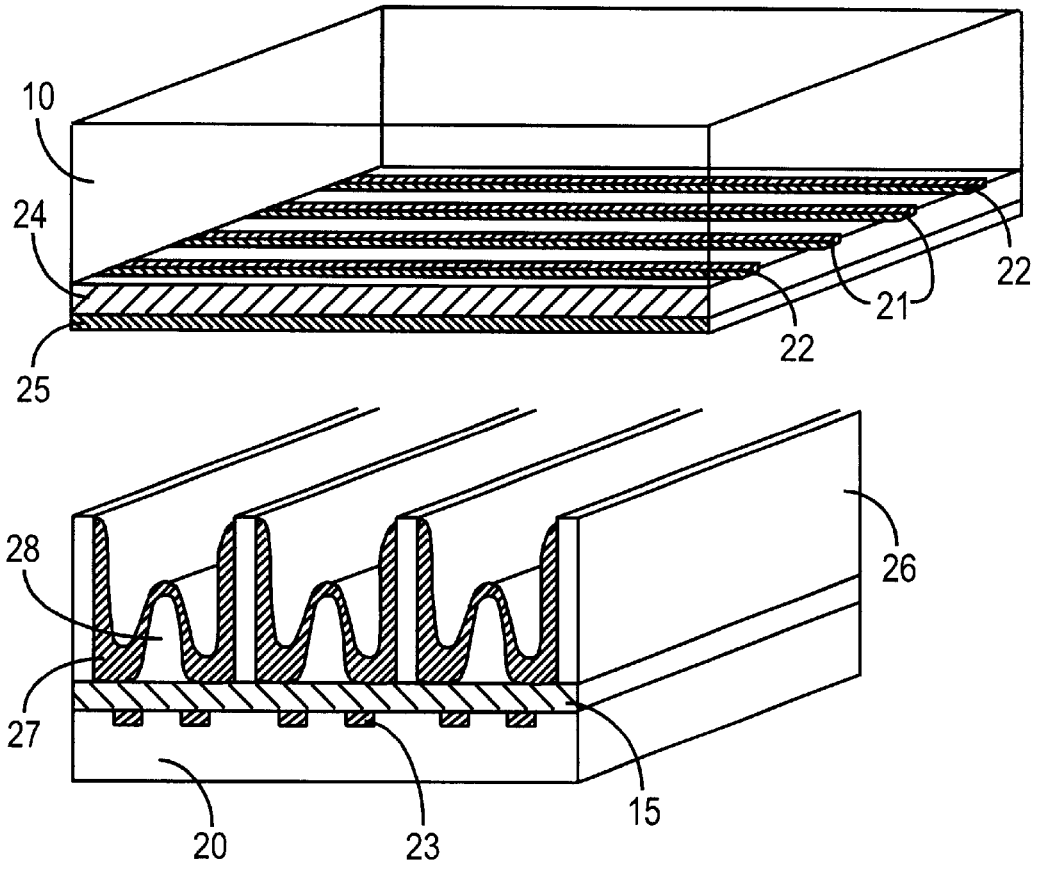
FIG. 21 shows a perspective exploded view of a PDP according to the sixth preferred embodiment.

The PDP in FIG. 21 has protrusions 28 between the plurality of electrodes 23 in a single display pixel. The protrusions 28 can be made very easily using the same material and the same method as that of the ribs 26. Though, the protrusions 28 do not have to be made with the same material with the ribs 26 nor made by the same method.

The protrusions 28 can be formed at any height, shape, and number according to the need. The protrusions 28 can be disposed contacting with the ribs 26. The protrusions 28 can be formed such that each of the plurality of protrusions connect to one another.

In the PDP in FIG. 21, the ribs 26 are forming strips, and two electrodes 23 are disposed parallel to the ribs 26 in an EU. Between the two electrodes 23 is the wall-shaped protrusion 28 disposed parallel to the electrodes 23 and the ribs 26 which are taller than the protrusions 28.

The PDP in FIG. 21 was driven by the conventional method, changing the height of the protrusions. The result is shown in Table 2. The experiment was conducted on a panel in which distances between the substrates, between the display electrodes, and between the neighboring ribs, are respectively 0.14 mm, 0.50 mm, and 0.44 mm.

TABLE 2

| Number of Electrodes 23 (per EU) | Height of Protrusions (micrometer) | Luminance (cd/m$^2$) | Emission Efficiency (lm/W) |
|---|---|---|---|
| 1 | 0 | 250 | 1.4 |
| 2 | 0 | 280 | 2.0 |
| 2 | 60 | 340 | 2.6 |
| 2 | 80 | 400 | 3.2 |
| 2 | 100 | 330 | 2.4 |

Table 2 shows that the luminance and the emission efficiency are increased by forming protrusions.

The PDP in FIG. 21 was driven by the method of this embodiment. When the panel in which the distances between the electrodes 21 and 22 and the substrates are respectively 0.5 mm and 0.18 mm, and the height of the protrusions 28 is 0.12 mm, a sustain voltage of 250V and a emission efficiency of 3.40 lm/W were obtained. By increasing the number of the electrodes 3 even further, the emission efficiency can be further improved.

Figure 22:
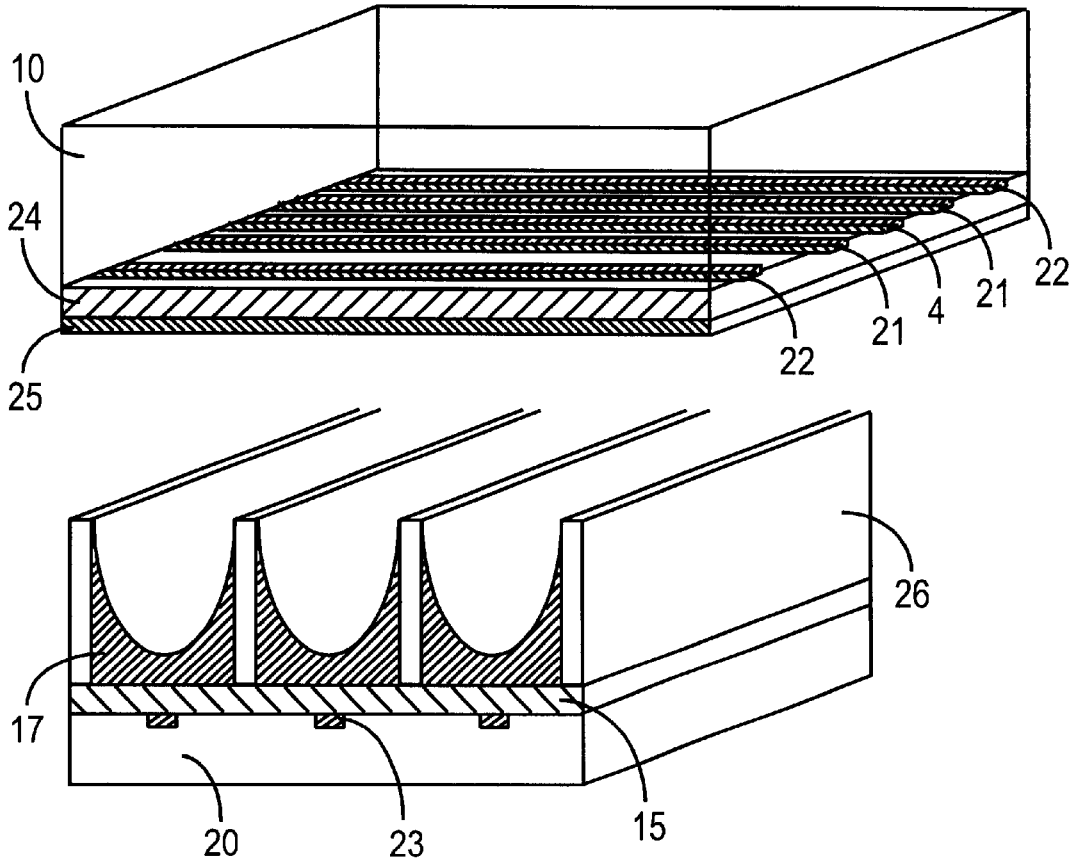
FIG. 22 shows a perspective exploded view of a PDP according to the sixth preferred embodiment.
Figure 23:
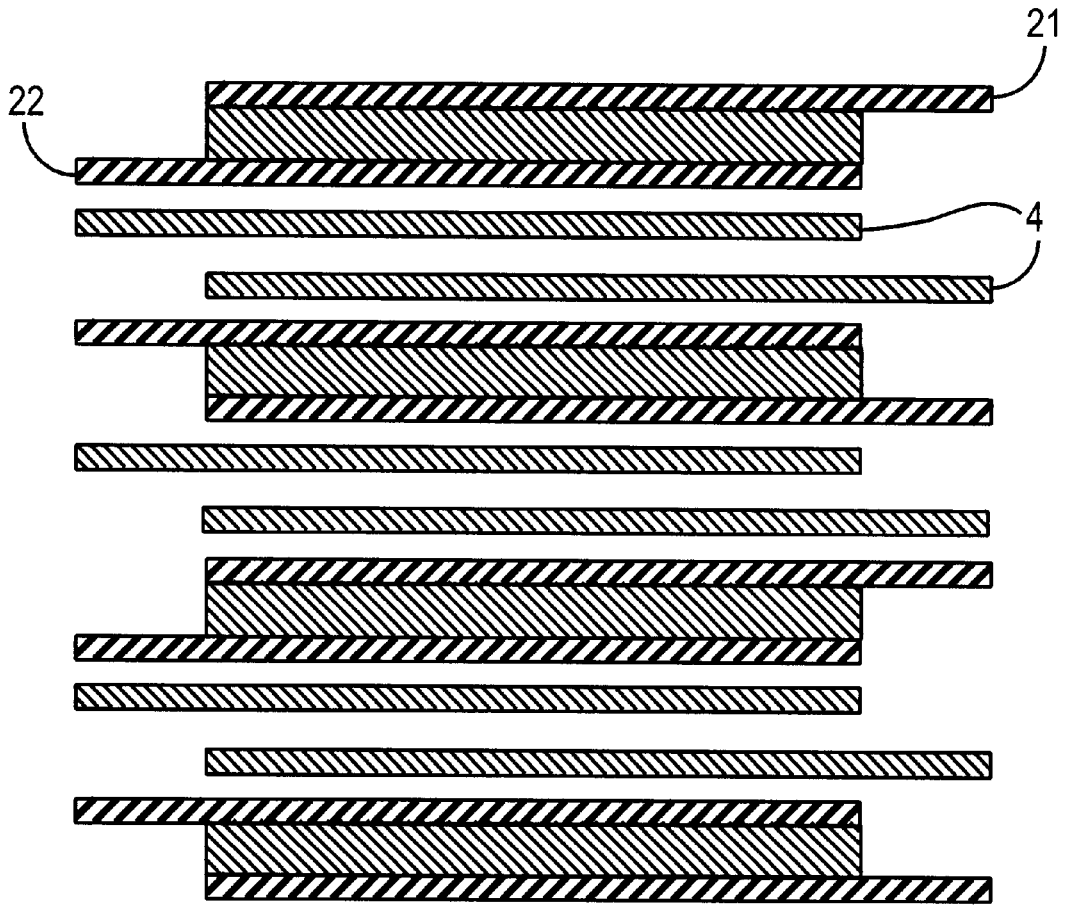
FIG. 23 shows a plan view of a PDP electrodes according to the sixth preferred embodiment.

In the PDP in FIG. 22, the electrodes 21 and 22 are formed on the substrate 10. Fourth electrodes (float electrodes) 4 are formed in the neighboring display pixels. A plan view of the float electrodes is shown in FIG. 23.

By driving the PDP in FIG. 22 by the driving method in this embodiment, cross-talk and flickering of discharge were suppressed. Flickering of discharge was further suppressed by forming a plurality of float electrodes 4 in the neighboring display pixels and connecting the electrodes 4.

Figure 24:
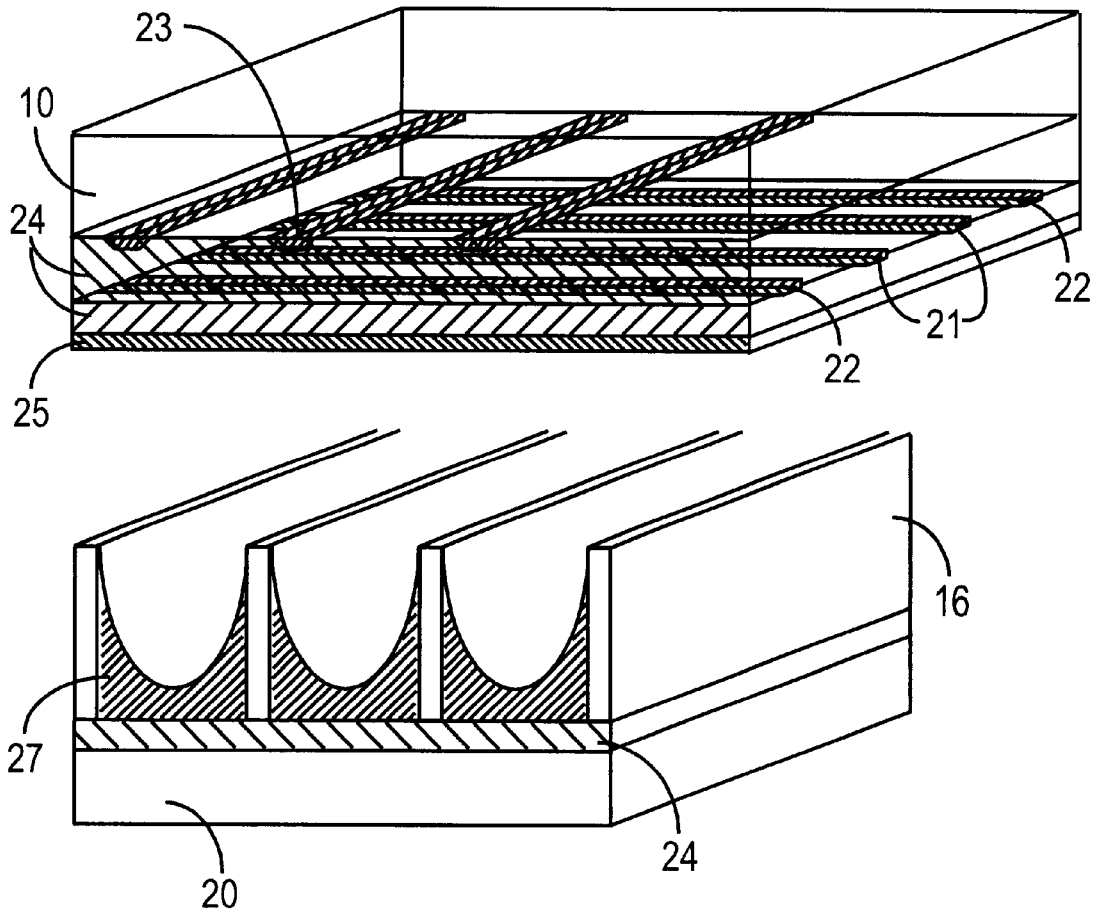
FIG. 24 shows a perspective exploded view of a PDP according to the sixth preferred embodiment.

The PDP in FIG. 24 has the electrodes 21 and 22 disposed on the substrate 10, and the electrodes 23 on the substrate 10 via the dielectric layer such that they transverse to the electrodes 21 and 22. This construction allows material of high secondary-emission coefficient like MgO to be used on all of the electrodes as a protective film.

When the PDP in FIG. 24 was driven by the method of this embodiment, the sustain voltage was lowered by 10V. Furthermore, the third electrodes were found able to be used as cathodes.

Figure 25:
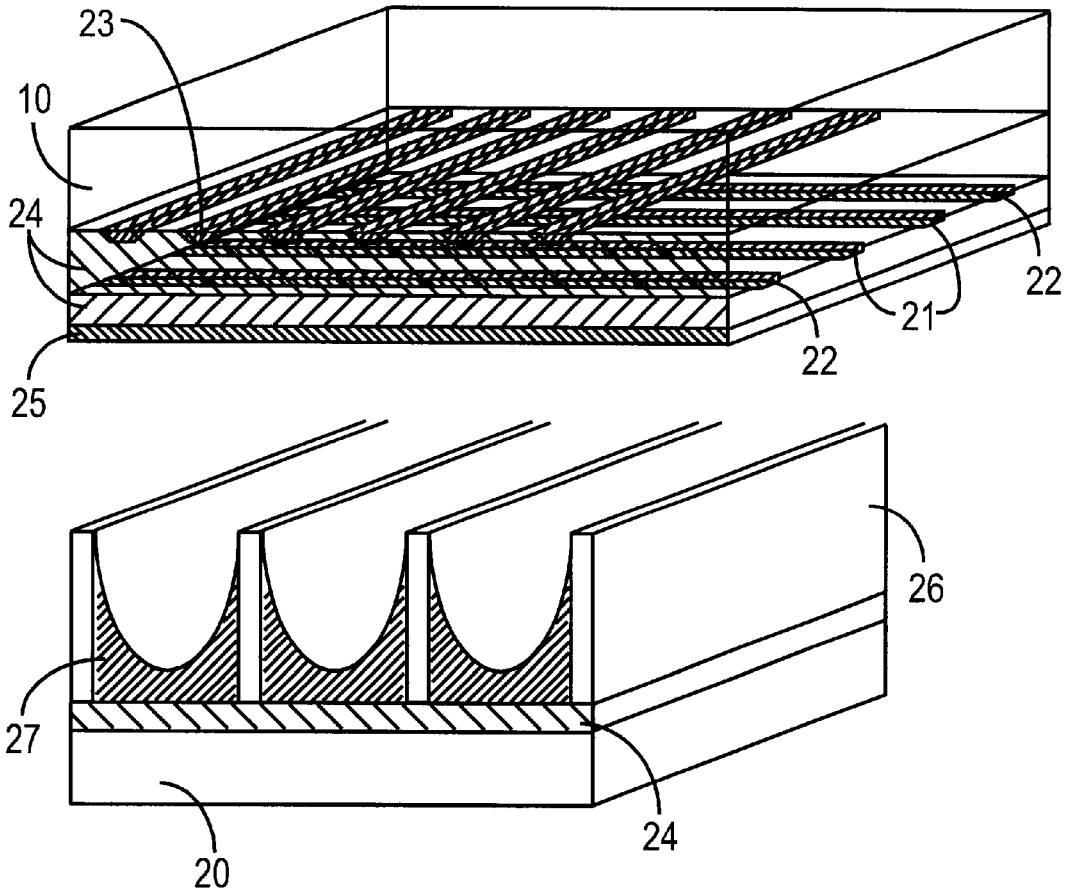
FIG. 25 shows a perspective exploded view of a PDP according to the sixth preferred embodiment.

The PDP in FIG. 25 has the electrodes 21 and 22 disposed on the substrate 10, and the electrodes 23 on the substrate 10 via the dielectric layer such that they transverse to the electrodes 21 and 22. Within a single EU, a plurality of electrodes 23 are formed.

When the PDP in FIG. 25 was driven by the method of this embodiment, the sustain voltage was lowered and the emission efficiency was enhanced.

Figure 26:
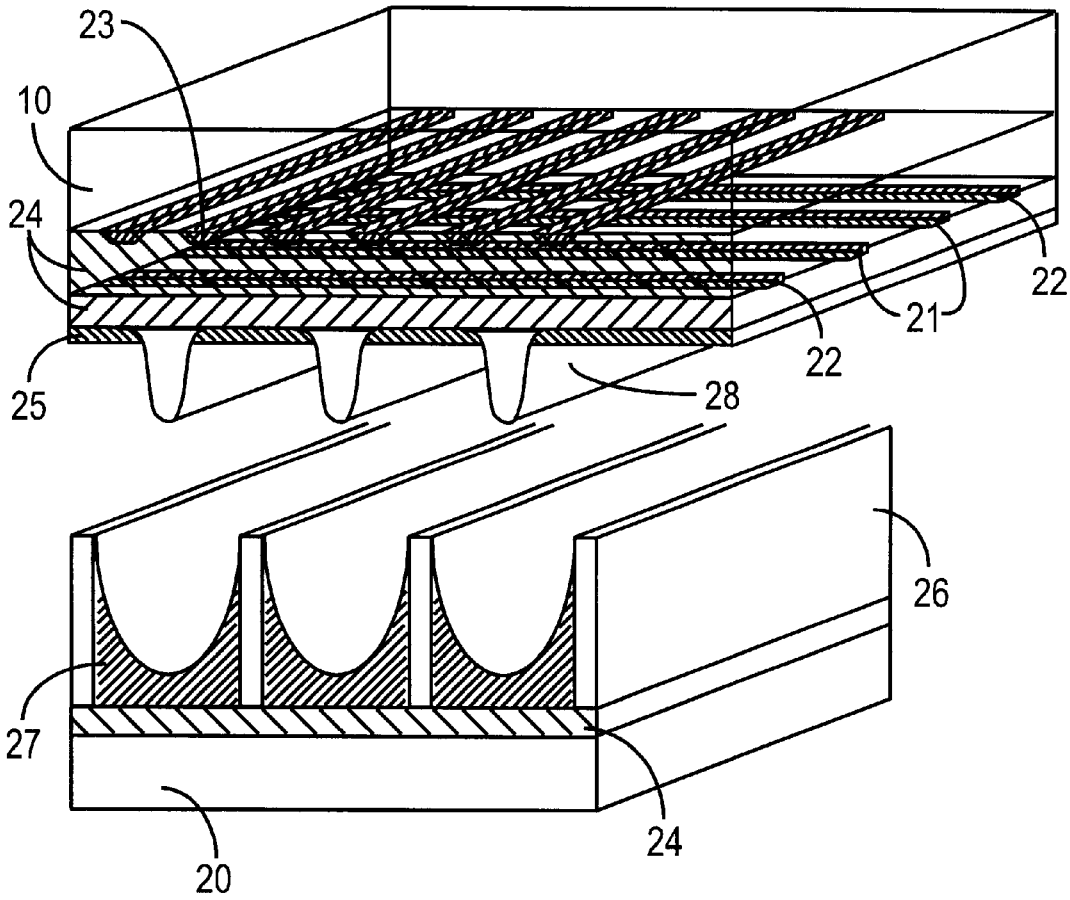
FIG. 26 shows a perspective exploded view of a PDP according to the sixth preferred embodiment.

The PDP in FIG. 26 has the electrodes 21 and 22 disposed on the substrate 10, and the electrodes 23 on the substrate 10 via the dielectric layer such that they are transverse to the electrodes 21 and 22. Between the plurality of electrodes 23 formed with in a single EU, is the protrusion 28.

When the PDP in FIG. 26 was driven by the method of this embodiment, the sustain voltage was lowered and the emission efficiency was enhanced.

Seventh Preferred Embodiment

Figure 27:
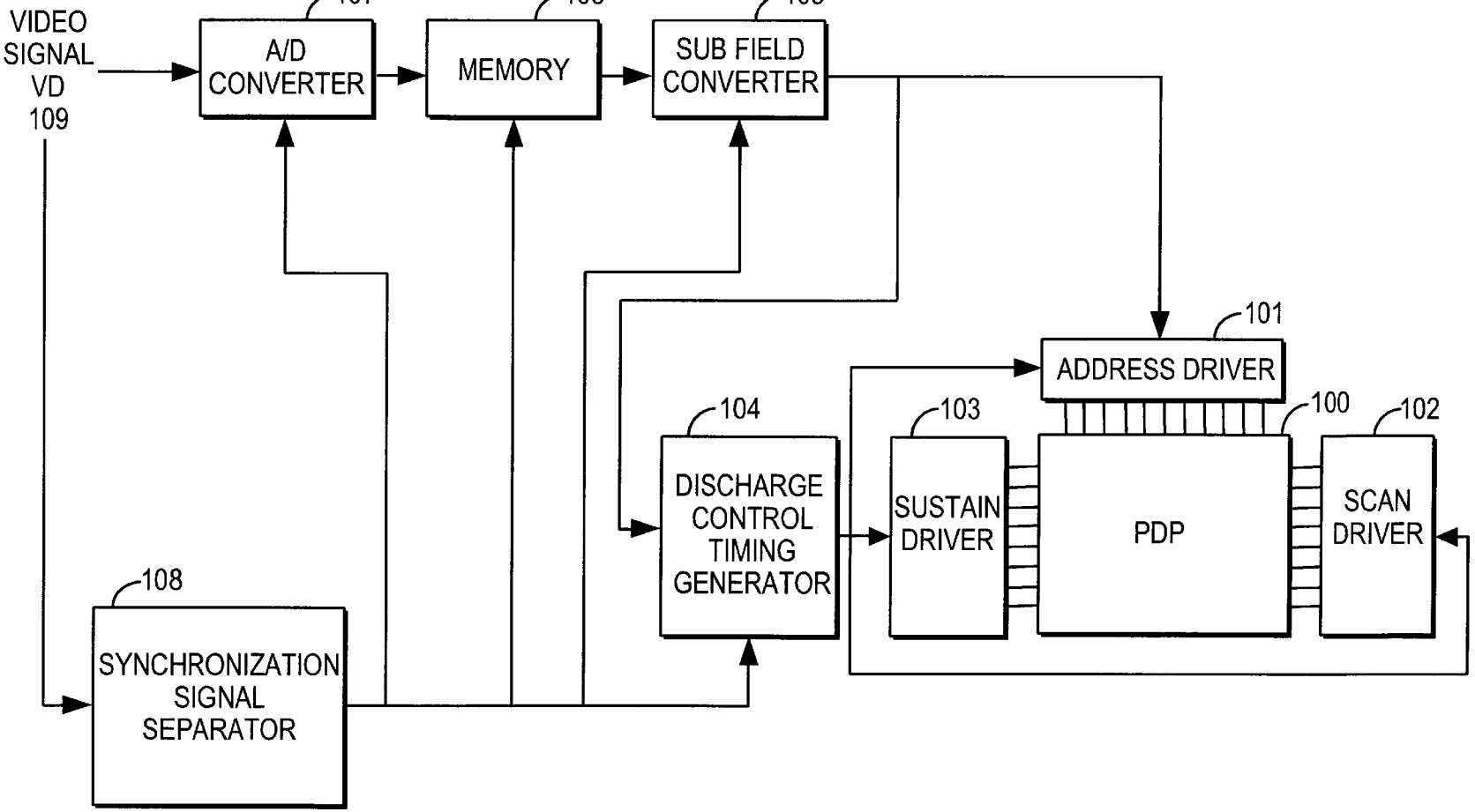
FIG. 27 shows a block diagram of a plasma display apparatus according to a seventh preferred embodiment.

A construction of the PDP of the seventh preferred embodiment of the present invention is roughly the same as the construction illustrated in FIG. 1. FIG. 27 shows a block diagram of the PDP apparatus of this embodiment. In FIG. 27, a PDP 100, an address driver 101, a discharge control timing generator 104, a sub-field converter 105, a memory 106, an A/D converter 107, a synchronizing signal separator 108 and a video signal 109 are shown.

The video signals 109 are converted in the A/D converter 107 from analog signals to digital signals, stored as video data for one field in the memory 106, separated in the sub-field converter 105 into the video data corresponding to a plurality of sub-fields, and output as data of one horizontal line to the address driver 101. The discharge control timing generator 104 outputs discharge control timing signals based on the number of sub-fields, and horizontal and vertical synchronizing signals to the sustain driver 103, the scan driver 102 and the address driver 101.

The PDP device constructed in the manner described above, is described in detail.

The synchronizing signal separator sends horizontal and vertical synchronizing signals to the A/D converter 107, the memory 106, the sub-field converter 105 and the discharge control timing generator 104.

The video signal 109 is input into the A/D converter 107. The A/D converter 107 converts the video signal 109 to a digital data of for example, 8 bit and 256 gradations. This video data is output to the memory 106. The memory 106 stores the digital data of 8 bit and 256 gradations of one field, and outputs the data of each bit to the sub-field converter 105.

The sub-field converter 105 converts the digital data of each field to the digital data of each sub-field corresponding to the number of sub-field. In the case of 8 sub-fields, for example, the data of each field is used as the data of each sub-field. However, when there are 12 sub-fields, a plurality of sub-fields are applied for one significant bit. Sub-fields are selected so that the light emitting sub-fields continues one after another in terms of time. Each of the pixel data of each of the selected sub-field is output to the address electrode driver 101 as a data of one horizontal line. The information of the number of the sub-field is output to the discharge control timing generating circuit 104.

The discharge control timing generator 104 generates the discharge control timing signals based on the horizontal and vertical synchronizing signals from the synchronizing signal separator 108, and the information of the number of the sub-fields output from the sub-field converter 105. The discharge control timing signals are fed to the scan driver 102, the sustain driver 103 and the address driver 101. These signals include a setup period, address period, a sustain period and an erase period as usual.

Figure 28:
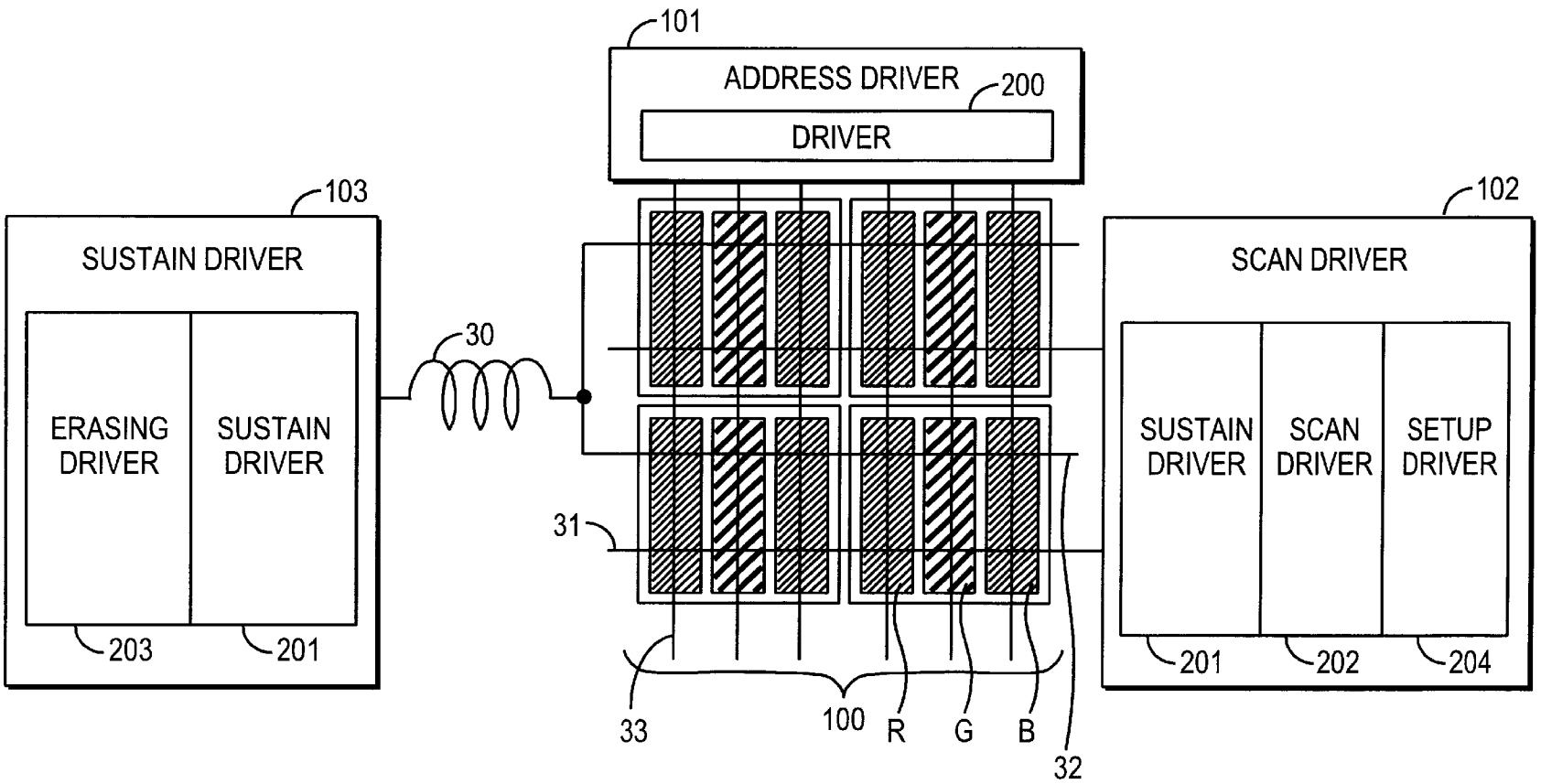
FIG. 28 shows an enlarged view of the panel driving section according to the seventh preferred embodiment.

FIG. 28 shows a block diagram illustrating a construction of the driving circuit of the PDP in FIG. 27. As FIG. 28 shows, the PDP 100 includes a plurality of address electrodes, a plurality of scan electrodes, and a plurality of sustain electrodes. The plurality of address electrodes are disposed vertically against the screen, whereas the plurality of scan and sustain electrodes are disposed horizontally against the screen. At the junctures of the address electrodes, the scan electrodes and,the sustain electrodes are discharge pixels. The discharge pixels of R,G and B form one pixel.

The address driver 101 includes a driver 200. The driver 200 drives the plurality of address electrodes 7 based on parallel data of each horizontal line fed to each sub-field from the sub-field converter 105 of FIG. 27. During the sustain and erase periods, the sustain pulses Psu and the erasing pulses Pe synchronized with the sustain driver 103 are output.

The scan driver 102 includes a scan driver 202 and a sustain driver 201. The scan driver 202 drives the plurality of scan electrodes consecutively by a plurality of scan pulses Psc gained by shifting vertically the discharge control timing signals fed from the discharge control timing generating circuit 104 of FIG. 27. During the setup period, setup pulses Pset are output at a time to the plurality of scan electrodes. During the sustain period, the sustain pulses Psu synchronized with the sustain electrode driver 103 are output simultaneously to the plurality of scan electrodes 32.

The sustain driver 103 includes a sustain driver 201 and an erasing driver 203. In between the sustain driver and the sustain electrodes is a coil 30 connected in series, so that pulse waveforms applied to the sustain electrodes have peaks and dips.

The discharge control timing generator 104 in FIG. 27 sends timing signals to each driver and the plurality of sustain electrodes 33 are driven at the same time.

The basic technological philosophy of the present invention is that in a three-electrode surface discharge AC type PDP, when the distance between the sustain electrodes and the scan electrodes on the front glass substrate is expanded and the discharge state is changed from negative glow to positive column discharge is stabilized, the luminance of the screen and light emitted are improved. The distance between the sustain and scan electrodes of the PDP of the present invention is longer than that of the conventional PDP. Therefore, higher voltage is required for starting the discharge. However, if high voltages are continuously applied, excessive discharge current will flow and it becomes difficult to improve the emission efficiency and the luminance of the screen. The driving method of the PDP of the present invention adjusts the discharge current by lowering the voltage so that the optimum current obtained after starting of the discharge. Since high voltages are applied at the beginning, the transverse discharge is easy to generate, and compared with the conventional PDP, the discharge current brought about by the transverse discharge is increased, helping to adjust the amount of the current flow to the optimal for positive column discharge.

Figures 29A, 29B, 29C:
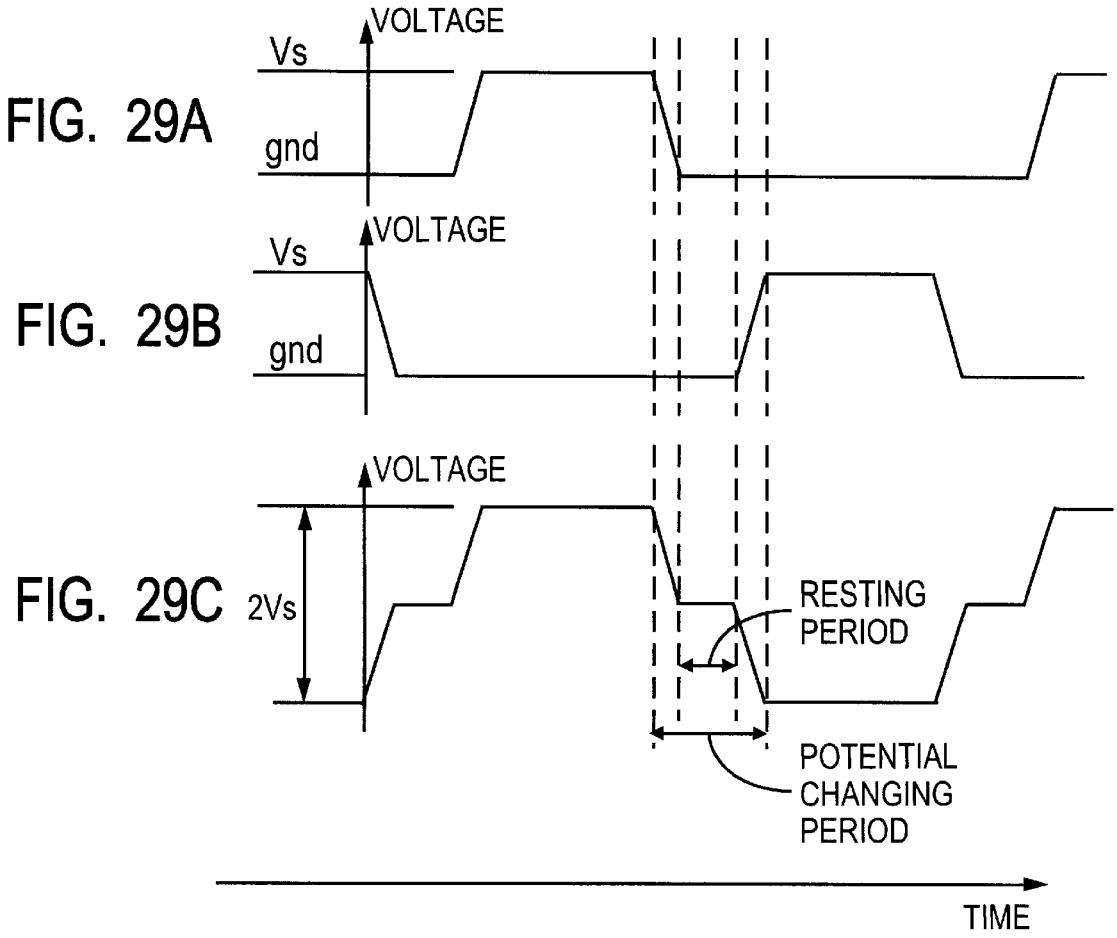
FIGS. 29A–29C show a timing chart of the sustain pulses according to the seventh preferred embodiment.

When the distance between the sustain and scan electrodes disposed on the front glass substrate of the PDP is expanded to 0.200 mm, and as a sustain pulses which have resting periods shown in FIG. 29 are applied on each electrode during the sustain period, the discharge state is changed from negative glow to the positive column discharge. As a result, the luminance of the screen and the emission efficiency are increased comparing to the PDP of which the electrodes is disposed at conventional intervals. In FIGS. 29A–29C, the horizontal axis shows time and the vertical axis shows voltage. FIG. 29A shows waveforms of pulses applied on the electrodes 31. FIG. 29B shows waveforms of pulses applied on the electrodes 32. FIG. 29C shows waveforms of a potential difference between the electrodes 31 and 32. When the electrodes 33 are connected to arbitrary voltage such as GND the discharge is stopped.

Figures 30A, 30B, 30C:
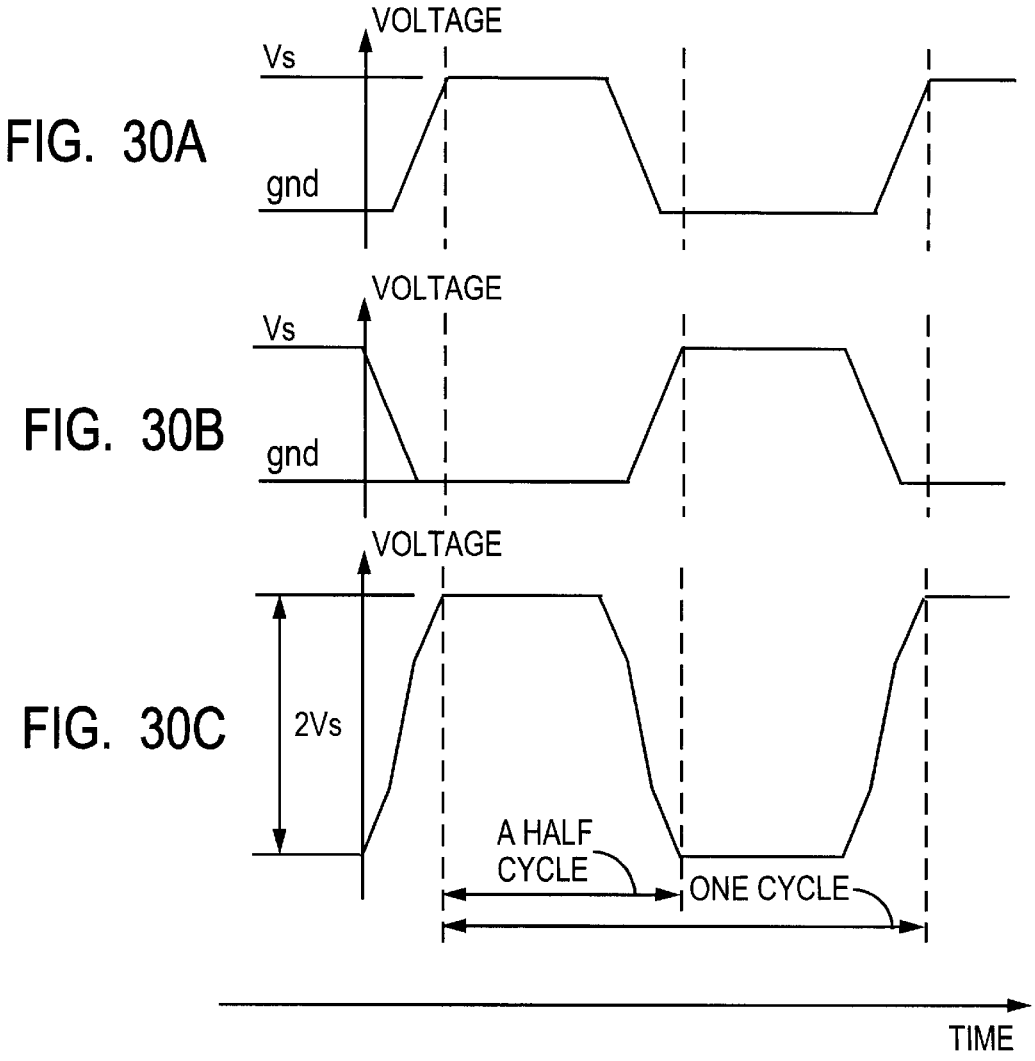
FIGS. 30A–30C show a timing chart of the sustain pulses according to the seventh preferred embodiment.

As FIGS. 30A–30C show, when halving the pulse length (halving the pulse cycle 30 $\mu$sec when the original cycle is 60 $\mu$sec), removing the resting period of the sustain pulses, eliminating the period when the sustain and scan electrodes have the same potential, and making the changing pattern of the potential linear rather than step change, the discharge of the positive column does not stop even if the address electrodes are connected to any potential. In FIG. 30, the horizontal axis shows time and the vertical axis shows voltage. FIG. 30A shows waveforms of pulses applied on the electrodes 31. FIG. 30B shows waveforms of pulses applied on the electrodes 32. FIG. 30C shows waveforms of a potential difference between the electrodes 31 and 32.

In this case, part of the surface discharge current flows in the electrodes 33. Therefore, when comparing with the case when the electrodes 33 are not connected to arbitrary potentials, the luminance of the screen is lowered slightly. However, the applied voltage becomes 300V, increased from the level observed in the conventional method, and the emission efficiency is around 1–1.51 m/W.

Figures 31A, 31B, 31C, 31D:
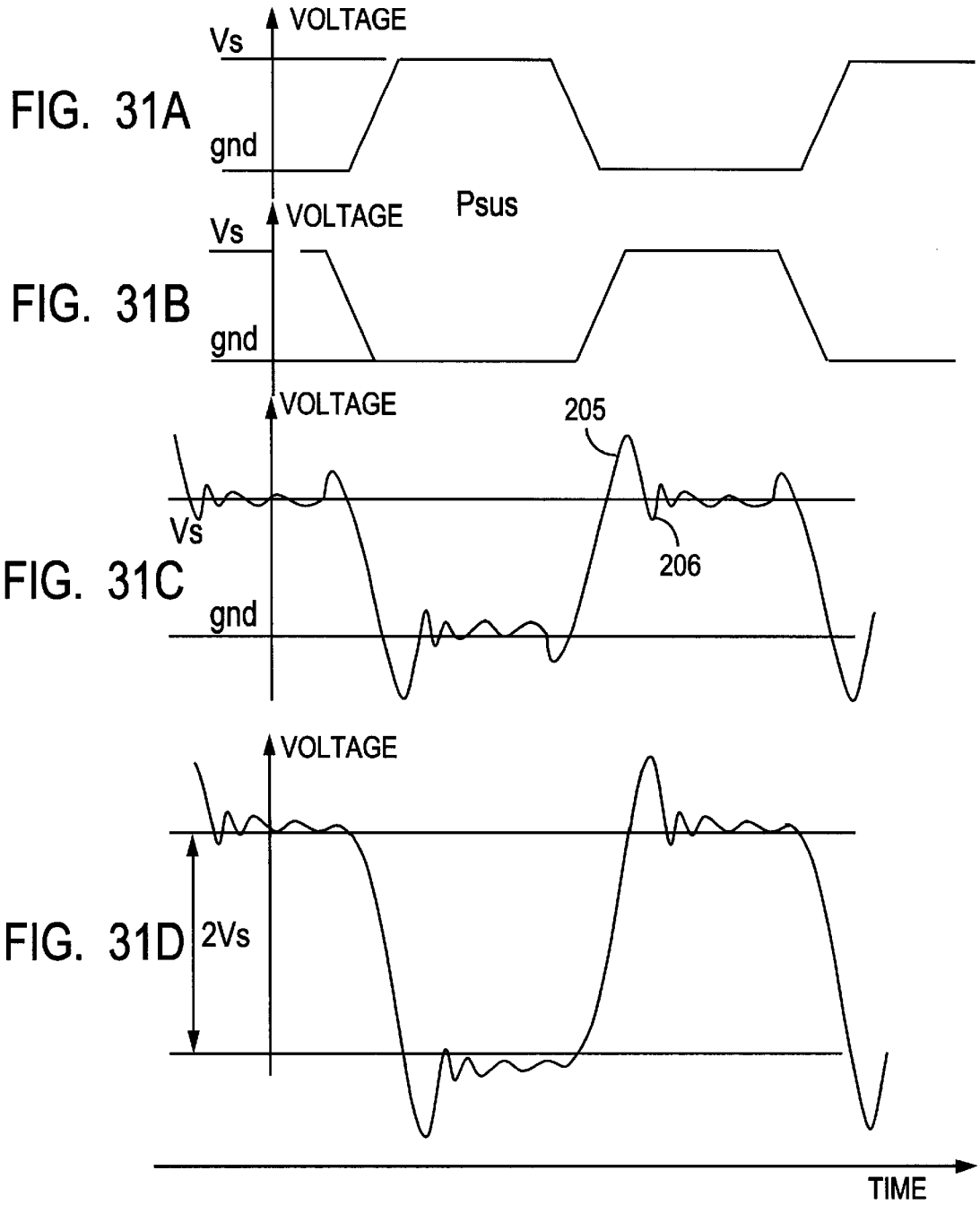
FIGS. 31A–31D show a timing chart of the sustain pulses according to the seventh preferred embodiment.
Figures 32A, 32B, 32C, 32D:
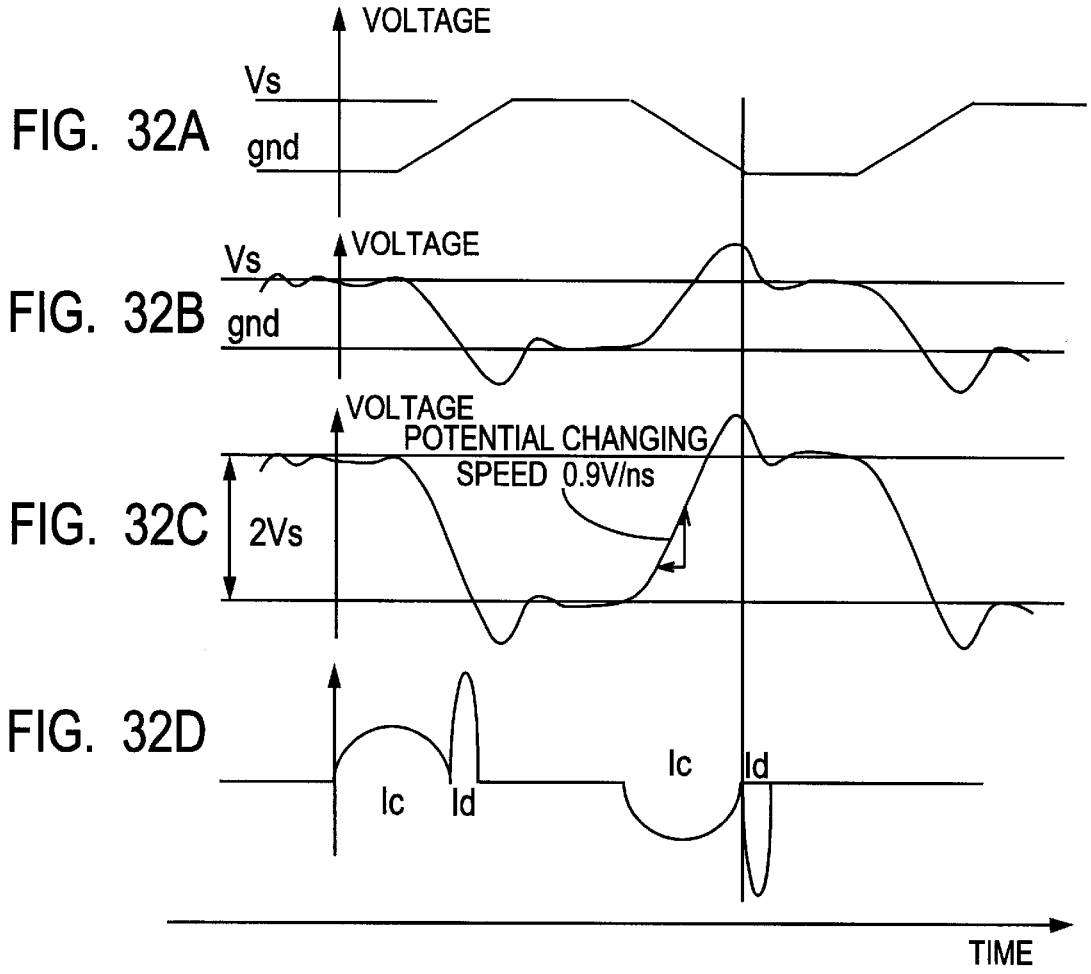
FIGS. 32A–32D show a schematic view illustrating the relationship between the sustain pulses and discharge current according to the seventh preferred embodiment.
Figures 33A, 33B, 33C, 33D:
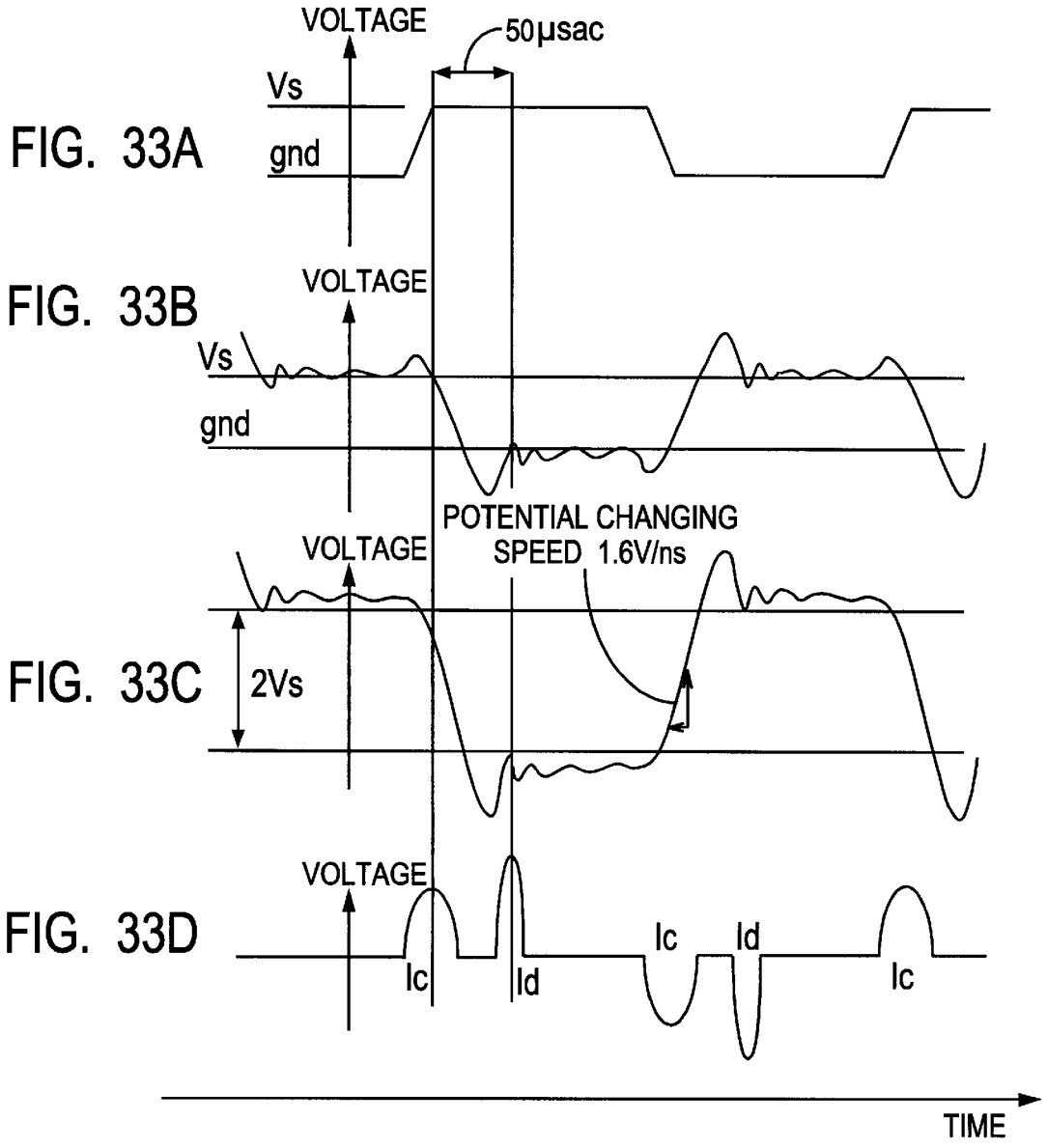
FIGS. 33A–33D show a schematic view illustrating the relationship between the sustain pulses and the discharge current according to the seventh preferred embodiment.

A coil of 100 $\mu$H is serially connected to the sustain electrodes. This causes the sustain pulses to have overshoot with ringing time as shown in FIGS. 31A–31D. As a result, hills 205 and dips 206 are generated In FIGS. 31A–31D, the horizontal axis shows time and the vertical axis shows voltage. FIG. 31A shows waveforms of pulses applied on the electrodes 31. FIG. 31B shows waveforms of pulses applied on the electrodes 32. FIG. 31C waveforms of pulses applied on the electrodes 32 after the coil is connected. FIG. 31D shows waveforms of a potential difference between the electrodes 31 and the electrodes 32 after the coil is connected. As shown in these charts, the discharge current flows in the electrodes 33 on the back substrate and the transverse discharge occurs. The discharge current used for the transverse discharge comprises 30% or more of the addition of the surface discharge current and transverse discharge current. Thus, compared with the conventional driving method, the surface discharge current is lowered and the discharge status of the positive column is stabilized. The emission efficiency of this state was 1.5–2.1 m/W. When the inductance of the coil was changed, at 100 $\mu$H and more, the transverse discharge current became 30% or more of the addition of the surface discharge current and transverse discharge current, thereby stabilizing the positive column.

The changing speed of the potential of the sustain pulses applied on the discharge space was changed from approximately 0.9V/nsec to 1.6V/nsec. FIGS. 32A–32D and 33A–33D show the relationship between the changing speed of the potential of the sustain pulses applied in the discharge space and the discharge current. FIGS. 32A–32D and FIGS. 33A–33D show the discharge current when the changing speeds of the potential are set 0.9V/ns and 1.6V/ns respectively. In FIGS. 32A–32D and 33A–33D, the horizontal axis shows time and the vertical axis shows voltage. FIG. A shows waveforms of pulses applied on the electrodes 31. FIG. B waveforms of pulses applied on the electrodes 32 after the coil is connected. FIG. C shows waveforms of a potential difference between the electrodes 31 and the electrodes 32 after the coil is connected. FIG. D shows the discharge current. Ic is the charging current and Id is the discharge current.

In FIGS. 32A–D, before the sustain pulses are applied on the electrode 31 and immediately after discharge started up, discharge current flows. In contrast, in FIGS. 33A–33D, after the sustain pulses on the electrode 31 start up completely, the discharge current start to flow at intervals of 50 ns or more. Thus, the minimum sustain voltage becomes 250V.

Figure 34:
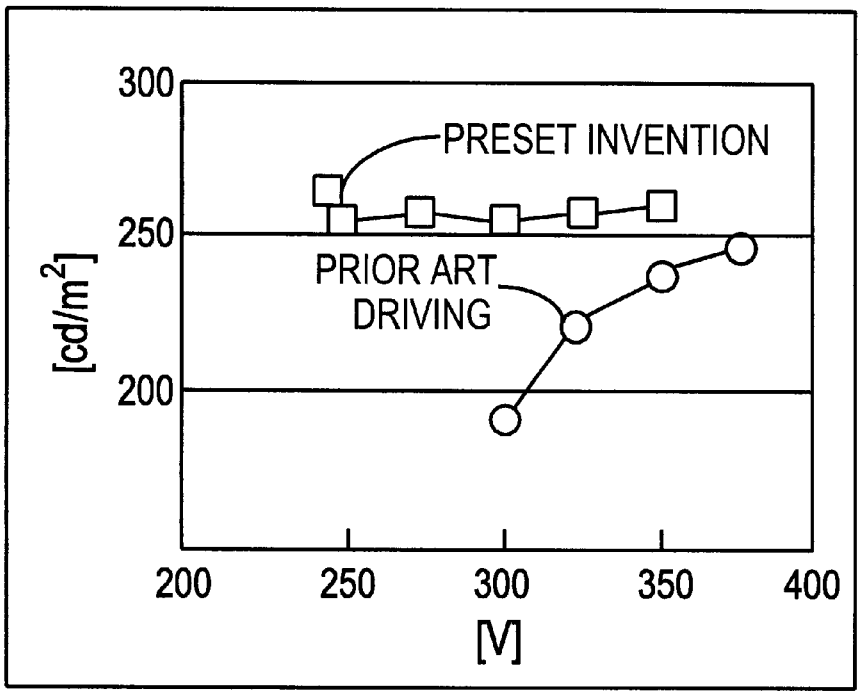
FIG. 34 shows a graph illustrating the relationship between sustain pulse voltages and luminance of the PDP according to the seventh preferred embodiment.

FIG. 34 shows the relationship between the applying voltage of the sustain pulses and the luminance of the screen. With the conventional driving method, the luminance of the screen and the applied voltage have a proportional relationship. However, in this embodiment, by raising the speed of the commencement and curtailment of the sustain pulses, a voltage range in which the luminance of the screen and the applied voltage have an inverse proportional relationship. Due to this, with a minimum sustain voltage, the luminance of the screen and the emission efficiency reach the maximum of 2.5 lm/W or more. Similarly, an experiment was conducted by changing the changing speed of the potential. As a result, improvements in the luminance of the screen and the emission efficiency were observed when the changing speed of the potential was 1.0V/ns or more.

Regarding the distance between the electrodes, an experiment was conducted by changing the distance between the sustain and scan electrodes from 0.100 mm to 0.500 mm. In this case, when the distance was 0.200 mm and over, a similar result was obtained.

In this embodiment, the coil was connected to the electrodes 32 serially, however, when the coil was connected to the electrodes 31, and both electrodes 31 and 32, a similar result was obtained.

Eighth Preferred Embodiment

The PDP of this embodiment is based on the PDP of the fourth embodiment. However, the electrodes 23 are floated or are connected to the earth via a high resistance.

Figure 35A:
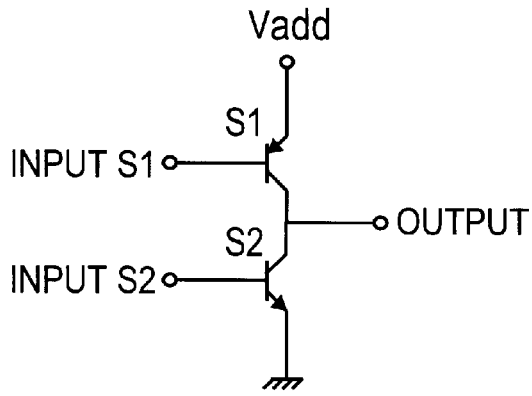
FIGS. 35A–35C show a driving circuit of an electrode 3 of the PDP according to a preferred embodiment 8.

The following is an example of a method to change the the electrodes 23 to floating. FIG. 35A shows a basic construction of the switching element. The switching element in FIG. 35A comprises a complementary pair. To apply voltage on the electrodes 23, S1 and S2 are switched ON and OFF respectively. When the electrodes 23 are connected to the earth, S1 and S2 are respectively switched OFF and ON. To make the state of the electrodes 23 floating, both S1 and S2 are switched OFF.

Figure 35B:
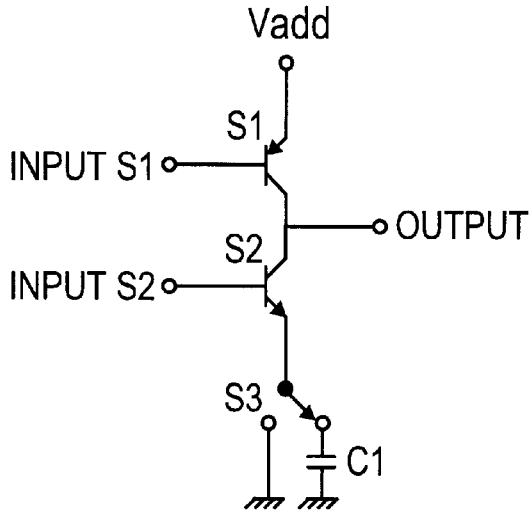

As it is shown in FIG. 35B, the same result is obtained when a floating state is generated by introducing a switch S3 and a capacitor C1. In this case, S1 and S2 are respectively switched OFF and ON, and S3 to the capacitor C1.

Figure 35C:
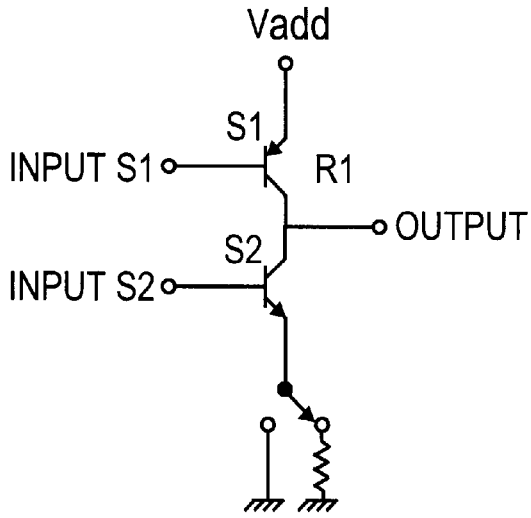
Figure 36:
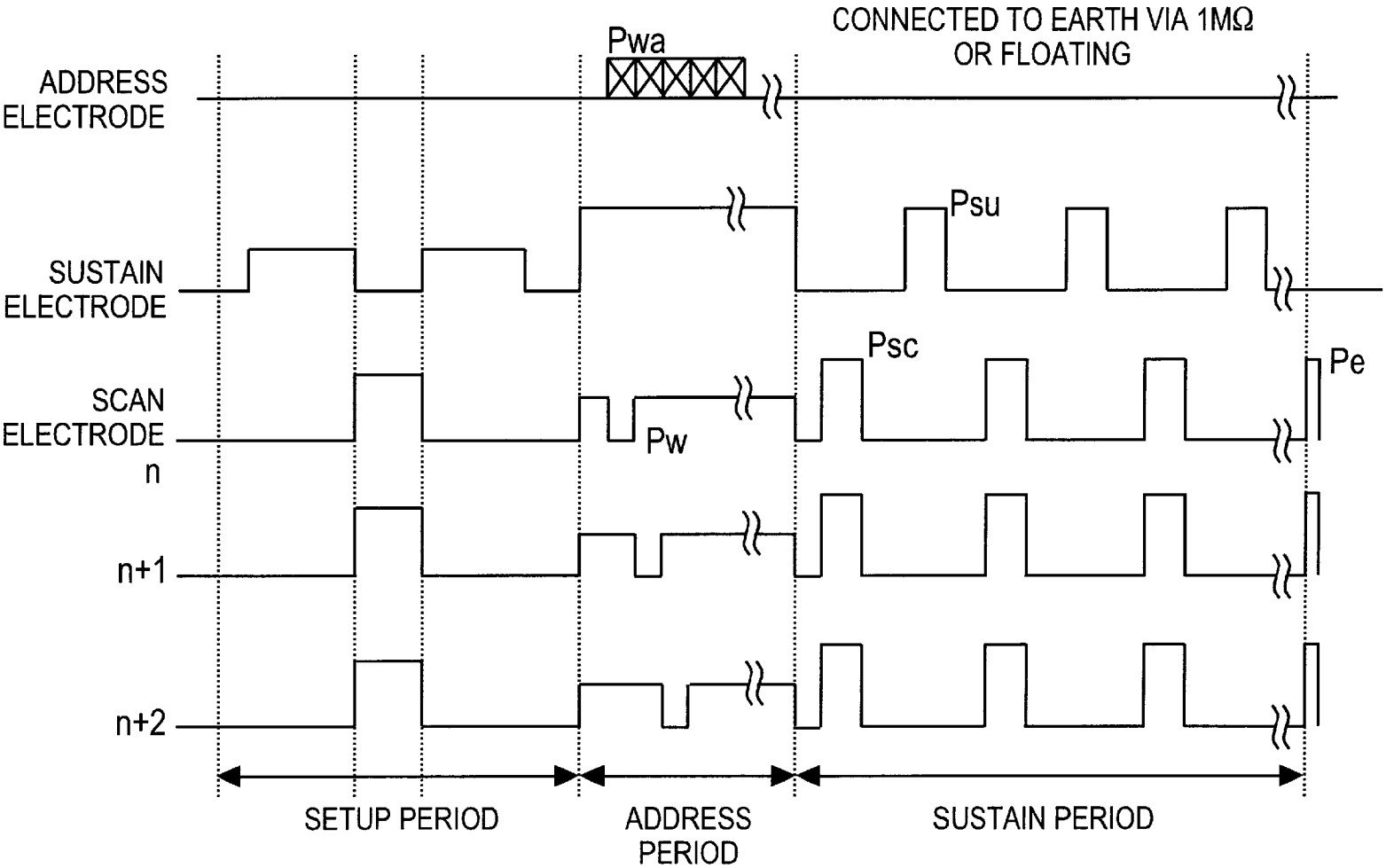
FIG. 36 shows a timing chart illustrating driving voltages applied on each electrode of the PDP when electrodes 3 are high-resistance terminated.

Further, as shown in FIG. 35C, a resistor of 1 M ohm or more can be connected to terminated at high resistance, to obtain the same result. In this case, S1 and S2 are respectively switched OFF and ON, and S3, to the resistor. FIG. 36 shows a timing chart showing the driving voltage applied on each electrode when the space between the address electrodes 23 and the earth is kept floating or resistance between them is set at 1 M ohm or more.

Light was emitted from the whole screen of the display device described above, and the luminance and the emission efficiency were evaluated.

Table 3 shows the comparison between the conventional method and the present invention regarding the relationship of the distance between the display electrodes and the luminance and the emission efficiency. In this case, as conditions of the present invention, the address electrodes were floated and a resistance of 1 Mohms was placed at the termination. The height of the ribs was set between 130 and 150 $\mu$m.

TABLE 3

| Distance between | Connection of the Address Electrodes | | | | | |
|---|---|---|---|---|---|---|
| | Earth (conventional art) | | Floating | | Earth via a Resistor of 1 Mohms | |
| Display Electrodes | Luminance cd/m$^2$ | Emission Efficiency lm/W | Luminance cd/m$^2$ | Emission Efficiency lm/W | Luminance cd/m$^2$ | Emission Efficiency lm/W |
| 80 | 180 | 0.9 | 200 | 1.0 | 200 | 1.0 |
| 100 | 200 | 1.0 | 240 | 1.2 | 220 | 1.1 |
| 200 | 330 | 1.1 | 420 | 1.4 | 360 | 1.2 |
| 300 | 420 | 1.2 | 560 | 1.6 | 455 | 1.3 |
| 400 | 500 | 1.2 | 750 | 1.8 | 583 | 1.4 |

According to Table 3, compared with the conventional method in which the electrodes 3 are set at earth potential, the display device of the present invention has higher luminance and emission efficiency. Flickering of the discharge was significantly lowered as well. The wider the distance between the display electrodes were, the higher the emission efficiency became.

As it has been clearly shown, by floating the address electrodes 23 or increasing the resistance between the address electrodes 23 and the earth to be 1 M ohm or higher during the display discharge period, unnecessary discharge between the electrodes 21 or the electrodes 22 and 23 can be suppressed. The present invention allows lowering of the flickering of the discharge and improvement of the luminance and the emission efficiency without changing the conventional driving circuit significantly.

Ninth Preferred Embodiment

Figure 37:
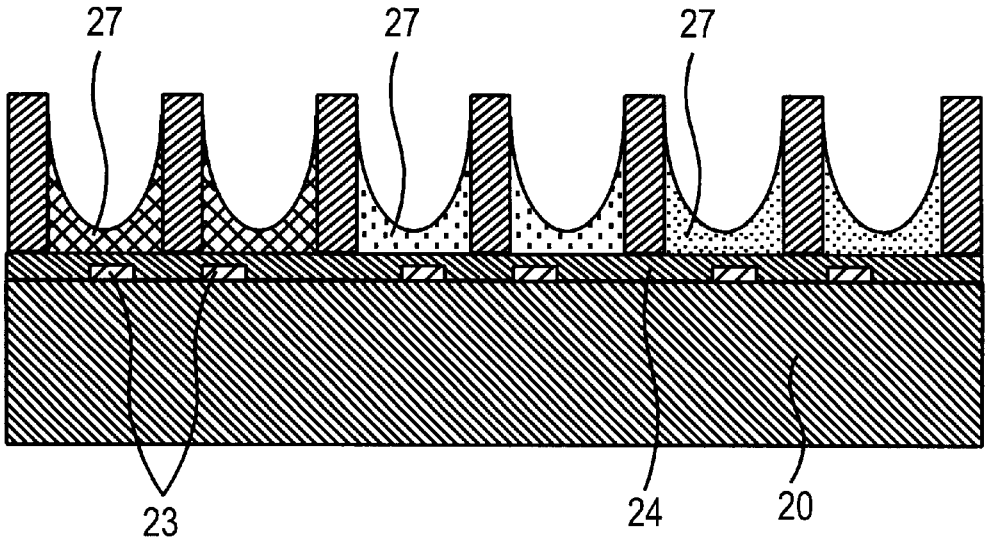
FIG. 37 shows a sectional view of the back panel of a PDP according to a ninth preferred embodiment.

FIG. 37 shows an example of a cross section of the back panel of the PDP of the ninth embodiment. The construction of the front panel is the same as the one illustrated in FIG. 1 of the first embodiment. The distance intervals of the pair of display electrodes are 0.2 mm or wider, and wider than the distance between the neighboring ribs 26. In order to satisfy this condition, in FIG. 37, within one EU, two luminance regions of the same color are disposed. The plasma display apparatus using the PDP of this construction was evaluated regarding the luminance and the emission efficiency. The result is shown in Table 4.

TABLE 4

| Distance | Distance between Ribs 440 micro meter | | Distance between Ribs 220 micrometer | |
|---|---|---|---|---|
| between Display Electrodes | Luminance cd/m$^2$ | Emission Efficiency lm/W | Luminance cd/m$^2$ | Emission Efficiency lm/W |
| 100 | 160 | 0.7 | 140 | 0.7 |
| 200 | 180 | 0.8 | 160 | 0.9 |
| 250 | 190 | 1.0 | 200 | 1.4 |
| 300 | 200 | 1.1 | 220 | 1.6 |
| 400 | 220 | 1.1 | 270 | 1.8 |
| 500 | 250 | 1.4 | 300 | 2.0 |
| 600 | 280 | 1.6 | 320 | 2.1 |

Table 4 shows that the discharge was stabilized and the luminance and the emission efficiency were increased by narrowing the distance between the neighboring ribs against the distance of the display electrodes.

Tenth Preferred Embodiment

Figure 38:
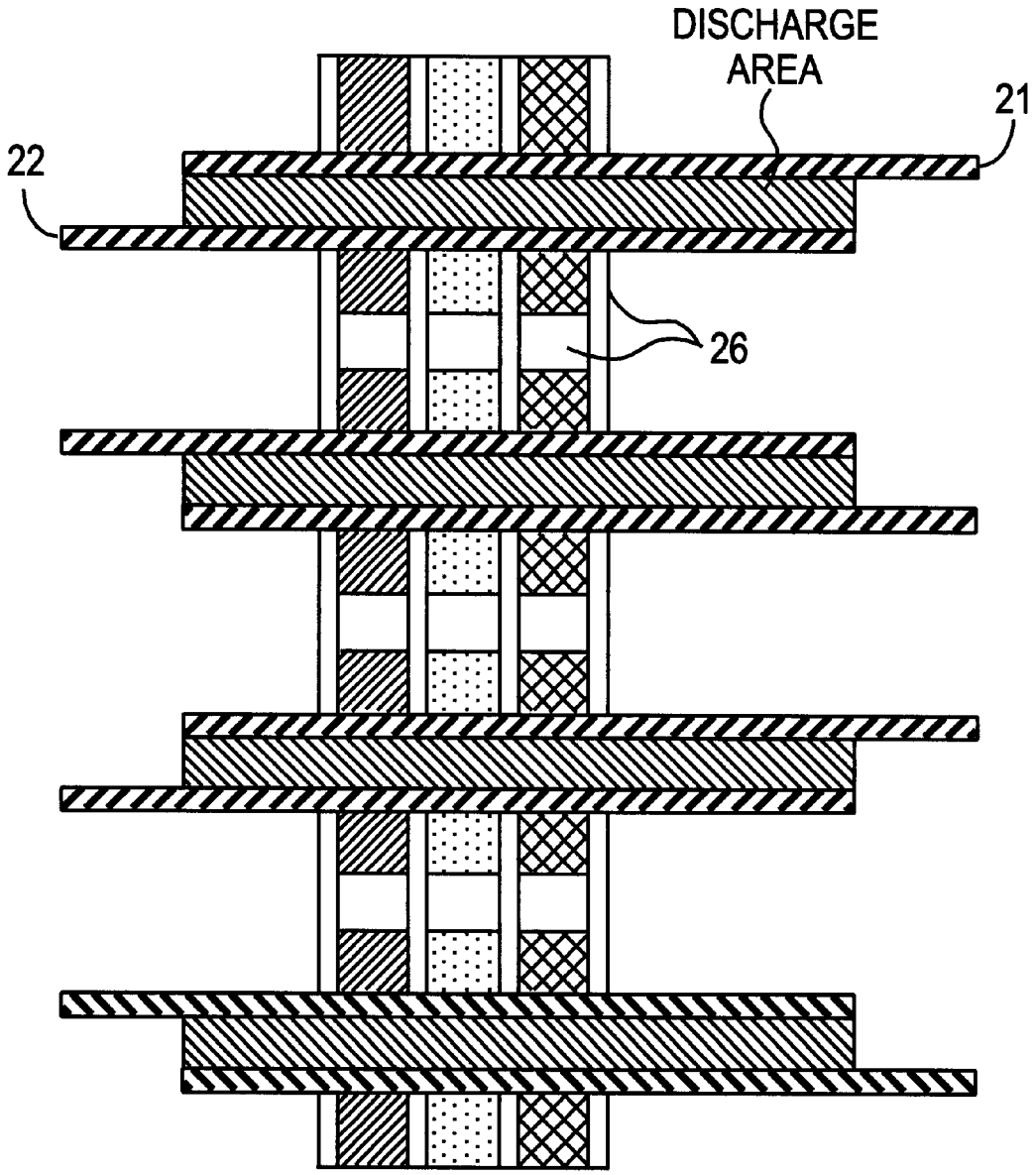
FIG. 38 shows a front view of a PDP according to a tenth preferred embodiment.

FIG. 38 shows a plan view of the PDP of the tenth preferred embodiment. In this embodiment, the display electrodes are 0.2 mm or more, and part of the ribs 26 is formed between the neighboring display electrode pairs. The stability of the discharge was observed by making the whole screen of the display apparatus using the PDP of this embodiment emit light. As a result, the flickering of the discharge and mis-discharge were suppressed by forming part of the ribs between the neighboring display electrode pairs.

Eleventh Preferred Embodiment

In this embodiment, the discharge distance between the electrodes 21 and 22 on the substrate 10 was widened. An inductance 30 is serially connected between the driving circuit of the electrodes 21 and the PDP. The potential of the electrodes 21, 22, and 23 during the period after the termination of the sustain discharge is maintained at the same voltage. This construction allows residual space charge and metastable atoms to be controlled, achieves stable selection of arbitrary pixels, and provides a PDP with high luminance and high picture quality.

The PDP apparatus, the PDP driving circuit and the disposition of the electrodes are the same as that of the foregoing embodiment.

Figure 39:
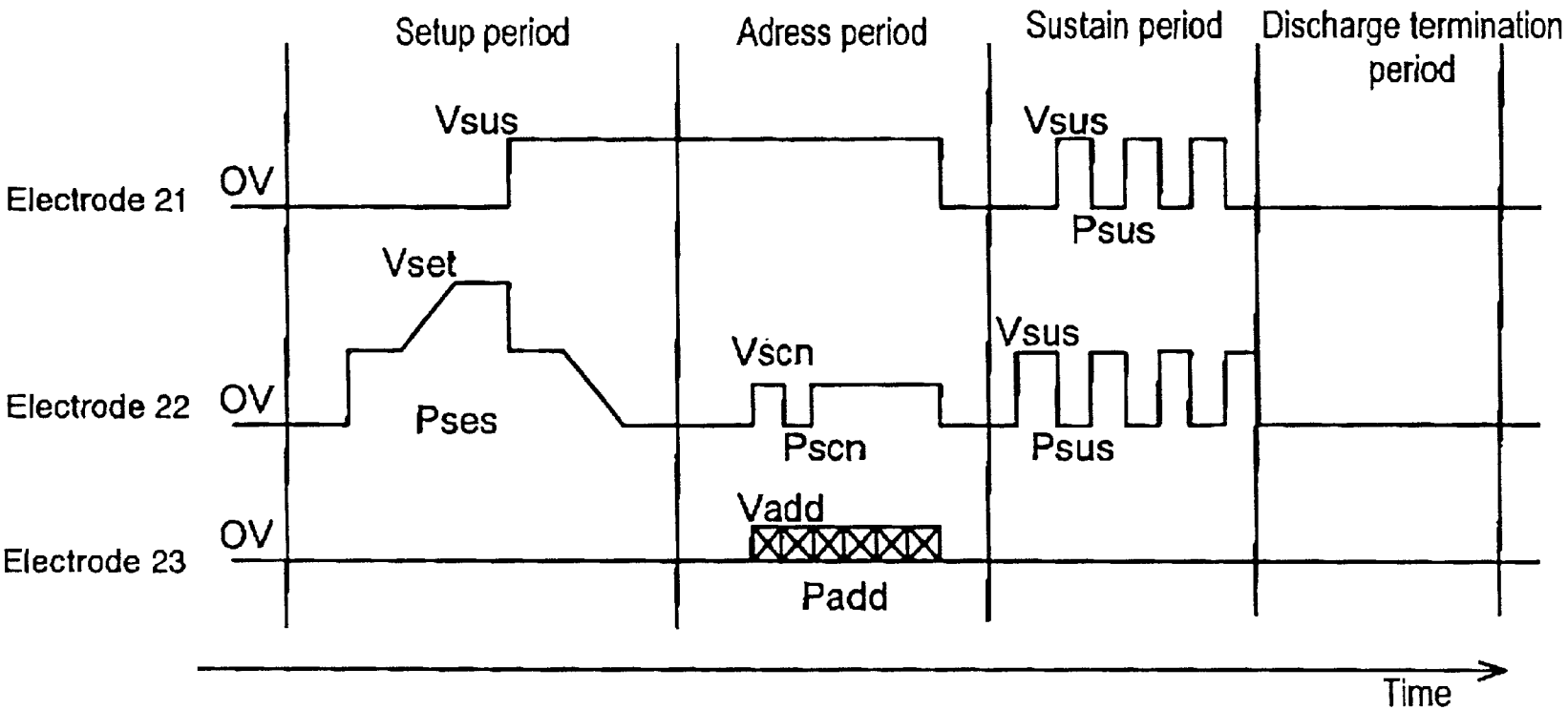
FIG. 39 shows a timing chart of voltage waveforms applied on each electrode of a PDP according to a eleventh preferred embodiment.

FIG. 39 shows applied voltage on each electrodes of this embodiment. In this embodiment, the erase period of the conventional PDP is the designated stopping period. Potential is set so that the electrodes 21, 22 and 23 have the same potential. The potential here is set to 0V. It can be set as sustain voltage Vsu. With this setting, a potential difference between the electrodes 21 and 22, which is generated by the wall charge, residual space charge and metastable atoms occurring during the sustain period, does not exist. Therefore, the discharge space does not exceeds the starting voltage, and discharge does not take place. This discharge stopping period allows the distance between the discharge electrodes of the electrodes 21 and 22, and arbitrary pixels to be selected firmly even when the inductance 30 of the driving circuit for the electrodes 21 is connected in series.

When the positive column discharge is generated by widening the intervals between the electrodes, if the electrodes 21, 22, and 23 are set to the same potential and the fourth electrodes are disposed parallel to the electrodes 21 and 22 and transversely to the electrodes 23 at right angle, the mis-discharge can be prevented. The control of the discharge by the positive column becomes easier as well.

Twelfth Preferred Embodiment

Figure 40:
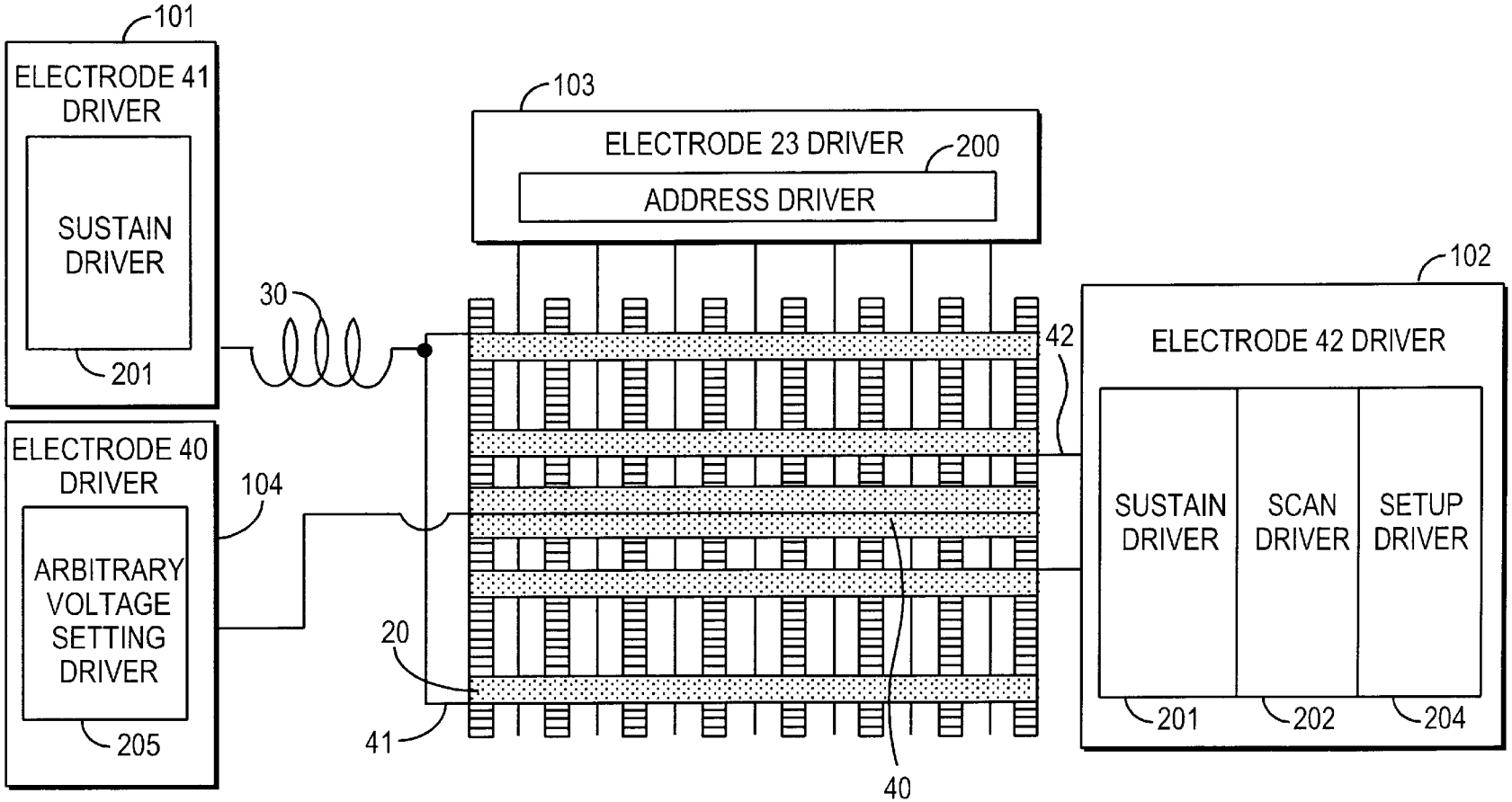
FIG. 40 shows a schematic view illustrating the electrode disposition and a driving circuit according to a twelfth preferred embodiment.
Figure 41:
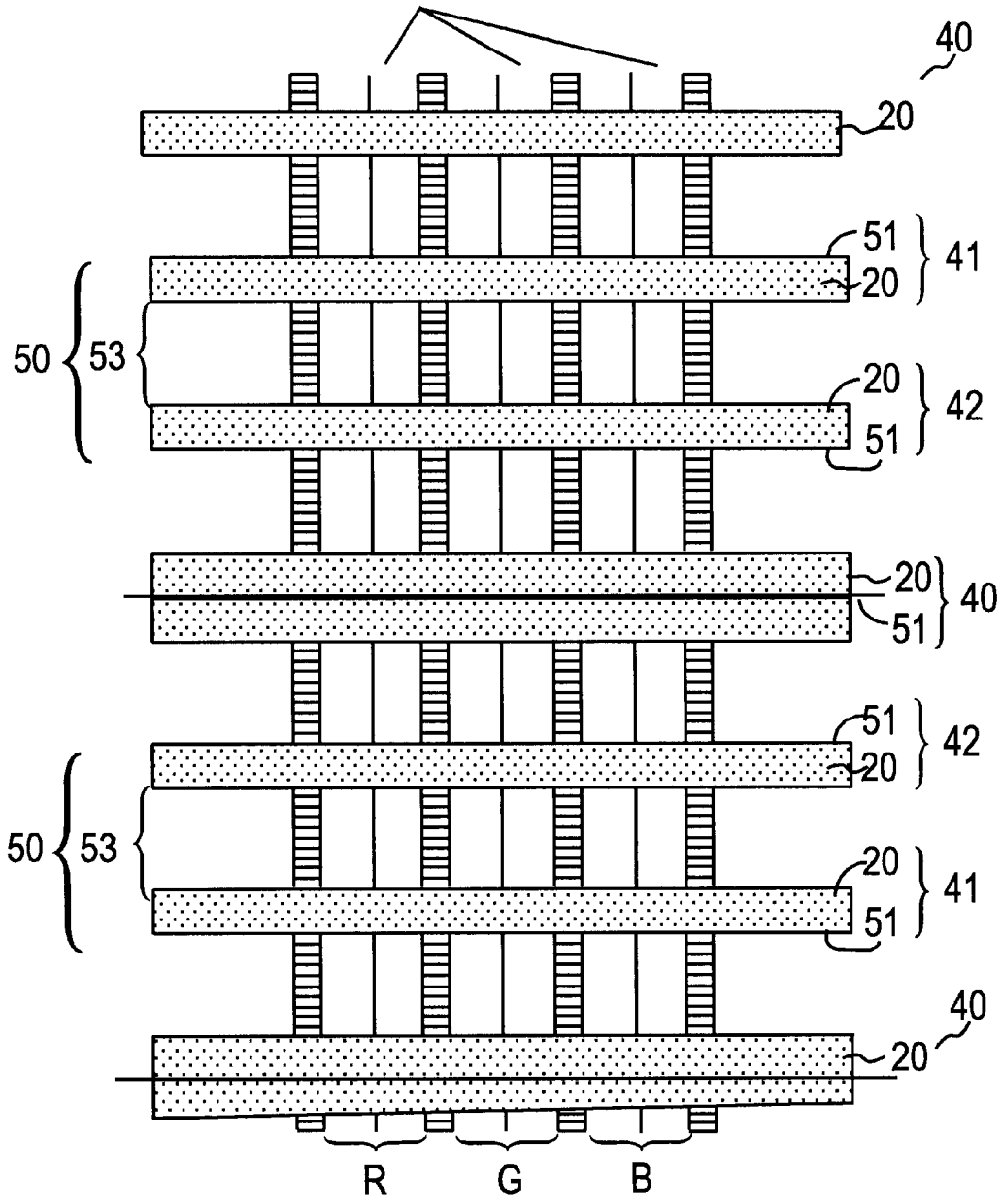
FIG. 41 shows a schematic view illustrating the electrode disposition of the PDP according to the twelfth preferred embodiment.
Figure 42:
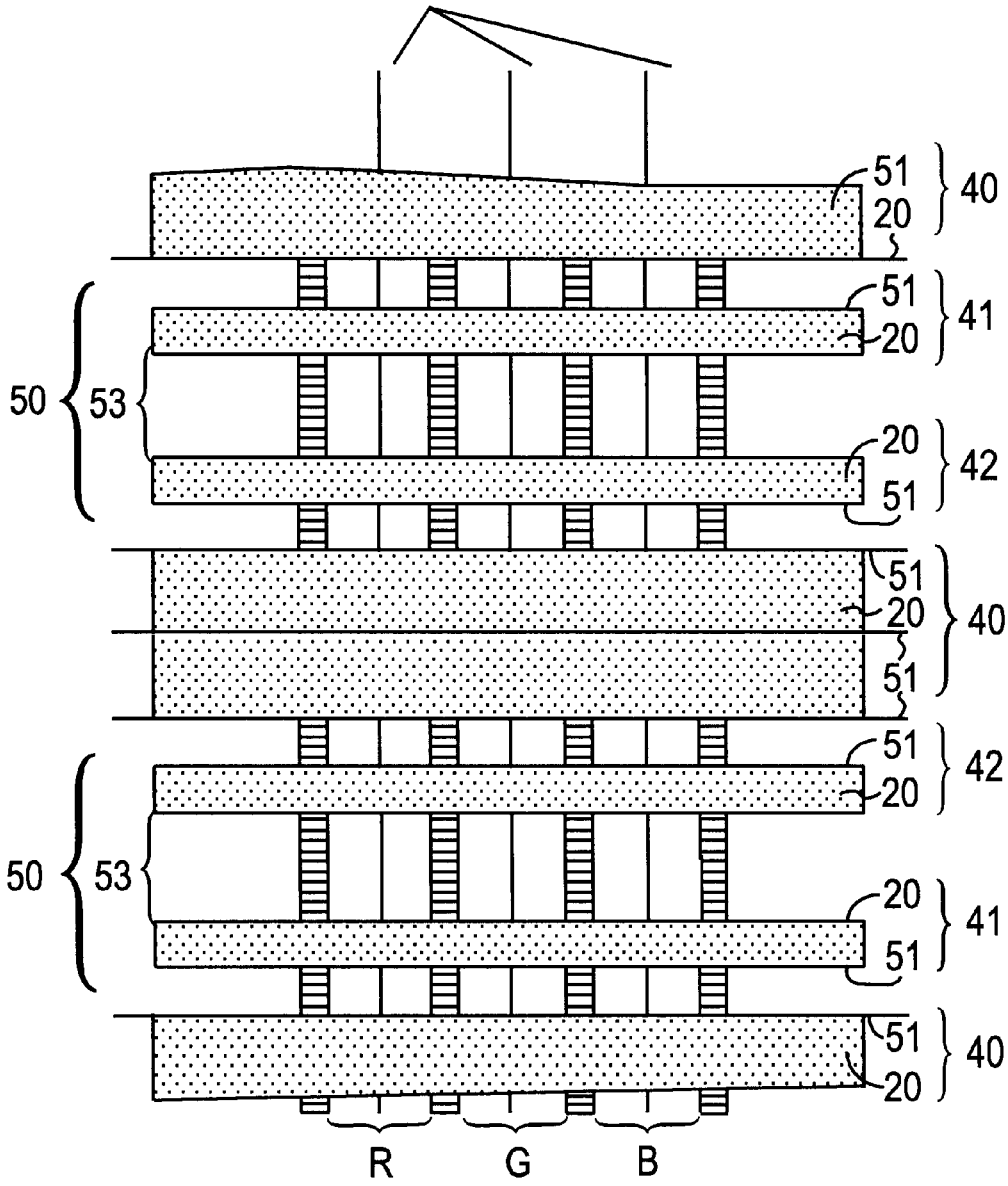
FIG. 42 shows a schematic view illustrating an electrode disposition of the PDP in which the space between forth electrodes is widened according to the twelfth preferred embodiment.
Figure 43:
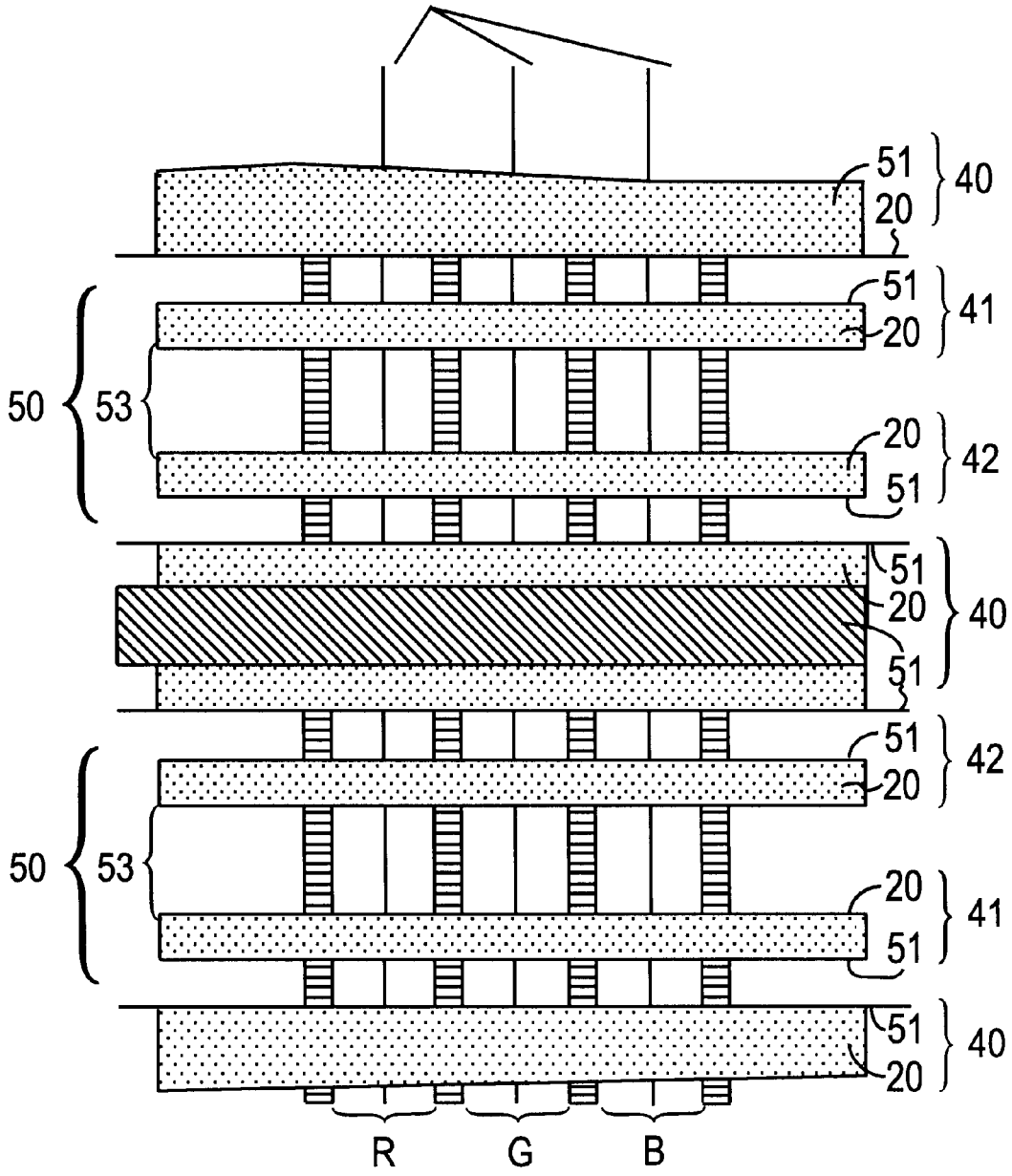
FIG. 43 shows a schematic view illustrating the electrode disposition of the PDP according to the twelfth preferred embodiment.

FIG. 40 shows a schematic view illustrating the electrode disposition of a driving circuit and a PDP of this embodiment. Of the space between the electrodes 41 and 42 on the substrate 10, an electrode 40 is disposed in the non-discharge space. In this embodiment, the electrode 40 are made of the same material as that of the electrodes 41 and 42. However, it is not limited to this. A distance between discharge electrodes 53 (FIG. 41) is wider than that of the conventional PDP. The emitted light is less obstructed. Therefore, even when the electrodes 41, 42 and 40 can be composed of transparent electrodes 20 and metallic bus electrodes 51, or just the metallic bus electrodes. FIGS. 41, 42, and 43 show the disposition examples of the electrodes 40. In FIG. 41, one electrode 40 is disposed in a non-discharge region 61, and the transparent electrodes 20 and the metallic bus electrodes 51 compose the disposition.

In this embodiment, by disposing the electrodes 40, space charge and metastable atoms which diffuse vertically are accumulated during the sustain period, thereby preventing the mis-discharge. During the discharge stopping period, residual space charge and metastable atoms remaining in the discharge space are accumulated, enabling sustain discharge which is firmly according with the address discharge. Furthermore, by connecting the electrodes 40 to predetermined voltage by arbitrary potential setting driver 205 illustrated in FIG. 40., vertical diffusion can be prevented, and effect of inhibiting the space charge and metastable atoms from remaining in the discharge space can be improved.

In FIG. 42, the width of the electrodes 40 is different from that of the electrodes 41 and 42. Since the electrodes 40 are closer to the electrodes 41 and 42, the accumulation of the space residual charge and metastable atoms is easier, thereby improving the effect of preventing vertical diffusion and function to stop discharge. However, when the width of the transparent electrodes 20 is expanded, and the metallic bus electrodes 51 are disposed only in the center, resistance between the electrodes 41 or 42 and the electrodes 40 becomes intensified. To prevent this, the metallic bus electrodes are disposed on both sides and the center. By this disposition the resistance between the electrodes 41 or 42 and the electrodes 40 is lowered, further improving the effect of preventing vertical diffusion and function to stop discharge. As FIG. 43 illustrates, adjustment of the resistance of the electrode 40 becomes possible by expanding the width of the metallic bus electrode 51 which is disposed in the center of the transparent electrode 20.

Waveforms of the applied voltage on each of the electrodes except for the electrodes 40 are the same as those of the eleventh embodiment. During all of the periods, the waveforms of the applied voltage of the electrodes 40 are connected to 0V. This allows the electrodes 40 to help prevent the vertical diffusion of the residual space charge and metastable atoms and stop discharge, thereby suppressing the mis-discharge during all setup, address, sustain and discharge stopping periods. During the setup period, since all the pixels discharge, the electrodes 40 are separated from the fourth electrode driver in FIG. 40 to increase their impedance. This means there are floating electrodes near the electrodes 41 and 42. Therefore, voltage for setup discharge between the electrodes 41 and 42 can be lowered. During the address period, by separating the electrodes 40 from the fourth electrode driver by synchronizing them with the scan pulses Psc, voltage of address discharge can be decreased. Similarly, during the sustain period the voltage for sustain discharge can be lowered by separating the electrodes 40 from the driving circuit. However, this increases vertical diffusion of the space charge. Therefore, the electrodes 40 are separated from the driving circuit when the sustain pulses Psu are initially applied, and the sustain discharge is generated completely. From the second application of the sustain pulses Psu onwards, the electrodes 40 are connected to 0V to prevent vertical diffusion.

Figure 44:
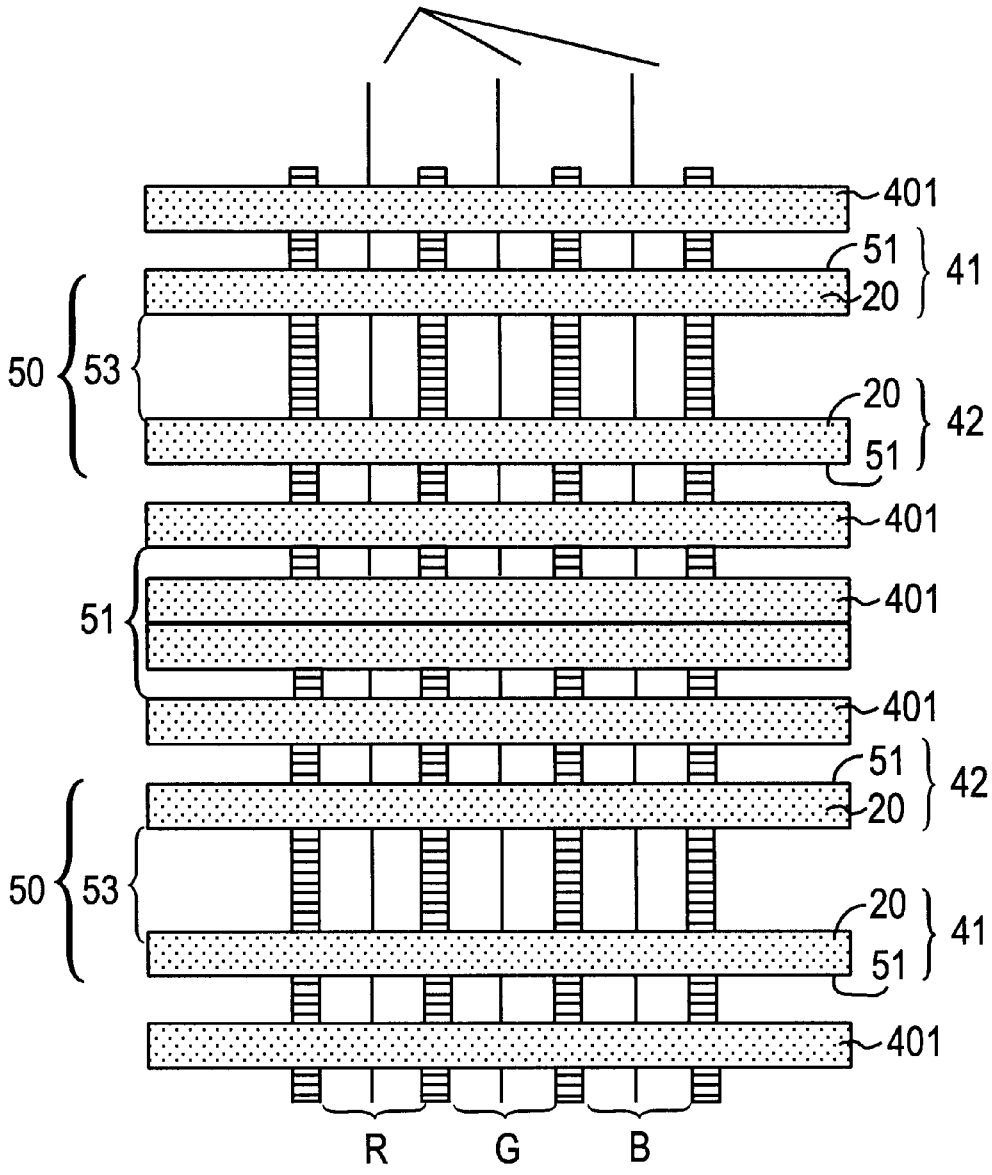
FIG. 44 shows a schematic view illustrating an electrode disposition of a PDP in which a plurality of fourth electrodes are disposed according to a thirteenth preferred embodiment.

FIG. 44 shows an electrode disposition of the PDP when three electrodes 401 are disposed. In FIG. 44, the electrodes 40 on the electrodes 40 and 42 side are separated from the electrode 401 driver during the address and sustain periods and each of the discharge voltages are reduced. In order to prevent vertical diffusion of the space residual charge and metastable atoms, the electrode 40 in the center is connected to 0V constantly. During the discharge stopping period, all the fourth electrodes 40 are connected to 0V to improve discharge stopping function and suppress mis-discharge.

Thirteenth Preferred Embodiment

Figure 45:
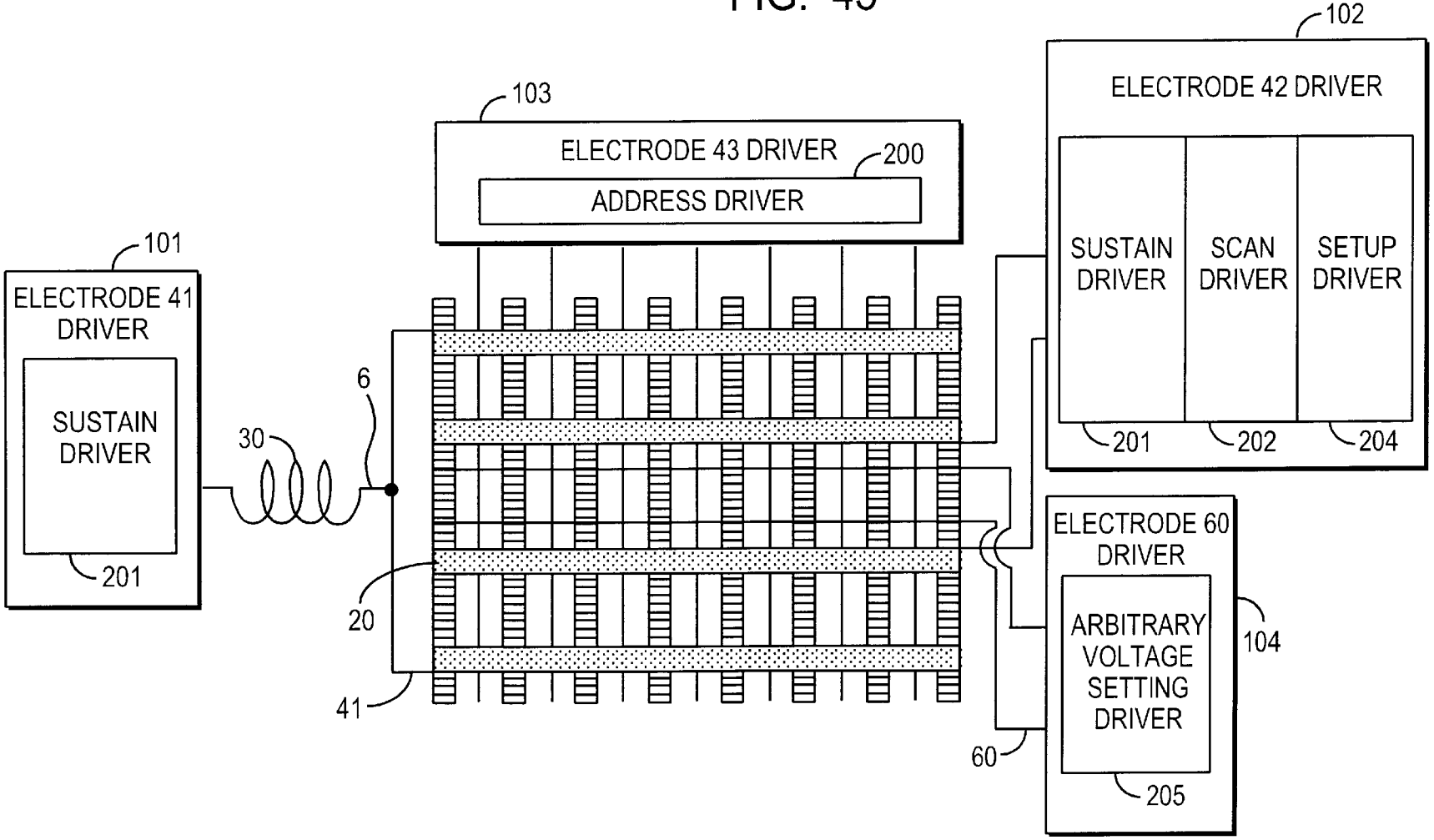
FIG. 45 shows a schematic view illustrating a driving circuit and electrode disposition of a PDP according to the thirteenth preferred embodiment.

FIG. 45 shows the electrical disposition of the plasma display device and PDP of this embodiment. In this embodiment, two electrodes 60 are disposed. Providing the plurality of electrodes 60 allows separate control of the electrodes 60 on the electrodes 41 side and the electrodes 42 side. Thus, the electrodes 60 can function as priming discharge electrodes between the electrodes 41 and 42.

When equalizing the distance of the discharge electrode 53 between electrodes 41 and electrode 60 and that between electrode 42 and the electrodes 60 to that of the conventional PDP, adopting the electrode disposition shown in FIG. 44, the discharge caused by the trigger pulses starts at around 400V. By using this discharge to prime the setup discharge occurring between the electrodes 41 and 42, the setup discharge voltage can be lowered.

Figure 46:
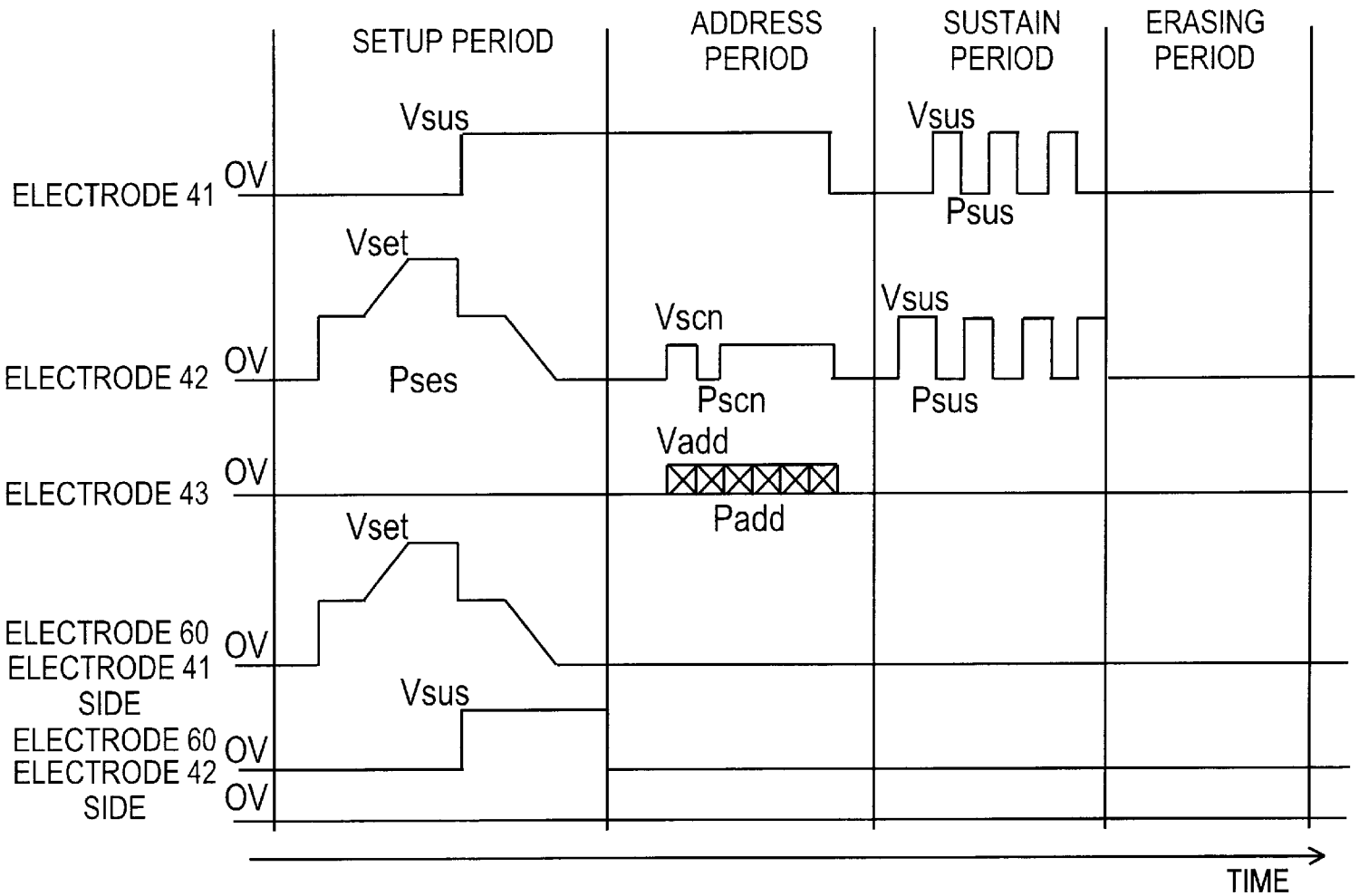
FIG. 46 shows a timing chart illustrating voltage waveforms applied on each electrode of the PDP in which the fourth electrode is independently driven according to the thirteenth preferred embodiment.
Figure 47:
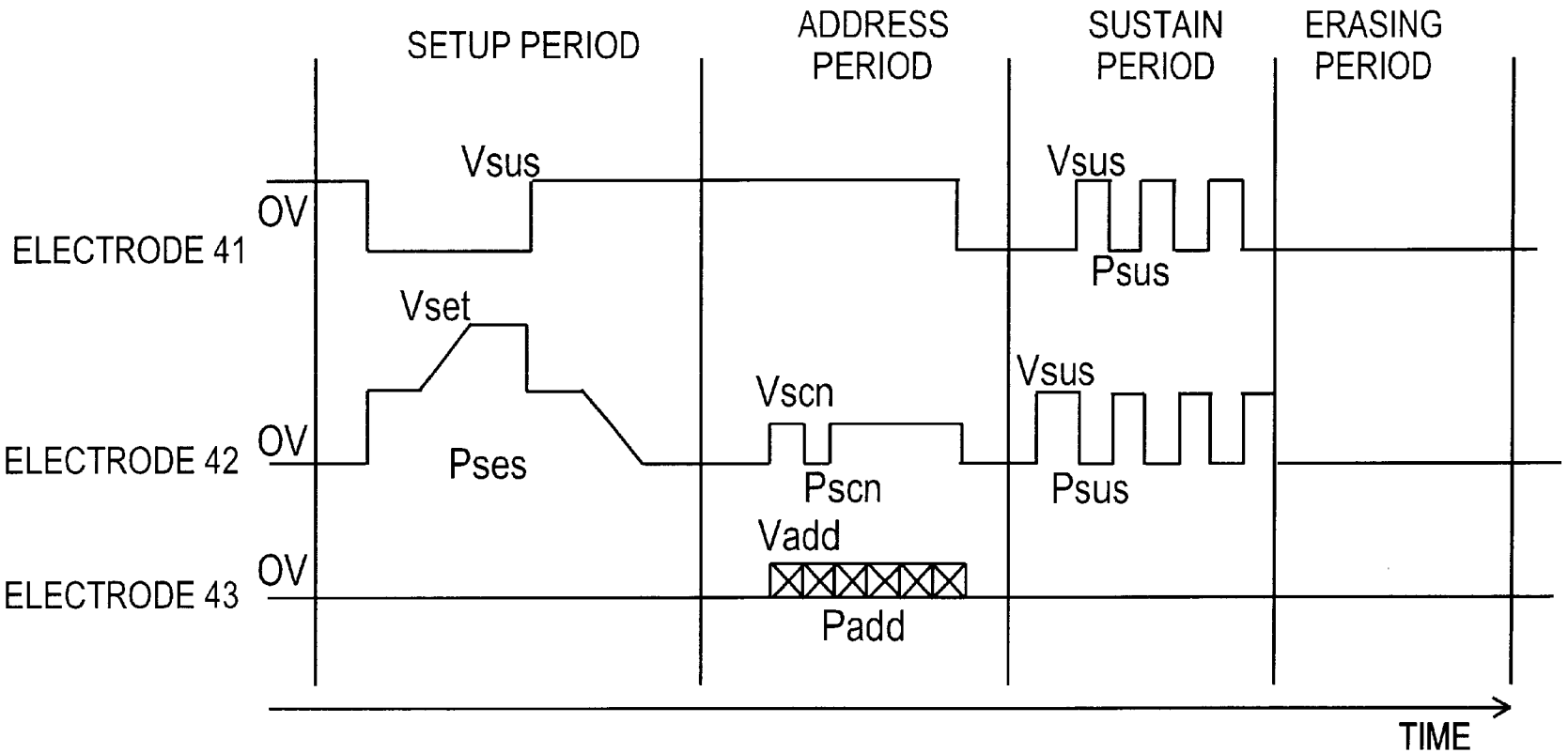
FIG. 47 shows a timing chart illustrating voltage waveforms applied on each electrode of a conventional PDP.

As FIG. 46 shows, driving the electrodes 60 on the electrodes 41 and 42 sides independently allows the setup discharge to occur not only between the electrodes 41 and 42 but between the electrodes 41 and 60 as well as the electrodes 42 and 60. In this case, the voltage waveforms of the electrodes 41 and 42 are applied respectively on the fourth electrode 60 on the electrodes 42 and 41 sides. By these applications, positive wall charge accumulates on the electrodes 41, whereas negative wall charge accumulates on the electrodes 42 said like the same waveform applied to respective electrodes as shown in FIG. 47. Due to this, address discharge voltage is lowered during the address period.

The electrode 60 disposed in the center of the non-discharge region is connected to 0V. This connection prevents vertical diffusion of the residual space charge and metastable atoms and promotes the discharge stopping after the termination of the sustain discharge, thereby suppressing mis-discharge.

Fourteenth Preferred Embodiment

Figure 48:
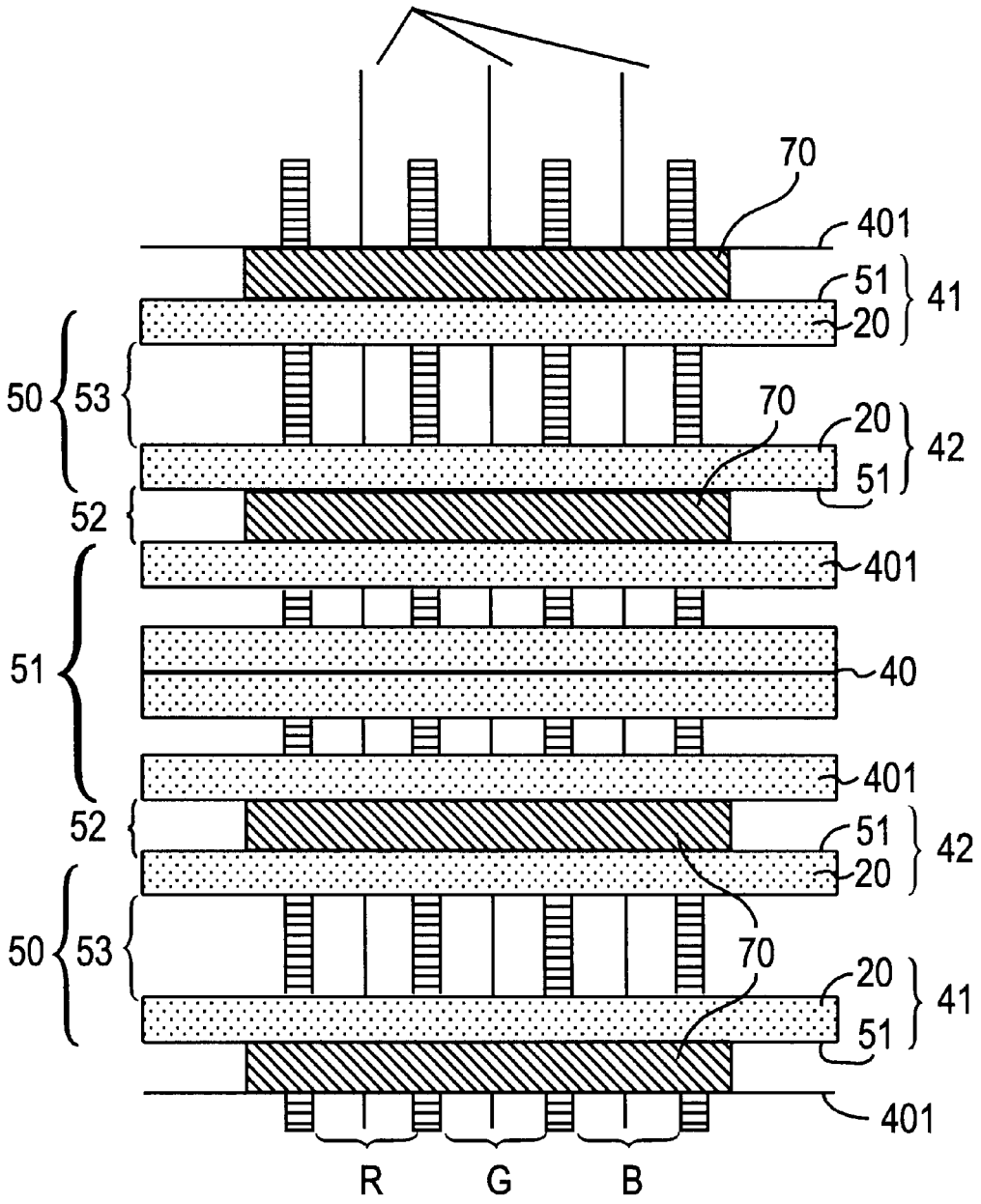
FIG. 48 shows a schematic view illustrating electrode disposition of a PDP in which a light stopping material is used according to a fourteenth preferred embodiment.
Figure 49:
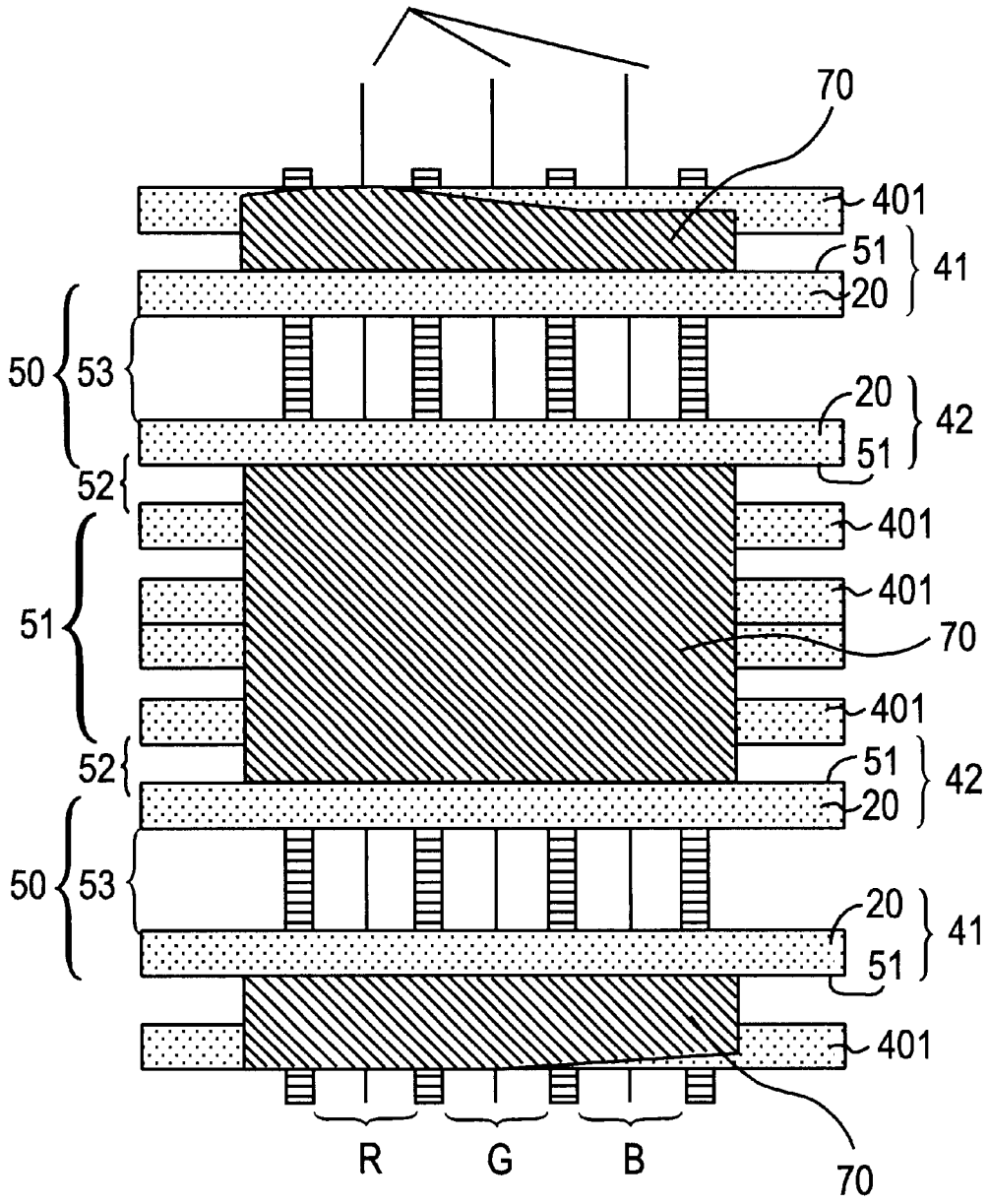
FIG. 49 shows a schematic view illustrating electrode disposition of the PDP in which a light stopping material is used to cover the whole non-discharge region according to the fourteenth preferred embodiment.

FIG. 48 shows the electrode disposition of the PDP of this embodiment. The driving method of this embodiment is identical to that of the thirteenth embodiment. As described in the thirteenth embodiment, when the electrodes 401 are used as setup discharge electrodes, a light-disturbing material 70 is provided between the electrodes 41 and 40 as well as the electrodes 42 and 401. This arrangement prevents the light of the setup discharge emitted at each sub-field from being output to the outside, thus improving the contrast ratio without relying on the condition of the pixels. As FIG. 49, the light-disturbing material 70 is disposed between the electrodes 41 and 42, covering the non-discharge region. This prevents the light emitted by the setup discharge from being output from the first substrates 10. Moreover, in the non-discharge region, reflection of the external light can be controlled, improving the contrast ratio.

Fifteenth Preferred Embodiment

In this embodiment, sustain pulses Psu are applied on the electrodes 23 disposed on the glass substrate in the back, thereby generating the surface discharge near the glass substrate 10 in the front and the transverse discharge between the glass substrates 10 and 20 disposed respectively in the front and back. In other words, the phosphor in the whole pixel is lit up.

Figure 50B:
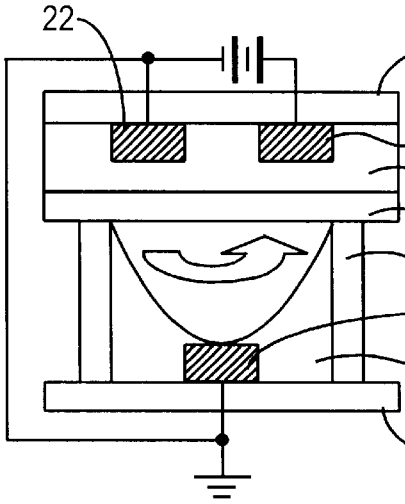
FIGS. 50A–50D show a schematic view of a sustain discharge in a three-electrode surface discharge AC-driven PDP.
Figure 50A:
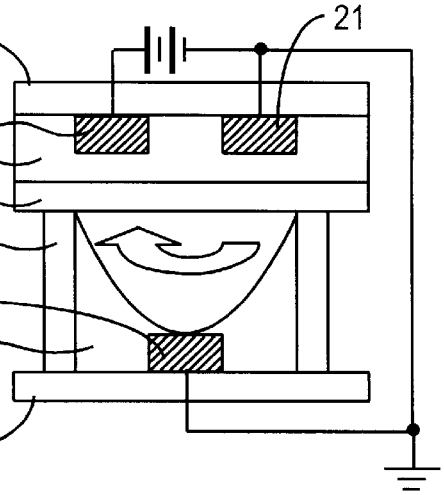
Figure 50D:
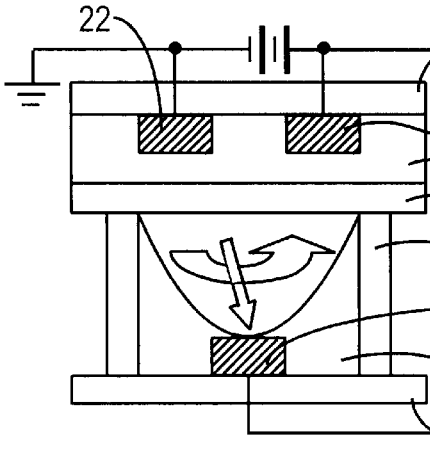

FIGS. 50A and B shows the routes of the sustain discharge of the prior art. As is clearly illustrated, the sustain discharge is occurring around the glass substrate 10. Distribution of the ultraviolet rays is considered to concentrate in and around the glass substrate 10. Therefore, the brightest luminance can be observed around the ribs 26, which are close to the substrate 10.

Figure 50C:
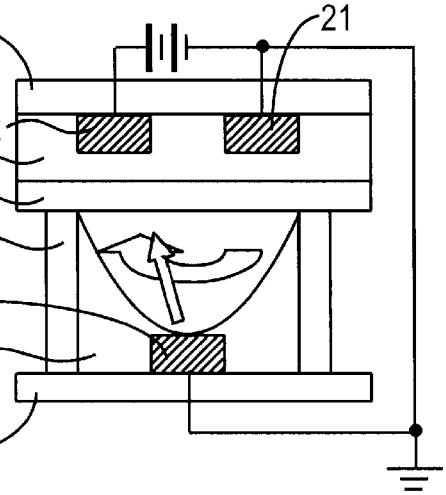

To deal with this, as FIGS. 50C and D show, part of the discharge near the substrate 10 was moved to the vicinity of the substrate 20. As a result, the phosphor near the substrate 20 receives more UV rays than the conventional method would provide, getting more excited and emitting light. However, when strong discharge occurs near the phosphor 27, it is degraded. To solve this problem, in this embodiment, a strong discharge is generated near the substrate 10, and a weak discharge is generated between the substrates 10 and 20.

Lowering concentration of the discharge current improves the emission efficiency of the PDP. In this embodiment, in addition to the sustain discharge near the substrate 10, the sustain discharge between the substrates 10 and 20 is generated. Therefore, the electrodes area which contributes to the sustain discharge increases, reducing the concentration of the discharge current without decreasing the current of the whole PDP. This increases the emission efficiency. If the concentration of the discharge current is simply reduced without modifying the construction of the PDP, the luminance brightness is lowered. However, in the case of this embodiment, the amount of light emitted near the substrate 20 is increased, so that the luminance brightness can be raised.

Figure 51:
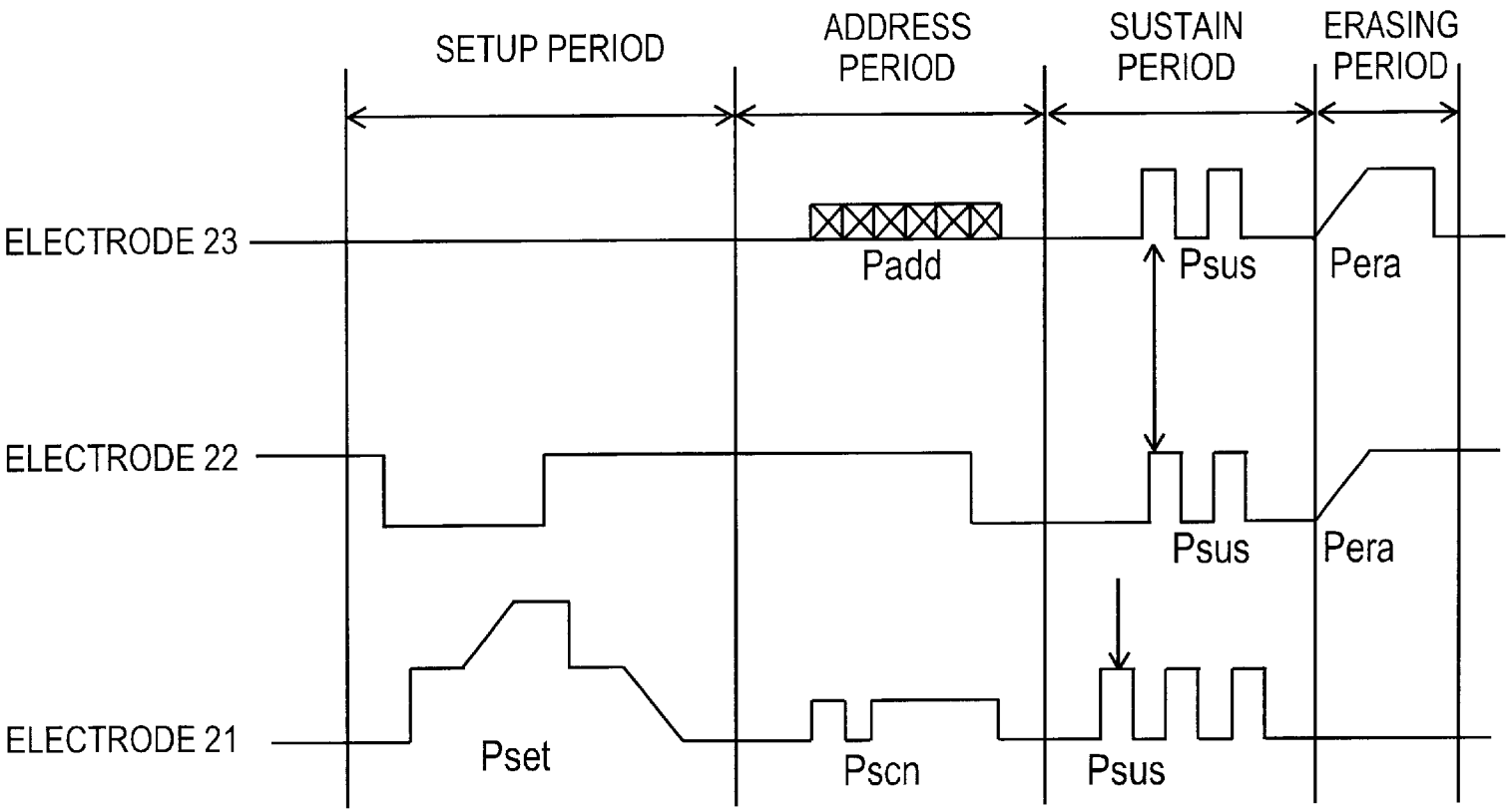
FIG. 51 shows a timing chart of pulse application on each electrode according to a fifteenth preferred embodiment.

The following is the description regarding how to drive the plasma display device of this embodiment. FIG. 51 shows the timing chart of the applied pulses on each of the electrodes used in the present invention. FIG. 51 shows waveforms of the applied pulses on one sub-field. The applied pulses are composed of four stages; the setup period, the address period, the sustain period and the erase period.

The setup period is for easing the generation of the address discharge which occurs during the address period, or the second stage. During the setup period, voltage of approximately 400V is applied on the electrodes 21. This application leads to accumulation of negative charge on the electrodes 21 and the positive charge on the electrodes 22 and 23. The wall charge accumulating here does not produce discharge only with the voltage of the sustain pulses Psu applied during the sustain period or the third stage.

During the address period, the wall charge accumulated during the setup period is utilized to generate discharge. The electrodes 23, 21 and 22 are applied with voltage of 80V, 0V and 200V respectively to generate discharge between the electrodes 23 and 21. This generates a discharge between electrode 23 and electrode 21. Thus, positive charge is accumulated on the electrodes 21 while negative charge accumulates on the electrodes 22 and 23. The electrodes 21 and 22 have more wall charge accumulated thereon than the amount of the wall charge accumulated during the setup period.

In the following third stage, the wall charge accumulated in the second stage is utilized to bring about the sustain discharge. The sustain pulses Psu start from the electrodes 21. Thus, positive charge is needed on the electrodes 21 and negative charge is needed on the electrodes 22 and 23. This charge is accumulated in the pixels where the address discharge was generated in the second stage. The initial sustain pulses Psu are applied only on the electrodes 21. Discharge occurs between the electrodes 22 and 21, as is the case with the conventional method. However, the following sustain pulses are applied on the electrodes 23 and 22, leading to discharge between the electrodes 22 and 21 as well as the electrodes 23 and 21. Thus, the discharge spreads throughout the pixels, allowing the phosphor near the substrate 20 to be excited by the UV rays more strongly than it would be by the conventional method.

The following sustain pulses are applied only on the electrodes 21. With the conventional driving method, the electrodes 23 are not applied with the sustain pulses, thus the electrodes 23 do not contribute to discharge. However, as is the case with this embodiment, when the sustain pulses synchronizing with the electrodes 22 are applied on the electrodes 23, discharge from the electrodes 23 occurs even when discharge of the sustain pulses occurs only on the electrodes 21.

Since the places where discharge occurs increase in number, the concentration of the discharge current of each electrode is reduced, contributing to increasing in the emission efficiency. Once the electrodes 23 start the sustain discharge, the discharge current from the electrodes 21 flow to the electrodes 23. Therefore, the discharge from the electrodes 21 spreads throughout the pixels, increasing the phosphor 28, which are excited by the UV rays, and lowering the concentration of the discharge current of each electrode.

At this moment, condition of the accumulation of charge on each electrode disposed on the pixels where the address discharge is not occurring is the same as that of the setup period, the first stage. Therefore, application voltage of the sustain pulses Psu of the third stage does not initiate the sustain discharge.

Figure 52A:
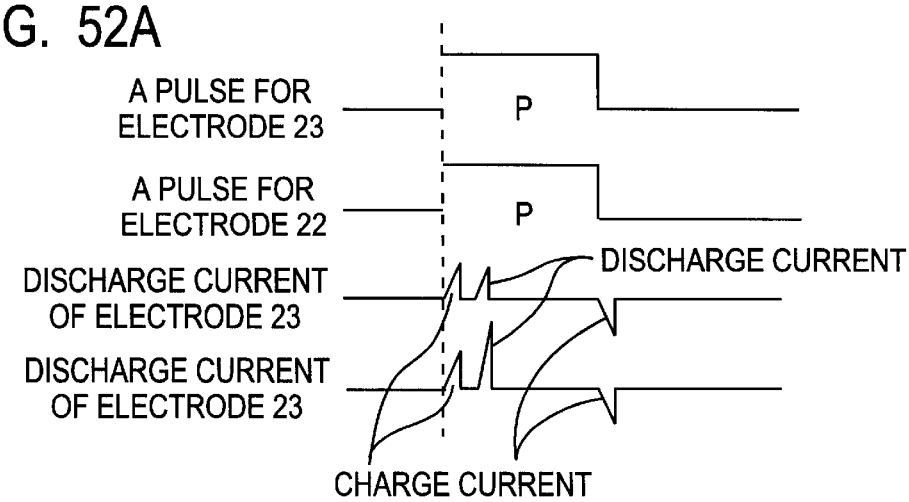
FIGS. 52A–52C show a timing chart of sustain pulses.
Figure 52B:
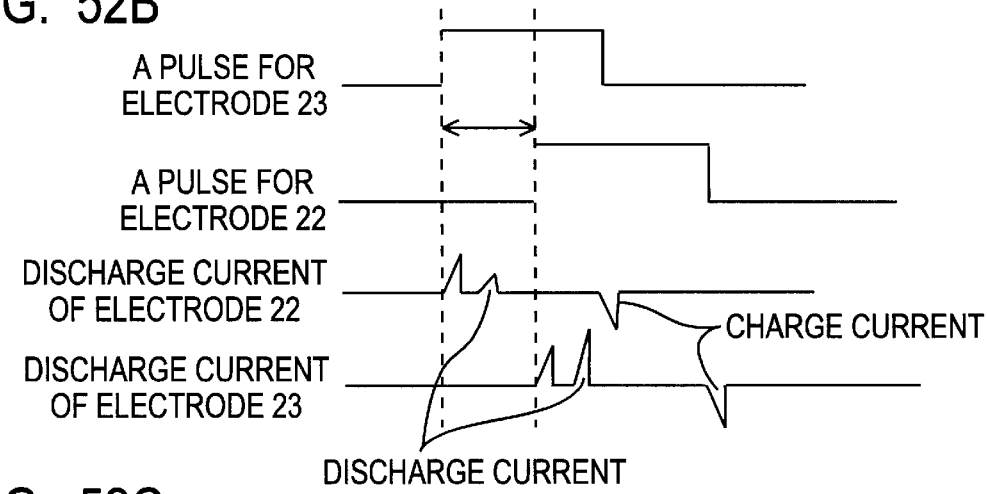
Figure 52C:
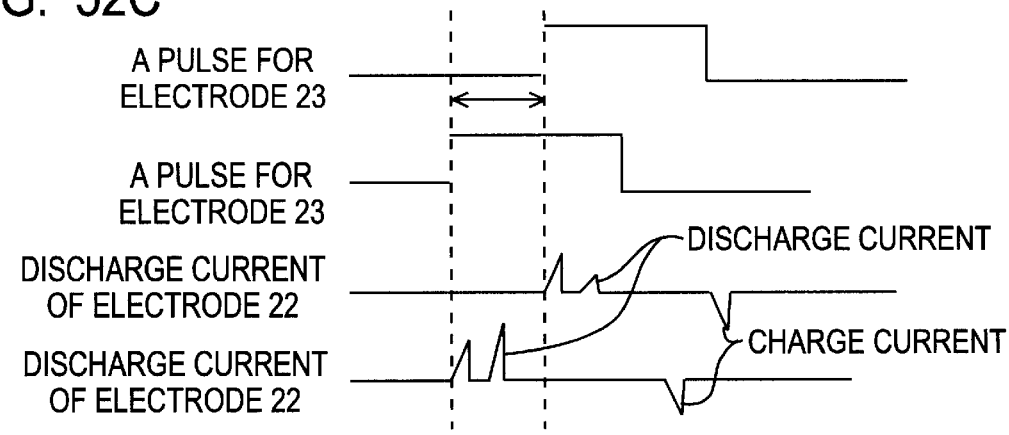

The application timing of the sustain pulses on the electrodes 23 is described below. FIGS. 52A–52C show the sustain pulses and the discharge current applied on the electrodes 23 and 22. FIG. 52A shows the case when the timing of application on the electrodes 23 and 22 coincides. FIG. 52B shows the case when the sustain pulses applied on the electrodes 23 are 1 $\mu$sec or more ahead. FIG. 52C shows the case when the sustain pulses applied on the electrodes 23 are 1 μsec or more behind. When the application timing of the sustain pulses coincides as in the case of FIG. 52A, the discharge current from the address and sustain electrodes flows adequately, enhancing the luminance of the screen and emission efficiency. On the contrary, with the discharge of the application timings of the sustain pulses in FIGS. 52B and 52C, the discharge current from the electrodes 23 decreases as the time gap in starting of the sustain pulse application on the electrodes 22 and 23 is widened. As a result the luminance of the screen and the emission efficiency are reduced to the level of the conventional method. Thus, sustain pulses must be applied on the electrodes 23 within 1 μsec after the sustain pulses are applied on the electrodes 22.

Voltage of the sustain pulses to be applied can be set at any value. Thus, the sustain pulses to be applied on the electrodes 23 can also be applied on the electrodes 22 as they are. A new driving circuit is not necessary. By changing the width of pulses, strength of the sustain discharge from the address electrode can be adjusted.

The fourth stage is the erase period. During this period condition of the wall charge in the pixels where the sustain discharge occurred and did not occur, is made the same. The electrodes 22 are 0V. The address-and-sustain electrodes 22 and the electrodes 23 are applied with pulses which start up moderately. By this arrangement, the wall charge in all of the pixels is neutralized.

As has been described, by generating the surface discharge on the substrate 10 and the transverse discharge between the substrates 10 and 20, area of the excited phosphor increases, enhancing the luminance of the screen of the plasma display panel. Further, since the electrodes 23 are added as electrodes for sustain discharge, area of the electrodes increases, improving the emission efficiency.

Sixteenth Preferred Embodiment

In this embodiment the sustain discharge is generated by four electrodes so that the discharge occurs evenly in the pixels.

Figure 53:
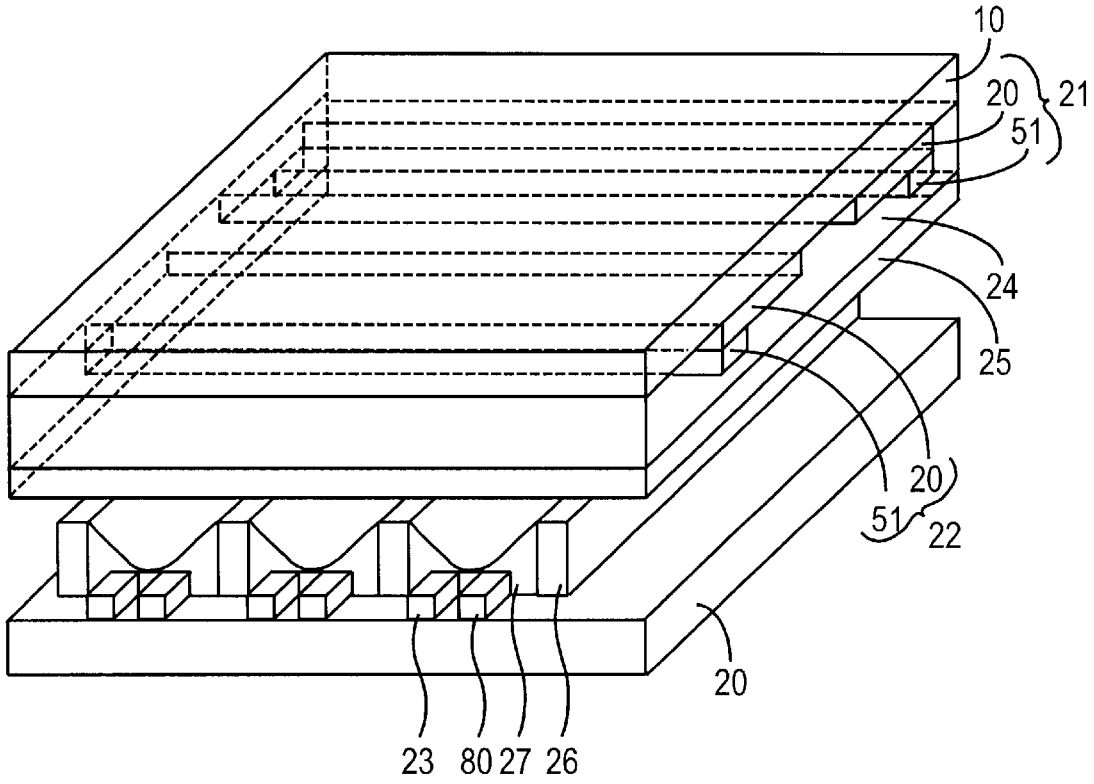
FIG. 53 shows a perspective view of a four-electrode AC-driven PDP.
Figure 54B:
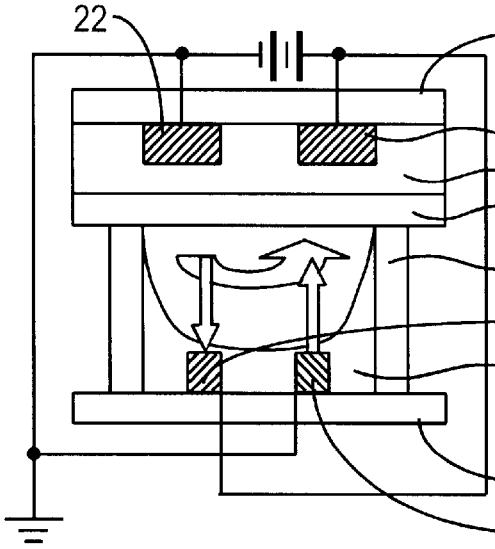
FIGS. 54A–54B show a schematic view of sustain discharge of a four-electrode AC-driven PDP.
Figure 54A:
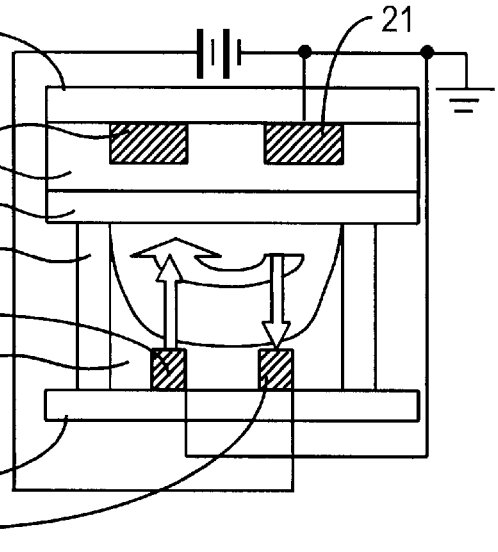

FIG. 53 shows a perspective view of the PDP which has four electrodes. Sustain discharge support electrodes 80 for supporting the sustain discharge, are disposed in parallel with the electrodes 23 on the substrate 20. The sustain discharge support electrodes 80 are applied with the sustain pulses Psu to generate discharge near the substrate 10 and the discharge between the substrates 10 and 20 simultaneously. As FIGS. 54 A–54 D show, the support electrodes 80 are applied with the pulses synchronized with the sustain pulses Psu so that discharge takes place from the substrate 20 as well.

This allows the UV rays generated by the discharge from the electrodes 21 to spread more evenly throughout the pixels than it was the case with the fifteenth embodiment. The concentration of the discharge current lowers as well. Therefore, further improvement of the emission efficiency becomes possible.

Figure 55:
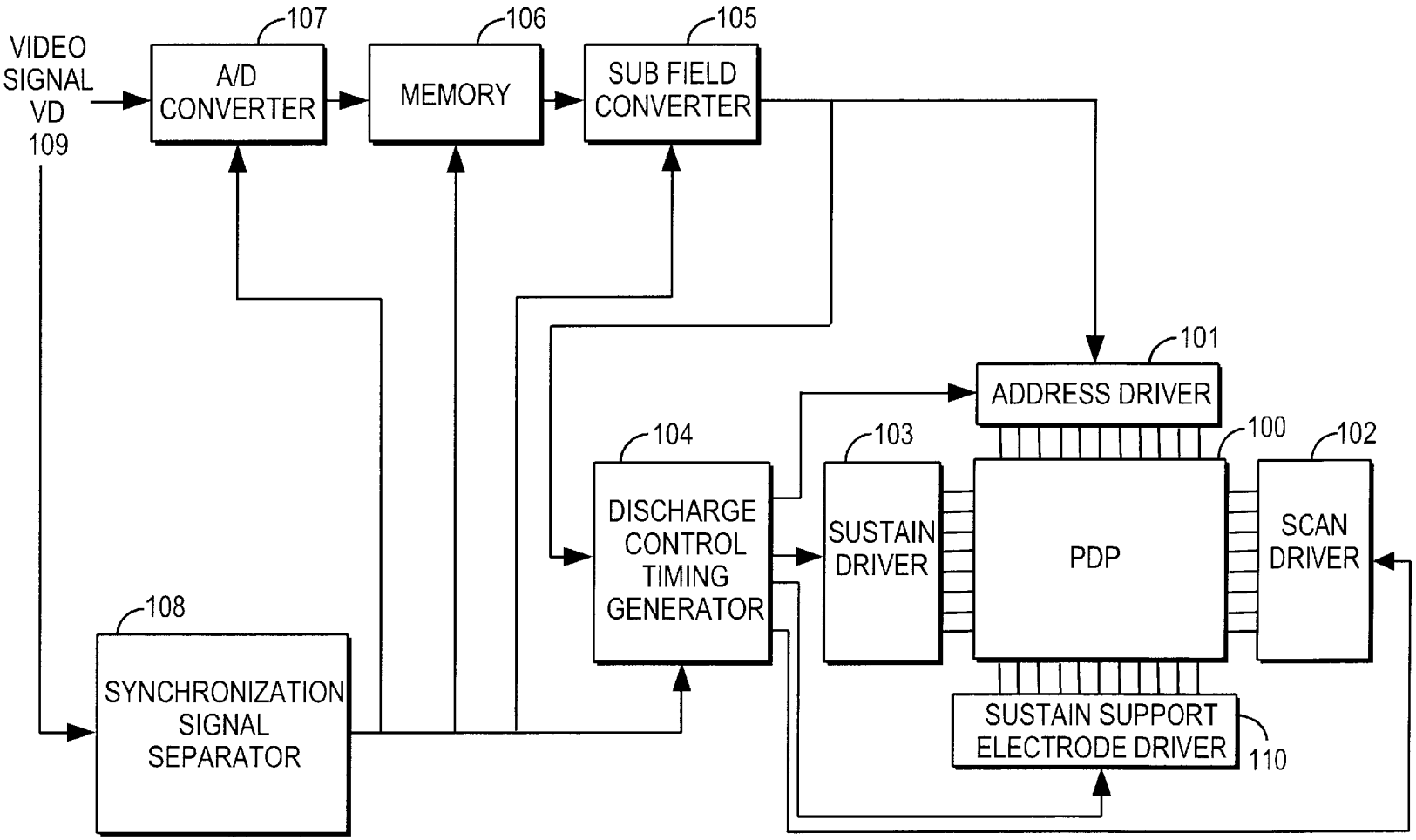
FIG. 55 shows a block diagram illustrating the construction of a PDP apparatus according to a sixteenth preferred embodiment.

FIG. 55 is a block diagram showing the construction of the PDP apparatus of the sixteenth preferred embodiment of the present invention. In the PDP apparatus of this embodiment, based on the PDP apparatus of the first embodiment, other electrodes are disposed vertically against the PDP. A driver for these electrodes (sustain discharge support electrode driver 110) is placed in the bottom of the panel. This driver 110 can be incorporated into an address electrode driver 101. The functions apart from the driver 110 have been already described.

The driver 110 includes a sustain driver 201 and an erasing driver 203. During the sustain period, the sustain pulses synchronized with the scan electrode driver 102 are output. During the erase period, erasing pulses Pe synchronized with the electrodes 23 and 22 are output.

Figure 56:
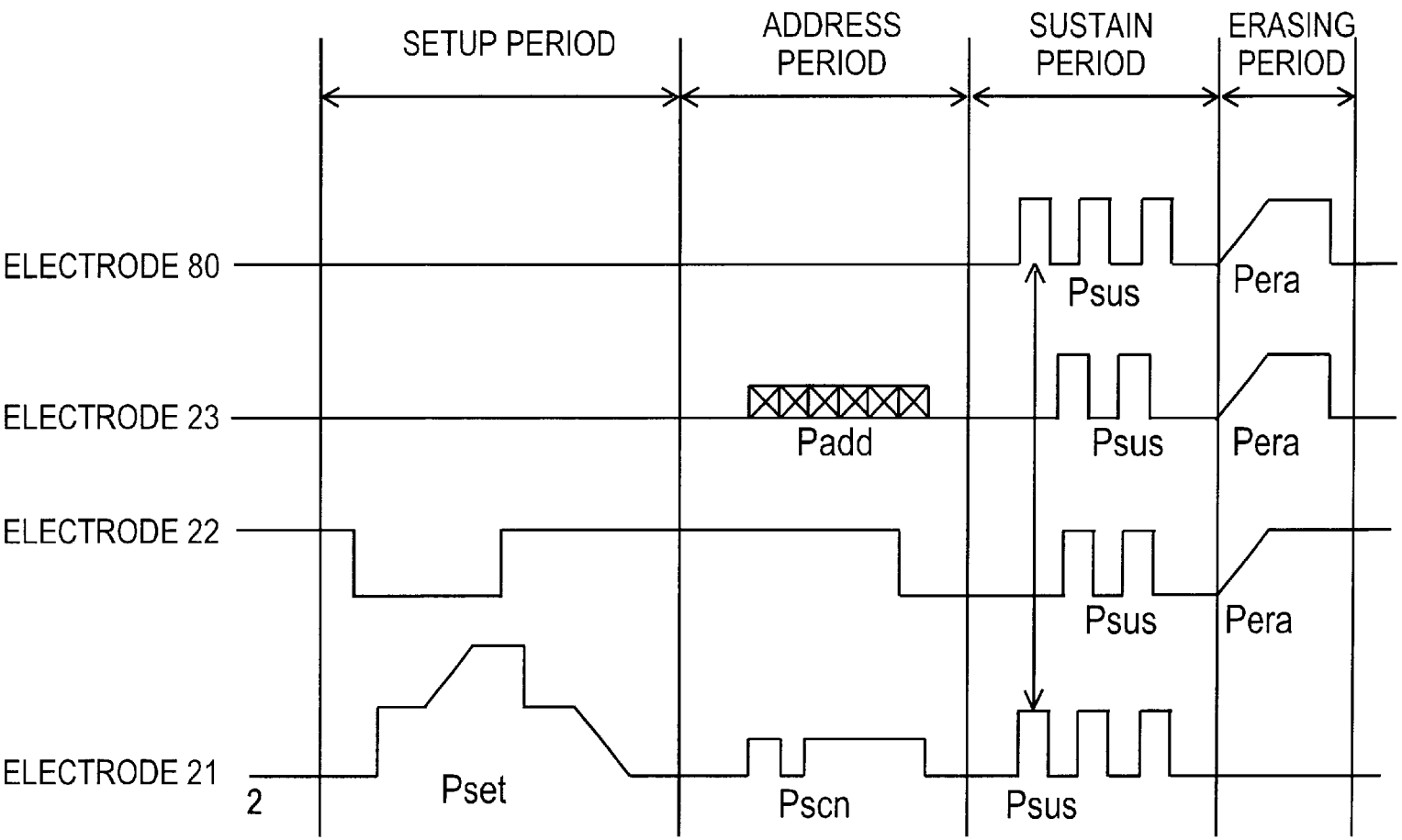
FIG. 56 shows a timing chart of pulse application on each electrode according to the sixteenth preferred embodiment.

FIG. 56 shows a timing charge of the application pulses of each electrode used in this embodiment. These pulses are prepared by adding application pulses for the support electrodes 80 to the application pulses described in the fifteenth embodiment.

The pulses applied on the support electrodes 80 are described below. The role of the support electrodes 80 is to synchronize with the electrodes 21 during the sustain period and to generate the sustain discharge. Therefore, the applied pulses are the sustain pulses Psu which are synchronized with the pulses applied on the electrodes 21 during the sustain period, and the erasing pulses Pe synchronized with the electrodes 23 and 22 during the erase period.

The discharge during the sustain period is described hereinafter in detail.

In order to gain higher luminance and higher efficiency, it is necessary to provide another electrode on which pulses synchronized with sustain pulses Psu applied on the electrodes 21. In this embodiment, the support electrodes 80 are disposed on the substrate 20 in parallel with the electrodes 23. The sustain pulses Psu synchronized with the electrodes 21 are applied on the support electrodes 80. This arrangement allows part of the sustain discharge from the electrodes 21 to move near the substrate 20. Furthermore, the electrodes 21 and the support electrodes 80 are synchronized and produce discharge, the concentration of the discharge current lowers, improving the emission efficiency.

Figure 57B:
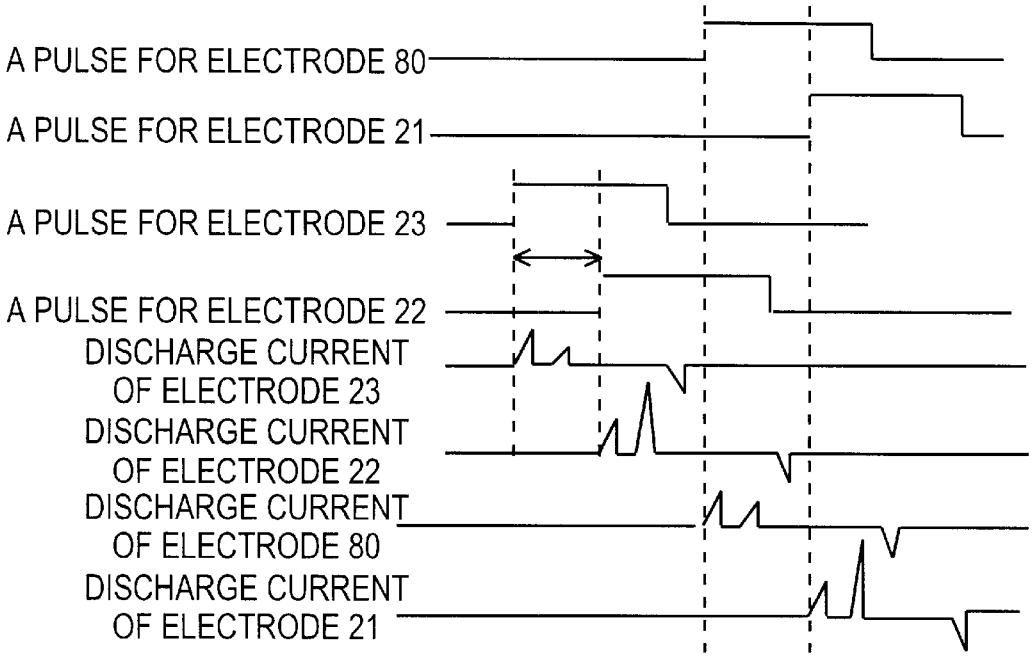
FIGS. 57A–57C show a timing chart of a sustain pulse application.
Figure 57A:
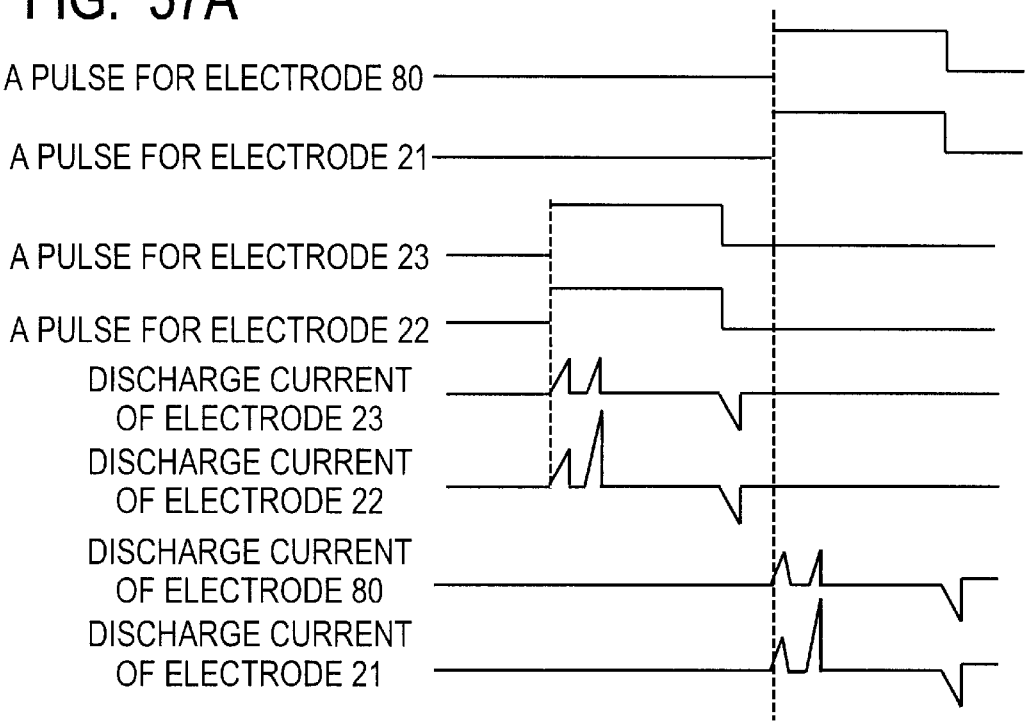
Figure 57C:
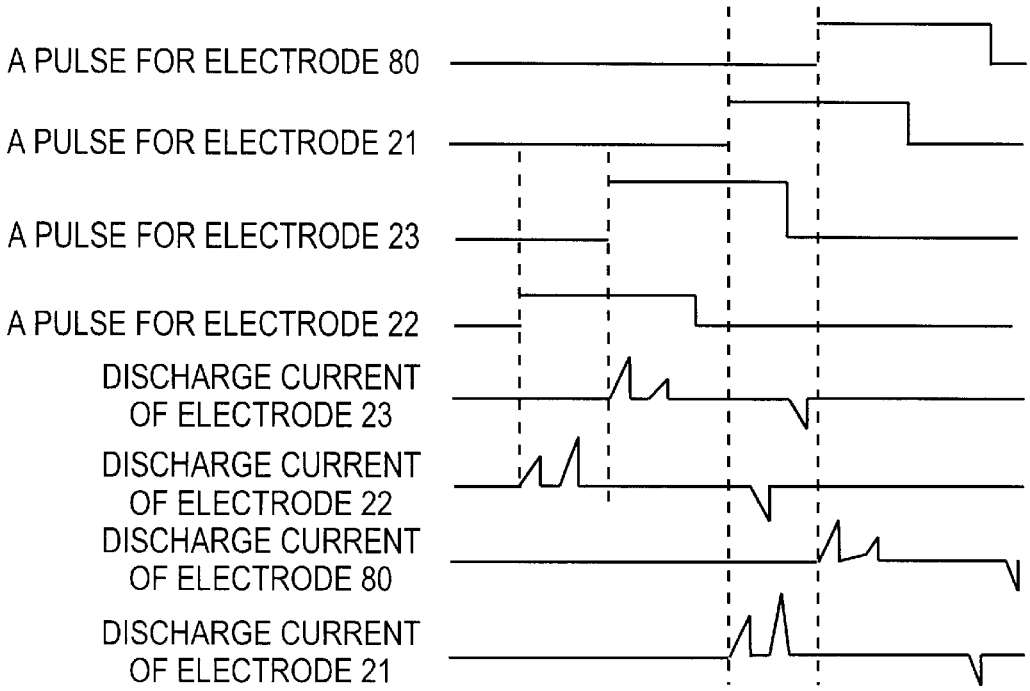
Figure 58:
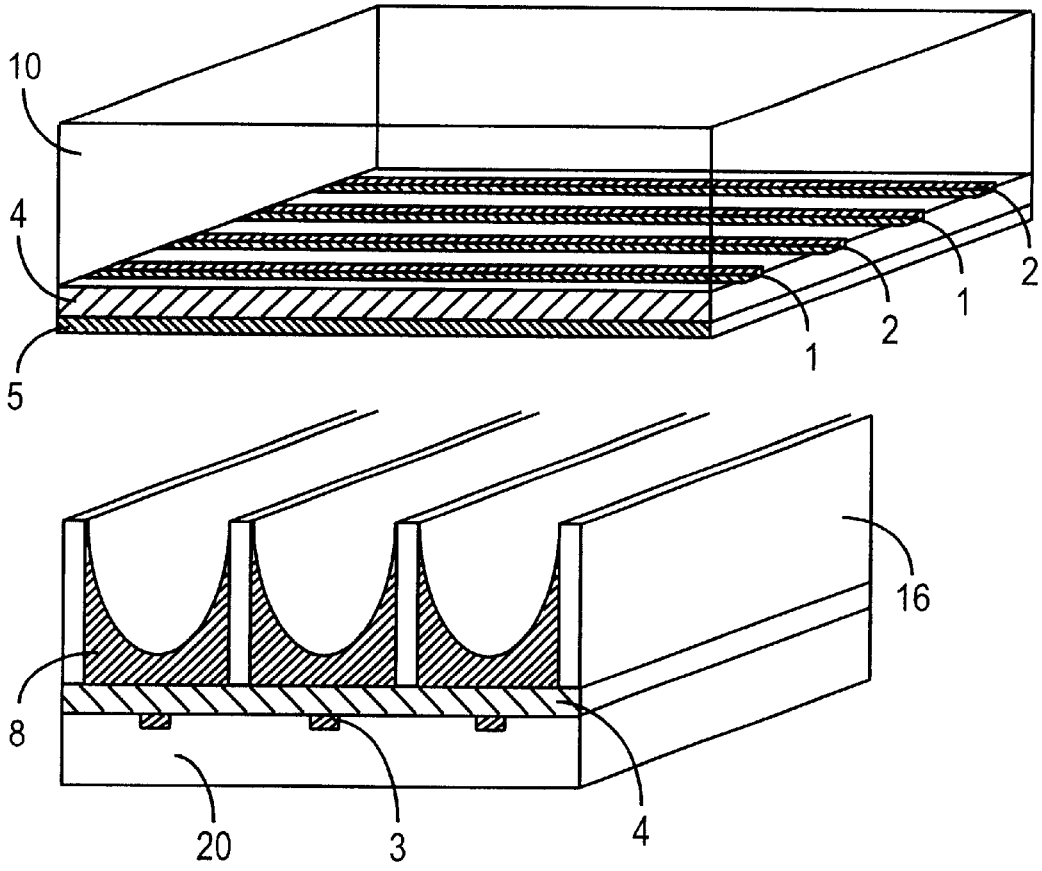
FIG. 58 PRIOR ART
FIG. 58 shows a perspective exploded view illustrating a construction of a conventional three-electrode surface discharge PDP.
Figure 1:
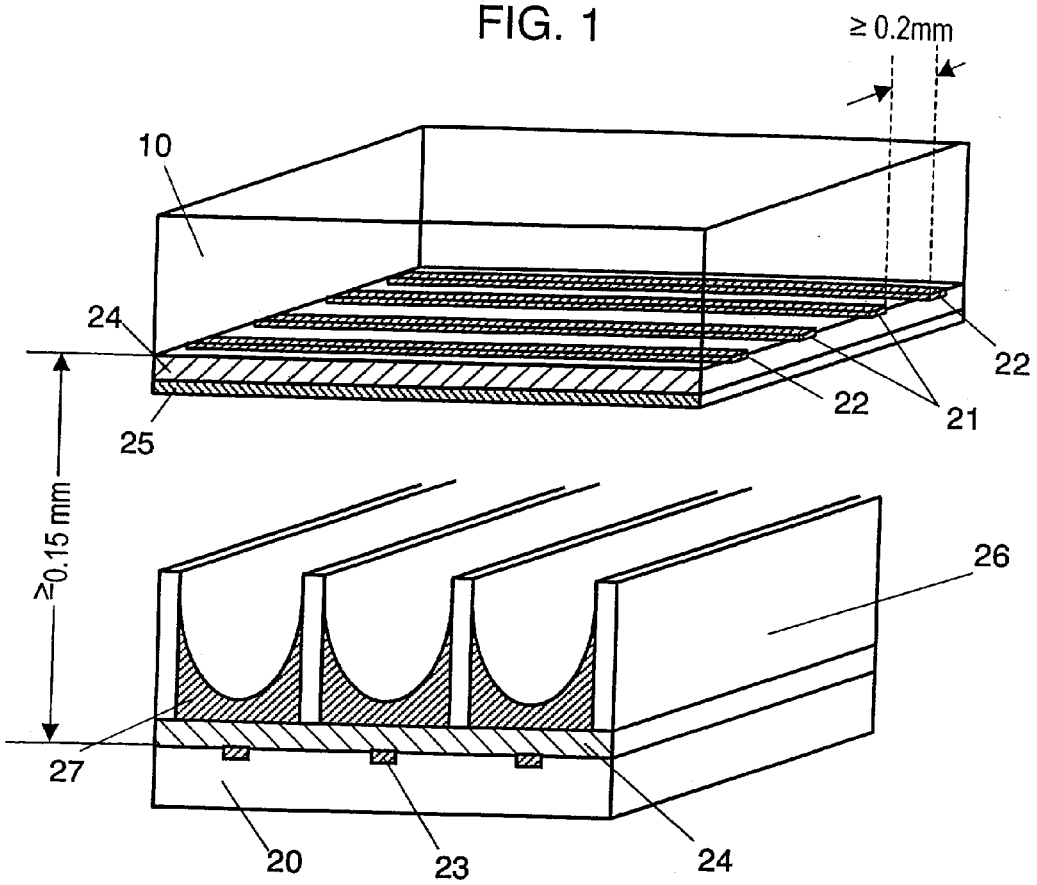
Figure 10:
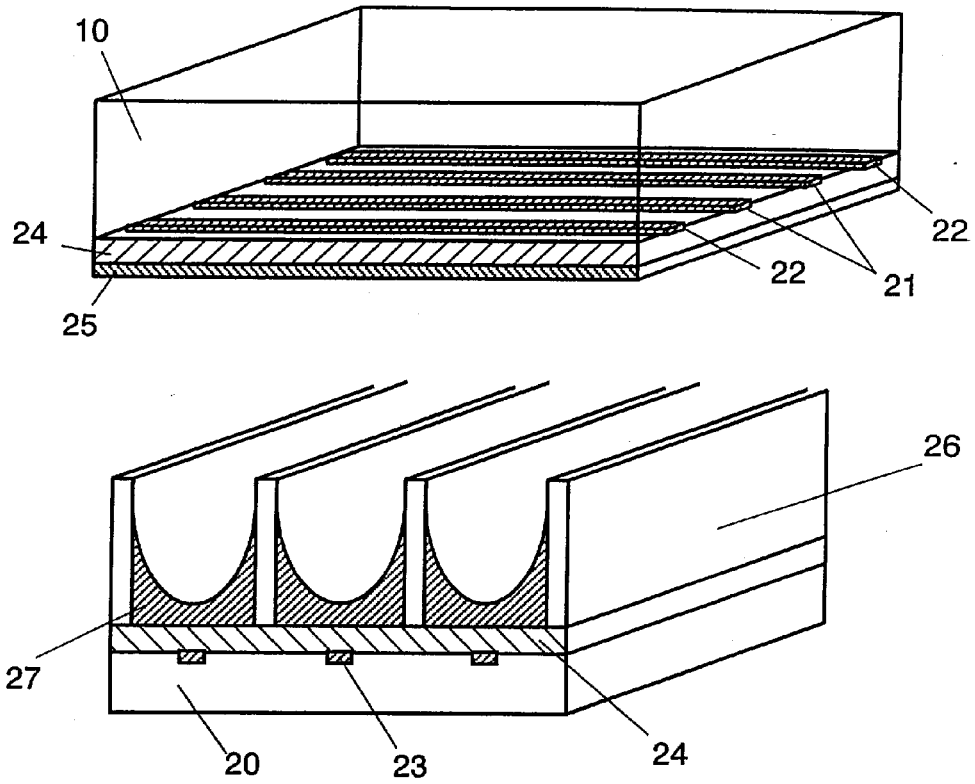
Figure 13:
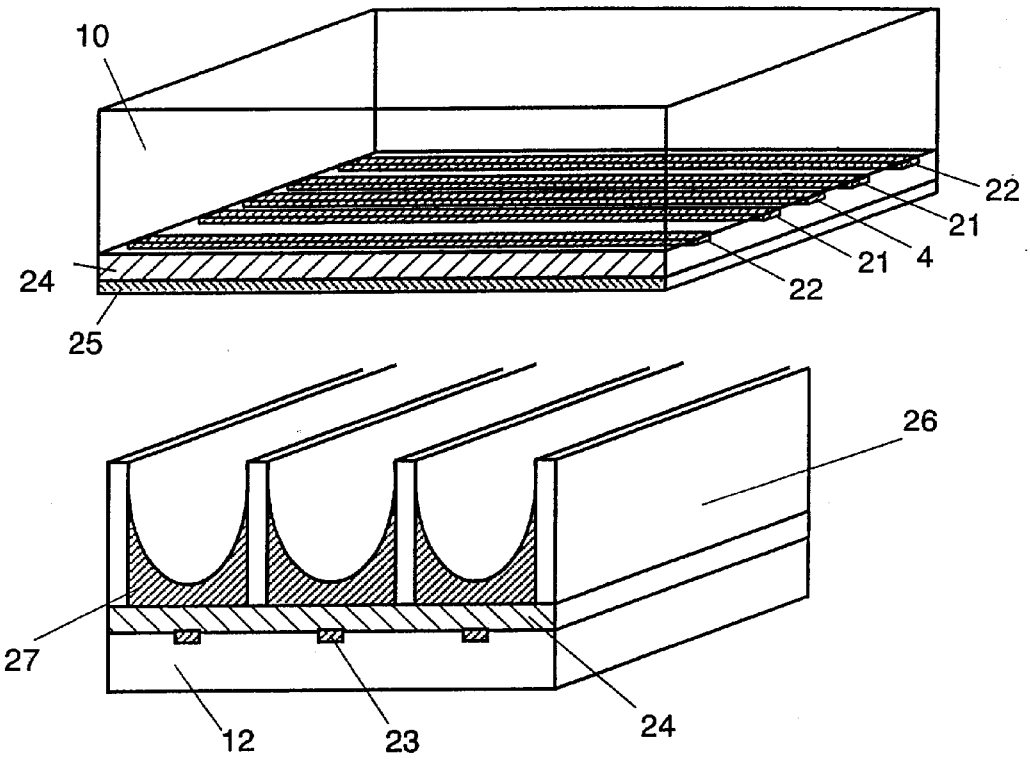
Figure 22:
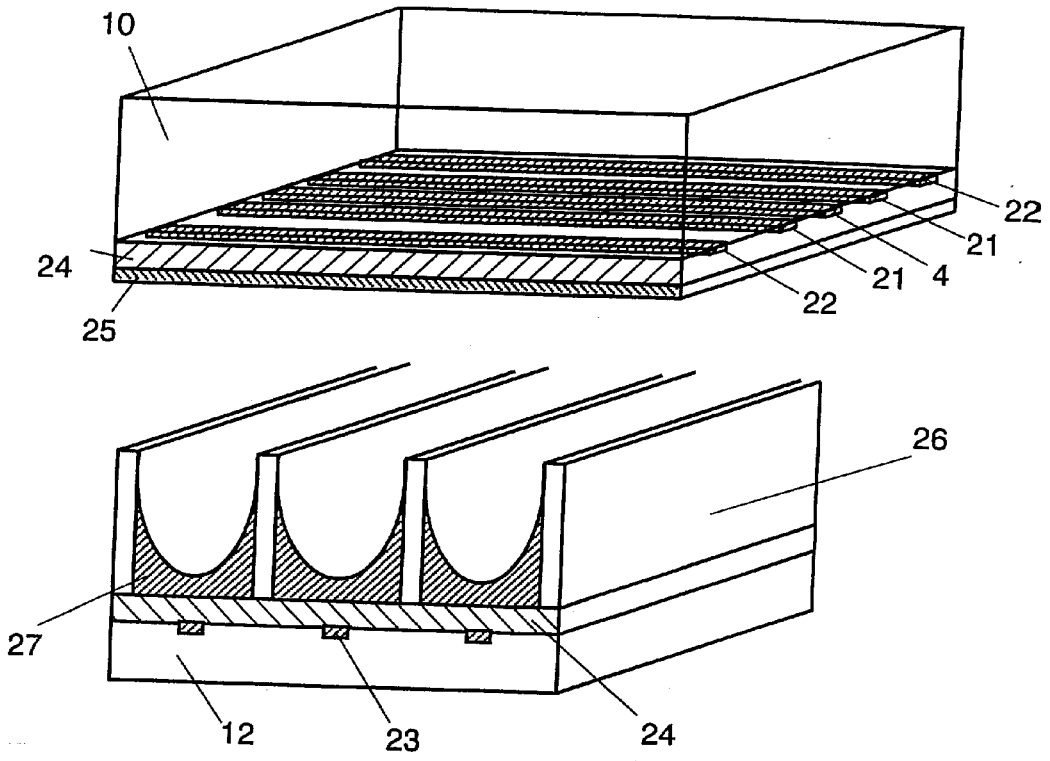
Figure 41:
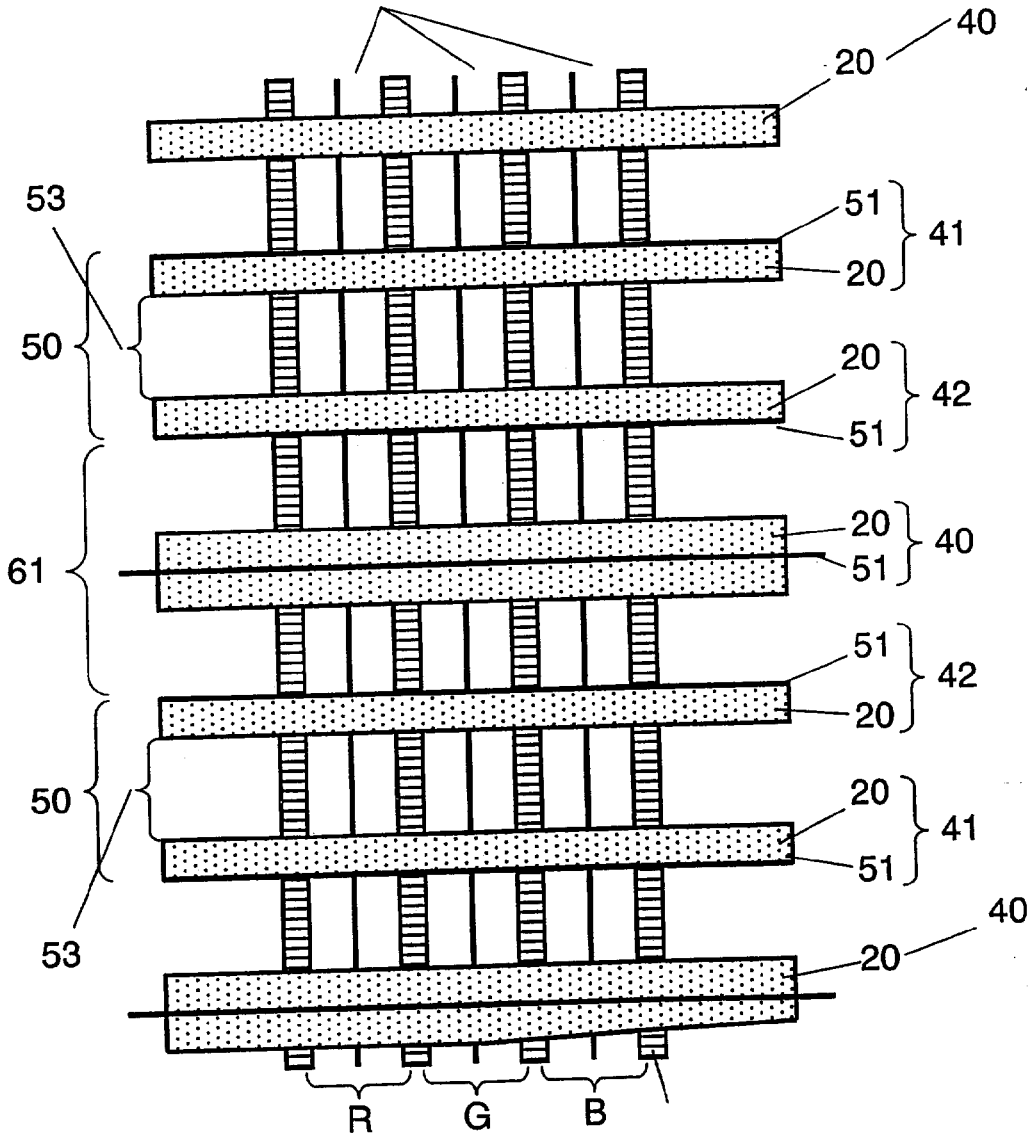
Figure 57C:
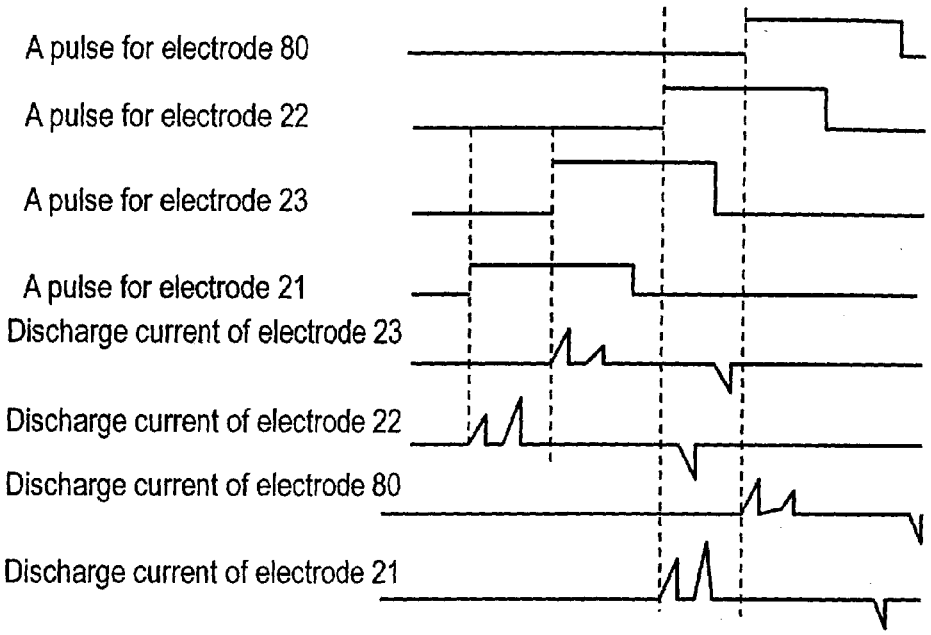

With regard to the application timing of the sustain pulses applied on the electrodes 23 and the support electrodes 80 is described briefly below. FIGS. 57A–57C show the sustain pulses and the discharge current applied on the electrodes 80, 21, 23 and 24. FIG. 57A shows the case when the timing of application on the electrodes 23 and 22 coincides. FIG. 57B shows the case when the sustain pulses applied on the electrodes 3 are 1 μsec or more ahead. FIG. 57C shows the case when the sustain pulses applied on the electrodes 23 are 1μsec or more behind.

When the application timings of the sustain pulses coincide, the discharge current flows adequately from the electrodes 21, 23, and 22, improving the luminance of the screen, and emission efficiency. On the contrary, the discharge with the application timings of the sustain pulses shown in FIGS. 57B and 57C, the discharge current from the support electrodes 80 and the electrodes 23 is reduced as the time gap from the beginning of the application of the sustain pulses on the electrodes 21 and 22 becomes bigger. The luminance of the screen and the emission efficiency are reduced to the level almost equal to that of the conventional method. To overcome this problem, the timing difference of the sustain pulses needs to be within 1 μsec.

As has been described, by disposing the support electrodes 80 in parallel with the electrodes 23, the surface discharge and the transverse discharge can be generated simultaneously. Due to this, the area of the phosphor, which is excited, increases, and since the electrodes 80 also contribute to the sustain discharge, the area of the electrodes increases, improving the emission efficiency.

As has been made clear by the preferred embodiments of the present invention, the driving method for the PDP of the present invention achieves production of stable positive column discharge and prevention of the flickering of the discharge. The positive column discharge produced in this manner is remarkably high in efficiency, and achieves high brightness.

The foregoing description was given based on a mixed gas of Xe/Ne (Xe 5%–15%, gas pressure 300–760 torr), however, the effect of the present invention can be obtained with a gas of different conditions providing the plasma discharge occurs.

According to the present invention, a plasma display panel which achieves high luminance, high emission efficiency and stable discharge can be provided by controlling the positive column discharge.

What is claimed is:

1. A plasma display panel comprising;

a pair of first and second electrodes disposed on a first substrate, which electrodes comprise display electrodes;

a third electrode disposed on a second substrate transversely to the first electrode;

a rib; and a phosphor layer, wherein an interval between said first electrode and said second electrode is 0.2 mm or longer, and a distance between said first substrate and said second substrate is 0.15 mm or longer.

2. The plasma display panel of claim 1, wherein an interval between said first electrode and said second electrode is longer than a interval between the neighboring ribs.

3. The plasma display panel of claim 1, wherein a plurality of third electrodes are disposed in a light emitting unit.

4. The plasma display panel of claim 3, wherein at least a part of said third electrodes are connected to each other.

5. The plasma display panel of claim 3, wherein a protrusion shorter than said ribs is formed in between said third electrodes.

6. The plasma display panel of claim 5, wherein the protrusions are formed in strip shapes and disposed in parallel to the third electrode.

7. The plasma display panel of claim 1, wherein at least one float electrode is formed between said first and said second electrodes, said first electrode and said second electrode comprising a display electrode pair.

8. The plasma display panel of claim 7, wherein said two or more float electrodes are partially connected.

9. The plasma display panel of claim 1, wherein a protrusion shorter than said rib is formed between said first electrode and said second electrode, said first electrode and said second electrode comprising a display electrode pair.

10. The plasma display panel of claim 1, wherein a part of the said rib is formed between said first electrode and said second electrode, said first electrode and said second electrode comprising a display electrode pair.

11. A plasma display panel comprising;

first and second electrodes disposed on a first substrate;

a third electrode disposed on a second substrate transversely to the first electrode;

a rib; and a phosphor layer, wherein a sustain discharge support electrode is disposed in parallel with said third electrode.

12. A plasma display panel comprising;

first and second electrodes formed on a first substrate; and a third electrode disposed on the first substrate via a dielectric layer transversely to said first electrode;

wherein an interval between said first electrode and said second electrode is 0.2 mm or longer.

13. A driving method of a plasma display panel comprising the steps of providing first and second electrodes formed on a first substrate of the plasma display panel;

providing a third electrode disposed on a second substrate of the plasma display panel transversely to the first electrode; and generating a surface discharge on the first substrate and a transverse discharge between said first substrate and said second substrate simultaneously.

14. The driving method of claim 13 and further comprising the steps of alternately applying a fast sustain pulse to said first electrode and to said second electrode at half a cycle during a display discharge period, and,applying a second sustain pulse synchronized with said first sustain pulse to said third electrode.

15. The driving method of claim 14, wherein said second sustain pulse applied to the third electrode and said first sustain pulse applied to said first electrode or said second electrode are synchronized within a time gap of 1 $\mu$s or less.

16. The driving method of the plasma display panel of claim 14, wherein the same sustain pulse is applied to said second electrode and to said third electrode, and the same sustain pulse is applied to said first electrode and to a fourth electrodes which fourth electrode provided in parallel with said third electrode half a cycle later, or the same sustain pulse is applied to said second electrode and to said fourth electrode, and the same sustain pulse is applied on the first and third electrodes half a cycle later.

17. The driving method of the plasma display panel of claim 14, wherein a pulse which is the same as an erasing pulse applied to said second electrode is applied to said third electrode.

18. The driving method of the plasma display panel of claim 14, wherein voltage and pulse width of the sustain pulse applied to said third electrode are set arbitrary at any value.

19. A driving method of a plasma display panel comprising the steps of;

providing a pair of display electrode and an address electrode transverse to said pair of display electrodes, wherein the address electrode resistance is variable or is set at 1 MΩ or more between the address electrode and ground.

20. A driving method of a plasma display panel having at least first, second and third electrodes, comprising the steps of (a) generating a potential difference between one of (1) said first electrode and said second electrode, said first electrode and said third electrode, and said second electrode and said third electrode, and (2) said first electrode and said second electrode, said first electrode and said third electrode or said second electrode and said third electrode;

(b) generating a first discharge current (I main) between said first electrode and said second electrode to emit light;

(c) generating a first counter electromotive force (Vemf-main), which suppresses fluctuation of said first discharge current, at one of (1) said first electrode and said second electrode, and (2) said first electrode or said second electrode; and (d) generating a second discharge current (I sub) between one of (1) said second electrode and said third electrode and said first electrode and said third electrode, and (2) said second electrode and said third electrode or said first electrode and said third electrode.

21. The driving method of the plasma display panel of claim 20, further, a third counter electromotive force (Vemf-sub), which suppresses fluctuation of the discharge current is generated at the third electrode.

22. The driving method of the plasma display device of claim 20, wherein when said potential difference is increased, a counter electromotive force Vemf-C which suppresses fluctuation of charge and discharge current of said plasma display panel is generated between one of (a) said first electrode and said third electrodes, said first electrode and said third electrode, and said second electrode and said third electrode, and (b) said first electrode and said third electrodes, said first electrode and said third electrode or said second electrode and said third electrode.

23. The driving method of the plasma display panel of claim 22, further, said third counter electromotive which suppresses fluctuation of the discharge current is generated at the third electrode.

24. The driving method of the plasma display panel of claim 20, wherein a peak value of the discharge current (I main) is reduced by 10% or more by said first counter electromotive force(Vemf-main).

25. The driving method of the plasma display panel of claim 20, wherein said second discharge current (I sub) is 10% or more of the sum of said first discharge current (I main) and said second discharge current (I sub).

26. The driving method of the plasma display panel of claim 20, wherein potentials of said first electrode and said second electrode are changed simultaneously against the third electrode.

27. The driving method of the plasma display panel of claim 20, wherein changing speed of potentials is 1.0V/ns or more in the process of creating a potential difference between said first electrode and said second electrode.

28. The driving method of the plasma display panel of claim 20, wherein the first counter electromotive force (Vemf-main) is changed according to display rate of the plasma display panel.

29. A driving method of a plasma display panel having at least first, second, and third electrodes, comprising the steps of applying a waveform of a sustain pulse to said first electrode and to said second electrodes, and applying a waveform of a potential difference between said first electrode and said second electrode which lowers as discharge current increases after discharge starts, and after the discharge stops, said waveforms maintain a voltage which do not trigger a discharge.

30. A driving method of a plasma display panel of claim 29, wherein said waveform of a potential difference between the first electrode and the second electrode has peaks or dips, or an overshoot-shape.

31. The driving method of the plasma display panel of claim 29, wherein the absolute value of the changing speed of voltages applied in discharge space is 1.0V/ns or more.

32. The driving method of the plasma display panel of claim 29, wherein a period when potentials of said first electrode and said second electrode becomes the same is shorter than 500 ns.

33. The driving method of the plasma display panel of claim 32, wherein a peak value of the discharge current between said first electrode and said second electrode is reduced by 10% or more.

34. A driving method of a plasma display panel comprising the steps of:

(1) providing first and second electrodes formed on a first substrate of the plasma display panel;

(2) providing a third electrode disposed on a second substrate of the plasma display panel transversely to the first electrode;

(3) reducing a potential difference between one of (a) said third electrode and said second electrode, (b) said third electrode and said first electrode, and (c) said third electrode and said second electrode, and said third electrode and said first electrode to generate a self-erasing discharge by its own wall charge between said electrodes; and (4) increasing a potential difference between one of (d) said third electrode and said second electrode, (e) said third electrode and said first electrode, and (f) said third electrode and said second electrode, and said third electrode and said first electrode to discharge to emit light using said self-erasing discharge as a trigger.

35. The driving method of the plasma display panel of claim 34, wherein the discharge is maintained by using the self-erasing discharge or trigger discharge as a trigger in the following cycle.

36. A driving method of a plasma display panel having at least first, second and third electrodes, comprising the steps of generating self-erasing discharge between one of (a) said second electrode and said third electrode and said first and said third electrodes, and (b) said second electrode and said third electrode or said first and said third electrodes; and when potential between said one is reduced, said self-erasing discharge is generated by its own wall charge when potential between electrodes is reduced.

37. A driving method of a plasma display panel having at least first, second and third electrodes, comprising the steps of generating self-erasing discharge between one of (a) said third electrode and said second electrode and said first electrode and said third electrode, and (b) said third electrode and said second electrode or said first electrode and said third electrode, and when a potential difference between said one is increased, and at this moment, a first discharge current (I main) is generated between said first electrode and said second electrode to emit light, and a second discharge current (I sub) is generated between said one using said self-erasing discharge as a trigger, said self-erasing discharge is generated by its own wall charge when potential between electrodes is reduced.

38. The driving method of the plasma display panel of claims 37, wherein when the first discharge current I main flows to emit light, a counter electromotive force (Vemf-main) which suppresses fluctuation of discharge current is generated on one of (1) said first electrode side and said second electrode side of a driving circuit, and (2) said first electrode side or said second electrode side of a driving circuit.

39. The driving method of the plasma display panel of claim 37, wherein when a potential difference between one of (1) said first electrode and said second electrode, said first electrode and said third electrode, and said third electrode and said second electrodes, and (2) said first electrode and said second electrode, said first electrode and said third electrode or said third electrode and said second electrodes is increased, a counter electromotive force Vemf-C which suppresses fluctuation of charge and discharge current of the plasma display panel is generated.

40. The driving method of the plasma display panel of claim 39, wherein a peak value of the discharge current I main is reduced by 10% or more by said counter electromotive force Vemf-main.

41. The driving method of the plasma display panel of claim 37, wherein when said second discharge current I sub flows, a counter electromotive force Vemf-sub which suppresses fluctuation of said second discharge current, is generated on said third electrode side.

42. The driving method of the plasma display panel of claim 37, wherein said discharge current I sub is 10% or more of the sum of said discharge current I main and said discharge current I sub.

43. A driving method of a plasma display panel having at least first, second and third electrodes, comprising the steps of (a) generating a trigger discharge between one of
(1) said third electrode and said second electrode and said first electrode and said third electrode, and
(2) said third electrode and said second electrode or said first electrode and said third electrode, (b) increasing a potential difference between one of;
(1) said third electrode and said second electrode, and said first and said third electrode; and
(2) said third electrode and said second electrode, or said first and said third electrode and at this moment, using said trigger discharge as a trigger, and (c) generating a first discharge current (I main) between said first electrode and said second electrode to emit light, and a second discharge current (I sub) between one of;
(1) said third electrode and said second electrode, and said first electrode and said third electrode; and
(2) said third electrode and said second electrode, or said first electrode and said third electrode.

44. A plasma display apparatus comprising;

at least first, second and third electrodes;

a fourth electrode in which charge which is generated by discharge between said first electrode and said second electrode accumulates, said fourth electrode being disposed in a non-discharge area; and a light-shielding material arranged between said first electrode and said fourth electrode which is the closest to said first electrode and between said second electrode and the fourth electrode which is closest to said second electrode.

45. The plasma display device of claim 44, wherein said light-shielding material is disposed on a non-discharge area between said first electrode and said second electrode.

46. A plasma display apparatus comprising;

a plasma display panel having at least first, second and third electrodes; and a driving circuit for;

(1) producing a potential difference between one of;
(a) said first electrode and said second electrodes, and between said first electrode, and said third electrode and said third electrode and said second electrode; and
(b) said first electrode and said second electrodes, and between said first electrode and said third electrode or said third electrode and said second electrode;

(2) generating a first discharge current (I main) to emit light between said first electrode and said second electrode;

(3) generating a first counter electromotive force (Vemf-main) which suppresses fluctuation of said first discharge current to one of
(a) said first electrode and to said second electrode; and
(b) said first electrode or said second electrode;

(4) generating a second discharge current (I sub) between one of;
(a) said third electrode and said second electrode and said first electrode and said third electrode; and
(b) said third electrode and said second electrode or said first electrode and said third electrode.

47. A plasma display apparatus comprising;

a plasma display panel having at least first, second and third electrodes; and a driving circuit which alters said third electrode to a floating state or to an electric resistance between said third electrode and ground 1 Mohm or more during a display discharge period.

48. A plasma display apparatus comprising;

a plasma display panel having at least first, second and third electrodes; and a driving circuit for maintaining one of;
(1) waveforms of sustain pulses applied to one of;

said first electrode and said second electrode; and said first electrode or said second electrode; and
(2) a waveform of a potential difference between said first electrode and said second electrode which decreases as discharge current increases after the initiation of discharge, and which are not started after discharge is terminated.

49. A plasma display apparatus of claim 48, wherein said waveforms have peaks and dips or have overshoot-shape.

50. A plasma display apparatus comprising;

a plasma display panel having at least first, second and third electrodes; and a driving circuit for inserting an inductance connected in series to one of said three electrodes, for at least one period during a discharge current flow.

* * * * *

UNITED STATES PATENT AND TRADEMARK OFFICE

CERTIFICATE OF CORRECTION

PATENT NO. : 6,376,995 B1 
DATED : April 23, 2002
INVENTOR(S) : Tetsuya Kato et al.

It is certified that error appears in the above-identified patent and that said Letters Patent is hereby corrected as shown below:

The title page should be deleted to appear as per attached title page.

Drawings,
The sheets of drawings, consisting of the illustrated figures 1, 10, 13, 22, 41 and 57C should be deleted to appear as per attached figures.

Title page,
Item [56], References Cited, U.S. PATENT DOCUMENTS, change "Anemiya" to -- Ameniya --.
Item [74], *Attorney, Agent or Firm*— change "Wendell" to -- Wendel --.

Signed and Sealed this

Twenty-fourth Day of June, 2003

JAMES E. ROGAN
*Director of the United States Patent and Trademark Office*

(12) United States Patent
Kato et al.

(10) Patent No.: US 6,376,995 B1
(45) Date of Patent: Apr. 23, 2002

(54) PLASMA DISPLAY PANEL, DISPLAY APPARATUS USING THE SAME AND DRIVING METHOD THEREOF

(75) Inventors: Tetsuya Kato, Sagamihara; Kazuo Tomida, Fuchu; Yoshio Watanabe, Yokohama; Hiroki Kono, Toyonaka, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/469,350

(22) Filed: Dec. 22, 1999

(30) Foreign Application Priority Data

| | | |
|---|---|---|
| Dec. 25, 1998 | (JP) | 10-369151 |
| Feb. 23, 1999 | (JP) | 11-044393 |
| Jun. 24, 1999 | (JP) | 11-177931 |
| Jun. 24, 1999 | (JP) | 11-177936 |
| Jul. 21, 1999 | (JP) | 11-205933 |
| Aug. 3, 1999 | (JP) | 11-219735 |

(51) Int. Cl.[7] ..... G09G 3/10
(52) U.S. Cl. ..... 315/169.3; 315/169.2; 315/169.4; 345/67; 345/204
(58) Field of Search ..... 315/169.1, 169.2, 315/169.3, 169.4; 345/55, 60, 67, 204

(56) References Cited

U.S. PATENT DOCUMENTS

| | | | | |
|---|---|---|---|---|
| 5,107,182 A | * | 4/1992 | Sano et al. | 315/169.4 |
| 5,661,500 A | * | 8/1997 | Shinoda et al. | 345/60 |
| 5,674,553 A | * | 10/1997 | Shinoda et al. | 427/68 |
| 5,943,030 A | * | 8/1999 | Minamibayashi | 315/169.3 |
| 5,995,069 A | * | 11/1999 | Tokunaga et al. | 315/169.4 |
| 6,037,916 A | * | 3/2000 | Anemiya | 345/60 |
| 6,084,559 A | * | 7/2000 | Nagao et al. | 345/67 |
| 6,144,349 A | * | 11/2000 | Awata et al. | 345/60 |
| 6,160,530 A | * | 12/2000 | Makino | 345/67 |

FOREIGN PATENT DOCUMENTS

| | | |
|---|---|---|
| JP | S57-22289 | 2/1982 |
| JP | 5-41164 | 2/1993 |
| JP | 5-41165 | 2/1993 |
| JP | 6-275202 A | 9/1994 |
| JP | 7-021929 A | 1/1995 |
| JP | 52-91373 | 1/1997 |
| JP | 9-068944 A | 3/1997 |

* cited by examiner

*Primary Examiner*—Don Wong
*Assistant Examiner*—Thuy Vinh Tran
(74) *Attorney, Agent, or Firm*—Parkhurst & Wendell, LLP

(57) ABSTRACT

The PDP of the present invention has first, second and third electrodes. Intervals between the first and second electrode is 0.2 mm or more. A plurality of third electrodes are formed. Protrusions which are shorter than ribs are formed between the plurality of third electrodes. The plurality of third electrodes are connected, in part, to one another or at least connected in part, such that they form a network. In the driving method of the PDP of the present invention, a self-erasing discharge is generated, and subsequently when a potential difference between the electrodes is increased, using the self-erasing discharge as a trigger, discharge is generated and light is emitted.

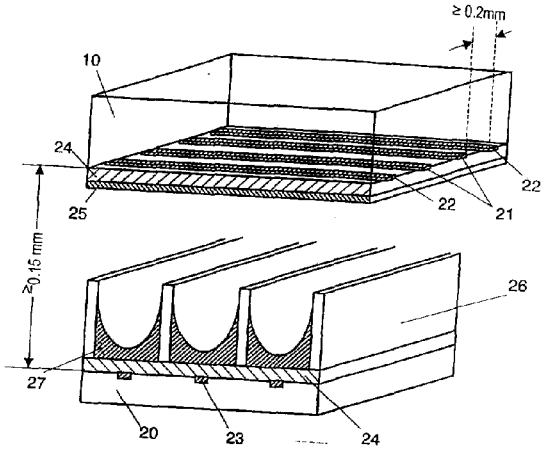

50 Claims, 59 Drawing Sheets